US006837640B2

(12) United States Patent
Kobayashi

(10) Patent No.: US 6,837,640 B2
(45) Date of Patent: Jan. 4, 2005

(54) APPLICATOR

(75) Inventor: Nobuaki Kobayashi, Nara (JP)

(73) Assignee: Sakura Color Products Corp. (JP)

( * ) Notice: Subject to any disclaimer, the term of this patent is extended or adjusted under 35 U.S.C. 154(b) by 0 days.

(21) Appl. No.: 10/368,841

(22) Filed: Feb. 18, 2003

(65) Prior Publication Data

US 2003/0123922 A1 Jul. 3, 2003

Related U.S. Application Data

(62) Division of application No. 09/659,851, filed on Sep. 12, 2000, now Pat. No. 6,554,521.

(51) Int. Cl.[7] ..... B43K 5/00
(52) U.S. Cl. ..... 401/206; 401/214; 401/141
(58) Field of Search ..... 401/141, 142, 401/205, 206, 214, 270, 273

(56) References Cited

U.S. PATENT DOCUMENTS

| | | | | |
|---|---|---|---|---|
| 853,156 | A | | 5/1907 | Brenton |
| 2,623,227 | A | | 12/1952 | Moonert |
| 3,003,183 | A | | 10/1961 | Rosenthal |
| 3,003,184 | A | | 10/1961 | Rosenthal |
| 3,233,275 | A | | 2/1966 | Hansen et al. |
| 5,082,386 | A | * | 1/1992 | Hironaka et al. ..... 401/206 |
| 5,362,168 | A | | 11/1994 | Abe et al. |
| 5,615,963 | A | | 4/1997 | Kobayashi |
| 5,871,296 | A | | 2/1999 | Furukawa et al. |
| 5,957,609 | A | | 9/1999 | Morita et al. |
| 5,967,688 | A | | 10/1999 | Hu |

FOREIGN PATENT DOCUMENTS

EP 626 276 A1 11/1994

* cited by examiner

*Primary Examiner*—Gregory L. Huson
*Assistant Examiner*—Huyen Le
(74) *Attorney, Agent, or Firm*—Wood, Phillips, Katz, Clark & Mortimer

(57) ABSTRACT

An applicator comprising:

a reservoir for holding therein an application liquid;

a valve assembly disposed in a distal region of the reservoir;

a tip disposed in front of the valve assembly;

the valve assembly comprising:

a valve chamber having a forward opening;

a valve body held in the chamber and movable fore and aft; and a biasing member for urging the valve body to be pressed against a circular rim around the opening so as to close it, the valve body having a distal portion in contact with a rear end of the tip, wherein the application liquid stored in the reservoir has a viscosity of 100 mPa·s or less, and the applicator further comprises a follower disposed in the reservoir and in rear of a column of the liquid so as to control flow rate of the liquid flowing out through the opening of the valve chamber, with the follower serving also as a back-flow inhibitor for the application liquid, and wherein a viscous material forming the follower shows the value of at highest '2' as the ratio of viscosity at 5° C. to viscosity at 35° C.

10 Claims, 42 Drawing Sheets

APPLICATOR

Divisional of prior application No. 09/659,851, filed Sep. 12, 2000 now U.S. Pat No. 6,554,521. Prior application information: Examiner: Huyen D. Le Group/Art Unit 3751 For CONTINUATION or DIVISIONAL Applications only: The entire disclosure of the prior application, from which an oath or declaration is supplied under Box 4*c*, is considered as being part of the disclosure of the accompanying continuation or divisional application and is hereby incorporated by reference. The incorporation can only relied upon when a portion has been inadvertently omitted from the submitted application parts.

FIELD OF THE INVENTION

The present invention relates to an applicator usable as a writing tool or as a cosmetic tool, and particularly relates to an applicator that comprises a reservoir of cylindrical or any other shape for holding therein an amount of an ink or a cosmetic liquid such that an applying tip may be soaked with the ink or liquid to apply same to any desired surface.

BACKGROUND OF THE INVENTION

The present applicant has disclosed in the Patent Laying-Open Gazette No. 9-323495 a free-inking applicator (viz., a writing tool) improved such that ink can smoothly be supplied enabling a continuous writing. This applicator for a writing use comprises a cylindrical ink reservoir and a fiber bundle tip, wherein the ink effluent from the reservoir flows through said tip due to capillary action. The applicator further comprises a valve assembly disposed in a distal region of the ink reservoir. Characteristically, this valve assembly is composed of a spherical valve body and a valve chamber that has a valve seat for supporting the valve body normally resting thereon. The valve seat has a forward opening and the valve body is movable fore and aft within the valve chamber. A spring urges the valve body towards the seat so that the tip disposed ahead the valve assembly has its rear end kept in contact with a forward portion of the valve body.

In the prior art applicator of the described structure, the spring disposed in the valve chamber forces the valve body to stop the forward opening lest any amount of ink should flow out of the applicator not being used. If however the tip is pressed against a paper sheet or the like to apply the ink thereto, then such a pressure to the tip will automatically push the valve body rearwards. As a result, the tip will be soaked with the ink continuously and at a moderate flow rate. Thus, the ink is prevented from trickling down in drops from the tip, but never causing the user to discontinue his or her writing motion for intermittent feed of the ink to the applying tip. There is no fear of any excessive amount of ink that will disable smooth and fine writings.

FIGS. 2 to 5 in the Gazette 9-323495 show the prior art examples wherein the applying tip has its proximal end of a diameter larger than that of the forward opening of the valve chamber. The valve body has a distal portion protruding forwards through the opening so as to contact the proximal end of the tip. The ink effluent through this opening is thus surely absorbed by and into this applying tip, thereby avoiding any dripping of the ink off said tip.

On the other hand, some of the known applicators comprise each an ink reservoir whose proximal or rear end is opened. A back-flow inhibitor such as a polybutene gel inserted in the rear region of the reservoir is capable of sliding therein in an axial direction. This inhibitor stopping the back-flow of ink does prevent ambient air from entering the reservoir's deep region in which the ink is retained. As the amount of the ink held in said reservoir decreases, the inhibitor will gradually move forwards ensuring smooth feed of ink.

In such a prior art structure, it may be necessary to suppress the flow rate of ink. For this purpose, the valve body may have to be of a diameter slightly less than the inner diameter of the valve chamber in order to reduce clearance between said body and the inner periphery of said chamber. In spite of those diameters nearly equal to each other, the valve body must surely seal the valve seat with the forward portion of said body sufficiently protruding from the forward opening out of the valve chamber when the applicator is not in use. To meet this requirement, it may be necessary for the valve seat to be of a concave shape precisely commensurate with the outer periphery of the valve body. However, such a machining of a material for the valve chamber is extremely difficult.

The valve body may, for convenience' sake, be a so small ball that the ordinary caulking process is feasible to form such a valve seat as providing a sufficient forward protrusion of the valve body and a reliable sealing effect thereof. An enlarged clearance around this body will raise the ink flow rate to an undesirable extent to cause the ink dripping. If viscosity of the ink and back-flow inhibitor is considerably low, then this drawback will become severer.

Therefore, a primary object of the present invention is to provide an applicator as well as an ink- or liquid-feeding mechanism incorporated therein, wherein its valve assembly is easy to manufacture and assemble, with the ink or liquid being capable of application to a foreign article at a moderately suppressed flow rate.

As discussed hereinbefore, the prior art writing tool is constructed such that a writing pressure causes a valve body to be retracted a little distance to open the valve assembly to thereby provide a small clearance through which an ink is dispensed. For ensuring a smooth flow-out of the ink, it is of a viscosity of about 100 mPa·s (viz., centipoise) or less. In order to prevent a superfluous discharge of the ink having such a low viscosity of 100 mPa·s or less, a highly viscous follower is disposed in the reservoir behind and in contact with a column of the ink. The follower will exert a viscosity resistance for the ink column so that the ink flows out through the opened valve at an appropriate rate.

Usually, the prior art followers are blocks of a polybutene gel. The present inventors have confirmed through their experiments that the polybutene gel would drastically change its viscosity in response to ambient temperature. In an atmosphere of a temperature of 5° C. corresponding to the winter room temperature, the polybutene gel will show a viscosity of about 100,000 mPa·s. In another atmosphere of a temperature of 35° C. corresponding to the summer room temperature, that gel will show a considerably lowered viscosity of about 35,000 mPa·s or less. If the follower must merely serve as a back-flow inhibitor, then such a polybutene will suffice. However the follower has to serve also as a flow regulator for controlling the flow rate of an ink or the like liquid commencing to flow out in response to small distance displacement of the valve body. Thus, there has been observed a problem that a drastic change in viscosity due to change in temperature would undesirably result in variation of flow rate of the ink or liquid to be applied, to such a degree as causing the ink dripping or scratchy writings.

Therefore, a second object of the present invention is to provide a liquid applicator whose valve body is movable a small distance to open the valve to smoothly flow out the liquid having a viscosity of 100 mPa·s or less at a moderate rate, without being adversely affected by any actual temperature change in living atmospheres. Reliable performance free from any liquid dripping or scratchy application has to be afforded herein.

Further in the described prior art applicators, an idle long elapse of time after used once has caused the applying tip to dry up. This is because the valve in the applicator not being used is closed to seal up the ink in the reservoir not to flow towards the tip. Even if the valve is opened again, the ink effluent from the reservoir will advance forwards merely at a limited and considerably low rate, failing to dissolve the dried ink and thus making it impossible to use the applicator any longer.

Therefore, a third object of the invention is to provide an applicator of the type that a liquid slowly exudes from a reservoir into an applying tip and improved such that even a long-term non-use might not dry up the said tip.

In the prior art writing tools, the spring has a sufficient biasing force so as to urge the valve body to firmly close the opening in the valve chamber, regardless of structure and/or size of the valve opening and the valve body. It is a matter of course that even such as strong biasing force is weaker than a writing pressure, because the valve body should be retracted a small distance when the tools are used. If the spring has an excessively high 'spring constant' (or more adequately 'spring modulus'), then actual biasing forces would vary among the springs undesirably due to slightly poor precision in dimension of molded members or in works for assembling them, impairing the performance of the writing tools. It is experimentally known that the writing pressure is usually 120 gf (viz., 'gram·force') or so in the conventional marking pen type of the writing tools. Accordingly, the biasing force is to be about 100 gf or less for the springs, and springs having a 'spring constant' of about 0.01 kg/mm have been employed for the purpose of quality assurance. In this case, the biasing force of finished products may be included in a range of 100±10 gf even if a dimensional error of about 0.1 mm were found in relevant members or parts. A maximum permissible value of the spring constant has been about 0.04 kg/mm.

As discussed just above, spring constant of the springs urging the spherical valve bodies or balls in the prior art has been designed as small as possible. However, as will be seen in FIG. 1(*b*) in the Gazette 9-323495, the ball tends to collide with a rear stopper in the valve chamber, with a bump or clunk. This motion of the ball will give to the user's hand an unpleasant feeling, when he or she uses the writing tool.

Therefore, a fourth object of the present invention is to provide an applicator of the type that a liquid slowly exudes from a reservoir into an applying tip when the tip is retracted a little by the writing pressure to open the valve, and of the following design. This applicator has to be improved such that a biasing member urging the valve towards its closed position has a biasing force that is balanced with the writing pressure only at an instant when the valve is opened. This structure will eliminate the feeling of collision, allowing the user to make a pleasant writing.

In addition to the drawbacks discussed above and inherent in the prior art applicators, there is another problem resulting from a structure that any ink pool is not formed outside the ink delivery opening in the valve. If the applying tip faces up for a long time while the applicator is used upside down, the valve kept open due to the writing pressure will allow an amount of ambient air to enter the valve chamber, from fore to aft. As a result, the ink and the back-flow inhibitor disposed behind same will tend to move back and to consequently flow out through the proximal opening of the ink reservoir, due to gravitational force.

Therefore, a fifth object of the present invention is to provide an applicator of the type that a liquid slowly exudes from a reservoir into an applying tip by means of a ink feed valve opened slightly when the applicator is used, and improved such that the ink is prevented from flowing back even when writing is done 'downside up'.

It is still another problem that bubbles entrained in the ink reservoir of the prior art applicator will allow the back-flow inhibitor to slide in a reverse direction towards the proximal end, particularly when the distal end of the applicator is kept up.

Therefore, a sixth object of the present invention is to provide an applicator of the type that a liquid slowly exudes from a reservoir into an applying tip, with a back-flow inhibitor being disposed behind a column of the liquid for application. This applicator has to be improved herein such that the liquid is prevented from dripping down to impair the smooth and continuous writing property. In this applicator, the back-flow inhibitor has to be retained in position not to slip off the reservoir so that leakage of the liquid is prevented from flowing out from the reservoir proximal end.

Further, each of the prior art applicators has to be constructed such that the applying tip is held in place to be capable of being retracted a limited distance, with this tip's rear end being kept in contact with a ball, i.e., a valve body. However, somewhat variation in dimension of the manufactured constituent members has sometimes caused the tip rickety fore and aft. Every time when the applicator is used repeatedly, the tip's rear face will be pressed against the ball, producing a small dimple in the rear face due to plastic deformation thereof. In such an event, the tip would be become more rickety so that not only vibrations are produced in the writings, but also the writing feeling is impaired.

Therefore, a seventh object of the present invention is to provide an applicator of the type that a liquid slowly exudes from a reservoir into an applying tip when the applying tip is retracted by a writing pressure to open the valve, and improved such that the tip is protected from undesirable rickety movements.

FIGS. 2 to 5 in the Gazette 9-323495 shows the prior art examples wherein the valve chamber (viz., valve housing) is substantially of a cylindrical shape with a thick peripheral wall. A valve seat and a spring rest are formed in the inner peripheral surface of said cylinder. However, such a valve chamber causes lower manufacture efficiency and a higher production cost.

It may be possible to employ a thinner cylindrical valve chamber retained in an end plug disposed in distal end of the ink reservoir. In this case, a distal end of such a valve chamber will easily be caulked at its distal outer periphery to provide a valve seat tapered towards the distal end. Mass production of those valve chambers may be feasible at a lowered cost, though the applying tip must have a proximal end having a diameter relatively larger than that of the opening formed in each of such valve chambers. This structure intended to prevent the dripping of the ink would inevitably cause a certain problem that the tip's proximal end face is forced against the constricted distal end of the valve chamber and/or against the spherical valve body of a reduced diameter. Consequently, a small dimple will be produced in said end face before long also in this case whereby the tip is rendered rickety. Further, the spherical valve body will come into a loose and idle engagement with an enlarged dimple, failing to be pushed back.

Therefore, an eighth object of the present invention is to provide an applicator of the type that a liquid slowly exudes from a reservoir into an applying tip, and improved such that the tip's proximal end face is protected from deformation while affording a high efficiency in manufacture of the applicators.

It has been a further problem in the prior art applicators that the valve once opened with the writing pressure imposed to the tip sometimes tends thence to stand open, causing superfluous discharge of ink. In order to avoid this problem, a stopper may be formed in the applicator to restrict retraction of the tip. Such a stopper will however give an unpleasant bumping or clunking feeling to the user when the tip collides with the stopper. A means for biasing the valve body is necessitated in this case in addition to this body, making it difficult to lower manufacture cost below a certain limit.

Therefore, a ninth object of the present invention is to provide a novel structure for a delivery valve dispensing a liquid to be applied, wherein the valve is capable of opening in response to the writing pressure or by intentionally thrusting inwards the tip in an improved manner. In detail, this structure, that does not need any biasing means in addition to the valve body itself, has to be effective to avoid the dripping of the application liquid ink. It is further desirable and now possible to protect the users from any unpleasant bumping or clunking feeling when they begin writing.

The Utility Model Laying-Open Gazette No. 6-79586 discloses an example of the prior art applicators each having a valve assembly disposed in a distal region of the ink reservoir. Also in this type, an applying tip is movable a limited distance fore and aft, so that the tip may be retracted to push back a valve body to open the valve assembly, thereby feeding a liquid to the tip for the writing purpose. In its inoperative position, the valve stands closed to interrupt the feeding of said application liquid.

In order to prevent the tip from being retracted beyond a limit in one embodiment of this prior art, the distal end of reservoir will abut against a shoulder formed in the proximal portion of said tip, with said distal end thus serving as a stopper. In another embodiment, a valve receiver disposed in the reservoir may abut against a valve body that is being pressed back with the tip, with said retainer as an alternative stopper. In any case, collision takes place between the tip's shoulder and the valve assembly's distal face, or between the valve body and the receiver. Thus, a bumping or clunking feeling will be given the user, making him or her unpleasant.

Therefore, a tenth object of he present invention is to buffer the described collision so as to diminish such an unpleasant feeling of bumping or clunking.

The Patent Laying-Open Gazette No. 7-266782 discloses a slit valve that is opened by thrusting inwards a pen-point tip so that ink held in a reservoir is fed to this tip. The slit valve (i.e., resilient body 8) in the prior art writing tool is a cylinder having a bottom in which cutouts are formed. The distal face of the bottom inclusive of the cutouts is in a close contact with the proximal face of the pen-point tip. In this type structure, the ink pressure imparted to a bottom of the slit valve tends to open those cutouts in normal (viz., inoperative) state of each writing tool. However, the rear face of each pen-point tip will hinder the slit valve cutouts from opening, although the latter will be allowed to open by retracting the tip. This will cause the ink to flow from the reservoir to the tip so as to supply thereto said ink, thereby making the writing tool ready for use.

In this type prior art writing tool, the slit valve cutouts will open wider when the tip is pressed back deeper. Consequently, a superfluous amount of ink will flow through the valve undesirably remaining open, causing the ink to drip off the tip.

Therefore, an eleventh object of the present invention is to provide a structure simplified but effective to inhibit an ink or the like application liquid from dispensed even if the tip is pressed back excessively, so as to avoid the problem of ink dripping.

The Patent Laying-Open Gazette No. 62-78486 discloses a writing tool such as a fiber bundle pen or a correction pen as well as a cosmetic tool such as a manicure liquid applicator. Also, an applying tip may be pressed back to exude the liquid such as ink into this tip applying them to a foreign object. The applicator of this type comprises a liquid holding reservoir, an aperture formed in distal end of the reservoir and discharging the liquid, and a valve body for opening and closing the aperture. A biasing member always urges the valve body forwards to normally keep the aperture closed. The applying tip disposed ahead the reservoir has a rear end in contact with the valve body, so that the aperture will open to be supplied to and around the tip's rear end when this tip is pressed back against resilient force of the biasing member. The tip's rear portion will absorb the liquid thus fed thereto, with the liquid subsequently migrating forwards within said tip. In use, the distal or forward end of this applying tip may be put onto and dragged along a paper sheet or a nail, so as to apply the liquid thereto.

However in the described prior art applicators, an idle long elapse of time after used once has caused the applying tip to dry up. This is because the liquid feeding aperture in the applicator not being used is closed to seal up the liquid in the reservoir not to flow towards the tip's proximal region. Even if the aperture is opened again by retracting the tip, this tip will scarcely absorb the liquid effluent from the reservoir, so that an excessive amount of the liquid falls down along the tip's outer periphery, causing the dripping of said liquid.

Therefore, a twelfth object of the present invention is to provide a liquid applicator of the type that the liquid in a reservoir is fed to and around the proximal end of an applying tip in response to retraction thereof, and improved such that any long elapse of time after use does not cause dry up of said applying tip.

SUMMARY OF THE INVENTION

In general, the present invention provides an applicator constructed such that a valve body disposed in a valve chamber is urged towards an opening formed therein to close it to stop supply of a liquid such as an ink to an applying tip during nonuse of the applicator. The distal end of the applying tip can however be pressed on a paper sheet or the like to produce an application pressure forcing rearward displacement of the valve body to initiate supply of the liquid to the tip. Thus, any dripping or flooding of the liquid around the tip will not take place from or around the tip on one hand, and any interruption of use is not necessary for supplying the tip with the liquid.

In detail and to achieve the primary object set forth above, the applicator of the invention may comprise a flow restrainer disposed in the valve chamber and upstream of the valve body so as to move fore and aft a limited distance. In this case, the biasing member disposed behind such a flow restrainer will urge through the valve body through this strainer towards a valve seat. This structure simply uses the flow restrainer, in addition to the valve body, to be incorporated in the valve chamber. Thus, it is advantageous in that any surplus and intricate work is neither required in manufacture, nor complicating the machining of the liquid feed valve composed of the chamber, the seat and so on. Any excessive amount of the liquid of a low viscosity will be fed no longer to the applying tip.

In order to achieve the second object set forth above, the applicator of the invention may comprise a follower or back-flow inhibitor made of a viscous material whose viscosity shows no impermissible change in response to ambient temperature varying within a range of 5° C. to 35° C. This follower will serve to regulate flow rate of the application liquid whose viscosity is low and for example about 100 mPa·s or less. Such an applicator will work smoothly all the year around, never causing blurred writings (due to poor supply of ink) nor irregularly thickened strokes (due to excessive supply of ink). This advantage is afforded herein without needing any novel and additional structure, but simply by improving the back-flow inhibitor only.

In order to achieve the third object set forth above, the applicator of the invention may comprise an applying tip coated with a plastics or with a metal. This tip normally disposed inside an external cylinder of the applicator will now be protected from drying up, enabling storage thereof for a long time.

Alternatively, the third object may be achieved by forming a distal stopper for the reservoir entirely or partially with a gas-permeating material. The stopper of this material is exposed not only inside the reservoir but also around the tip. A solvent vapor emitted from the liquid remaining in the reservoir will be transmitted through the permeative material to around the tip. Such a simply improved feature will nevertheless be enough to suppress evaporation of the solvent out of the tip, thus preventing it from drying up.

Still another option is provided herein to achieve the third object, wherein at least the proximal portion of the tip is disposed inside the external cylinder together with valve assembly and reservoir. A first closed space is formed between the proximal portion and the cylinder, with a second one formed between the reservoir and the cylinder. Those first and second spaces communicate with each other, and an anti-drying agent is placed in the second space. By virtue of this feature, the applying tip disposed in the cylinder will be protected well from drying, enabling a long time storage of the applicator.

In order to achieve the fourth object set forth above, the applicator of the invention may comprise a biasing member urging the valve body towards its closed position. The 'spring constant' of the biasing member is selected herein such that the urging force thereof will increase almost abruptly, once the valve body is retracted a small distance. Such a suddenly increasing urging force will withstand well the writing pressure imparted to the tip, never producing any feeling of collision even when the tip is retracted, thus affording a natural and smooth touch.

In order to achieve the fifth object set forth above, the applicator of the invention may comprise a check valve between the feed valve and the reservoir. This check valve disposed behind the feed valve for moderately supplying an ink to the tip will operate to prevent the ink from flowing back and out of the proximal end of said reservoir.

In order to achieve the sixth object set forth above, the applicator of the invention may comprise an air inlet and an obstructer in relation to a back-flow inhibitor. This inhibitor, following the tail of the column of an application liquid within a reservoir so as to move forwards as the liquid is being spent, will slide forwards as in the prior art. The air inlet and the obstructer provided herein are formed in the rear end portion of the reservoir, so that the inhibitor can more smoothly advance forwards, while at the same time preventing it from moving backward even when the applicator is held upside down. Further, even if the reservoir has a fully opened rear end, the obstructer in the present invention will stop the inhibitor from slipping off through such a rear end, and thereby retaining the liquid never to escape through said end.

In order to achieve the seventh object set forth above, the applicator of the invention may comprise a second biasing member in addition to the first one already described above. This second biasing member urges the proximal end portion of the tip inwardly (viz., backward) with an elastic force weaker than that of the first biasing member acting on the valve body. By such a structure, the tip receiving two urging forces acting towards each other will no longer make a rickety motion. The weaker second biasing member will not cause any unintentional opening of the valve.

In order to achieve the eighth object set forth above, the applicator of the invention may comprise a tip stopper inhibiting the tip from retraction beyond a given limit. The valve chamber has its distal end region that may be a cylindrical portion located behind the proximal end of the tip, and is possibly constricted and tapered towards its distal extremity. The rear face of the tip will no longer tend to be collapsed, because neither the valve body nor the valve chamber's distal end does impart to said face any intolerable force.

In order to achieve the ninth object set forth above, the applicator of the invention may comprise a valve body formed of an elastically compressible material and disposed in a valve chamber that is in turn defined between a valve stopper and a valve seat. A passage for allowing the application liquid to flow out of a reservoir and then into the chamber is formed in and through the valve stopper. The valve body in this case will be compressed in a fore-and-aft direction, as the tip is retracted towards the reservoir. If the application is not in use, the valve body keeps the outlet aperture or opening of the valve chamber so as to interrupt ink feed. If however the valve body is pressed with a natural writing pressure imparted to the tip or by intentionally pressing back the tip, then the outlet opening in the valve seat will be opened to supply the ink from the reservoir to the tip at a moderate and proper low rate. Thus, this applicator can now be used to make smooth writings, without suffering from any problem of ink dripping. Further, the elastically compressible valve body will reduce the bumping or clunking touch that would make the users unpleasant. In addition, such a elastic valve body make it possible to dispense with any conventional biasing members such as a spring. Preferably, this applicator may be designed such that the valve body occasionally receiving a strong pressure exceeding a certain given limit will bear against an internal wall surface of the valve chamber so as to bring the valve into its closed position. This feature is advantageous in that any excessive pressure that might be applied to the writing tip would never give any superfluous amount of ink to said tip, during a continued operation of writing, thus preventing the problem of ink dripping.

In order to achieve the tenth object set forth above, the applicator of the invention may comprise a resistant member that prevent the tip from backward displacement beyond a given limit. This resistant member may be made from a buffering material such as a silicone rubber. In use, the tip being pressed back will collide with such a buffering resistant member, without giving rise to any unpleasant touch of bumping or clunking.

In order to achieve the eleventh object set forth above, the applicator of the invention may comprise a valve assembly interposed between an ink reservoir holding an application liquid and an applying tip disposed ahead the reservoir to be movable fore and aft. The valve assembly, that remains closed unless the applicator is used, will open in response to retraction of the tip within a given range so as to feed the ink from the reservoir to the tip. If however the tip is pushed back beyond the limit, then the valve assembly will be closed again. This means that usual writing pressure or intentional moderate pressure imparted to the tip will allow normal feed of ink thereto, while inhibiting ink feed when the tip is too strongly pressed back. Thus, fine writings or painted surfaces will be obtained, free from any defect that would otherwise be caused by the ink dripping or the like.

In order to achieve the twelfth object set forth above, the applicator of the invention may be constructed such that at least the proximal portion of the tip is disposed inside the external cylinder together with valve assembly and reservoir. A first closed space is formed between the proximal portion and the cylinder, with a second one formed between the reservoir and the cylinder. Those first and second spaces communicate with each other, and an anti-drying agent is placed in the second space. By virtue of this feature, the applying tip disposed in the cylinder will be protected well from drying, enabling a long time storage of the applicator. When use of the applicator is resumed after the long term storage, any blurred writings will not be made. This is because the liquid discharged through the feed opening is smoothly absorbed into the tip. Any dripping of the ink that is a hindrance to fine writings will not take place in this applicator.

BRIEF DESCRIPTION OF THE DRAWINGS

FIG. 25(*b*) is a fragmentary front elevation corresponding to FIG. 25(*a*);

FIG. 31(*b*) is an enlarged fragmentary cross section corresponding to FIG. 31(*a*), but the distal opening of the housing is opened in response to the applying tip that has made action relative to the housing;

FIG. 33(*b*) is a schematic cross section corresponding to FIG. 33(*a*), but the distal opening of the housing is opened due to the pressure which the applying tip is exerting;

FIG. 33(*c*) is a schematic cross section also corresponding to FIG. 33(*a*), but the distal opening of the housing is closed again due to an excessive pressure which the applying tip is exerting;

DETAILS OF THE INVENTION

Figure 1:
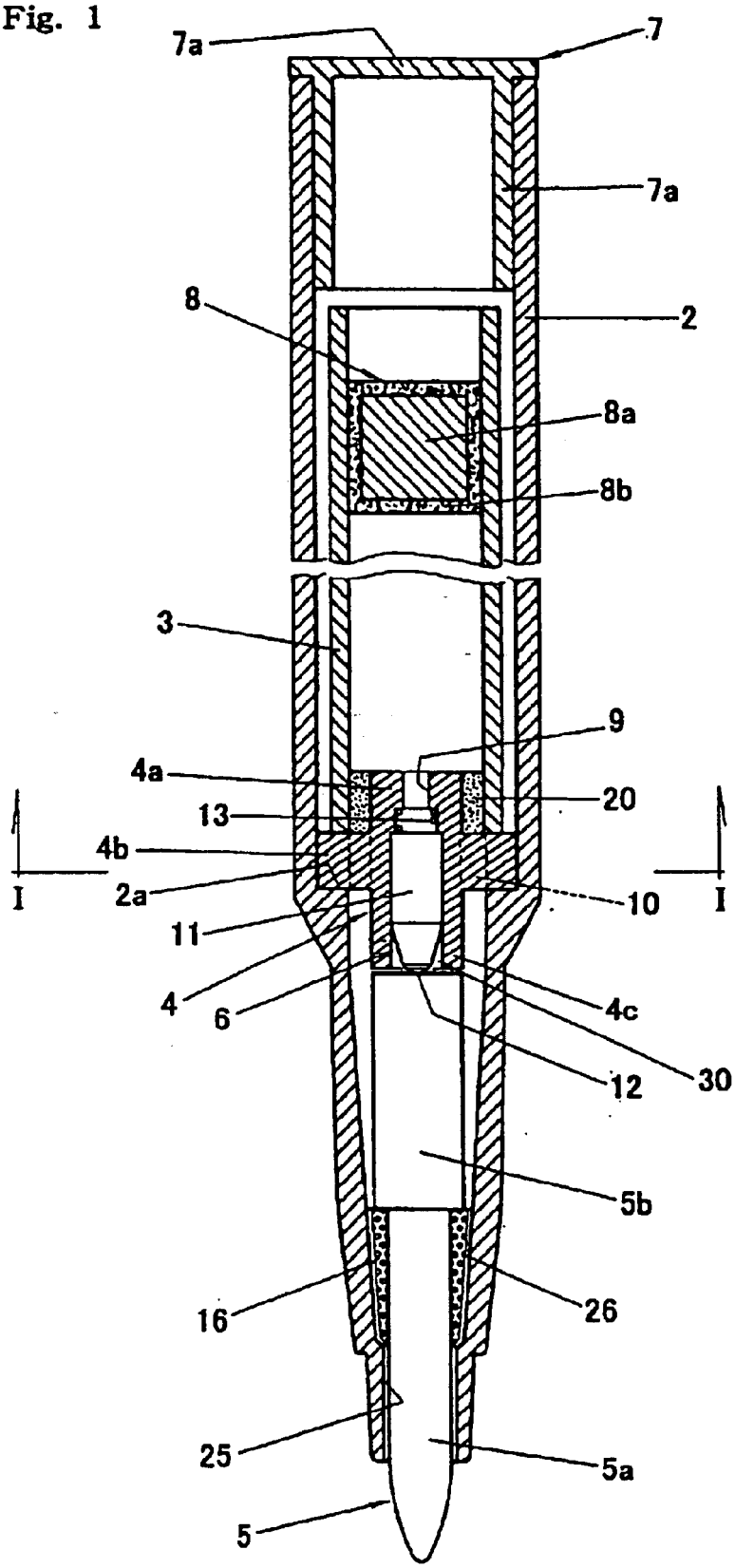
FIG. 1 is a vertical cross section of an applicator provided in an embodiment of the present invention.
Figure 2:
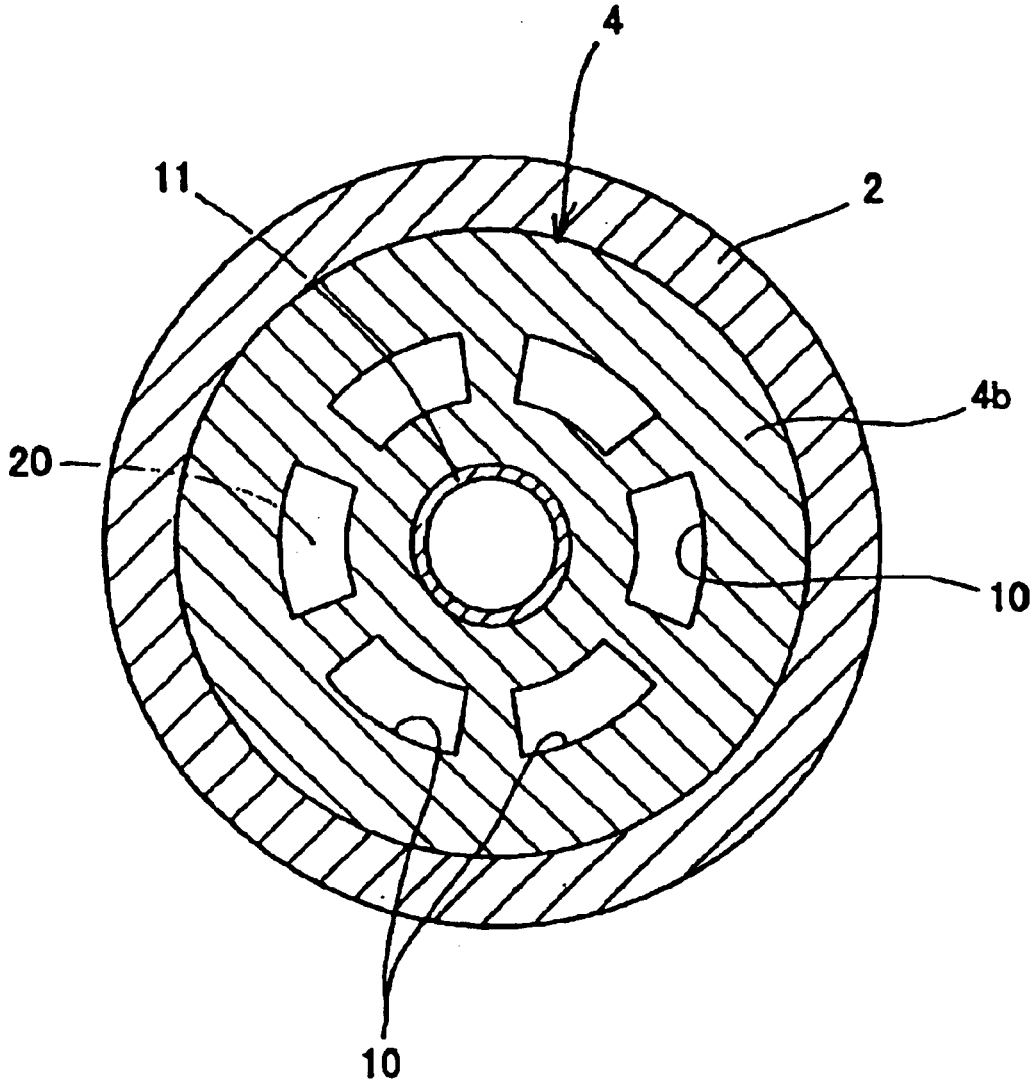
FIG. 2 is a cross section taken along the line I—I in FIG. 1.
Figure 3:
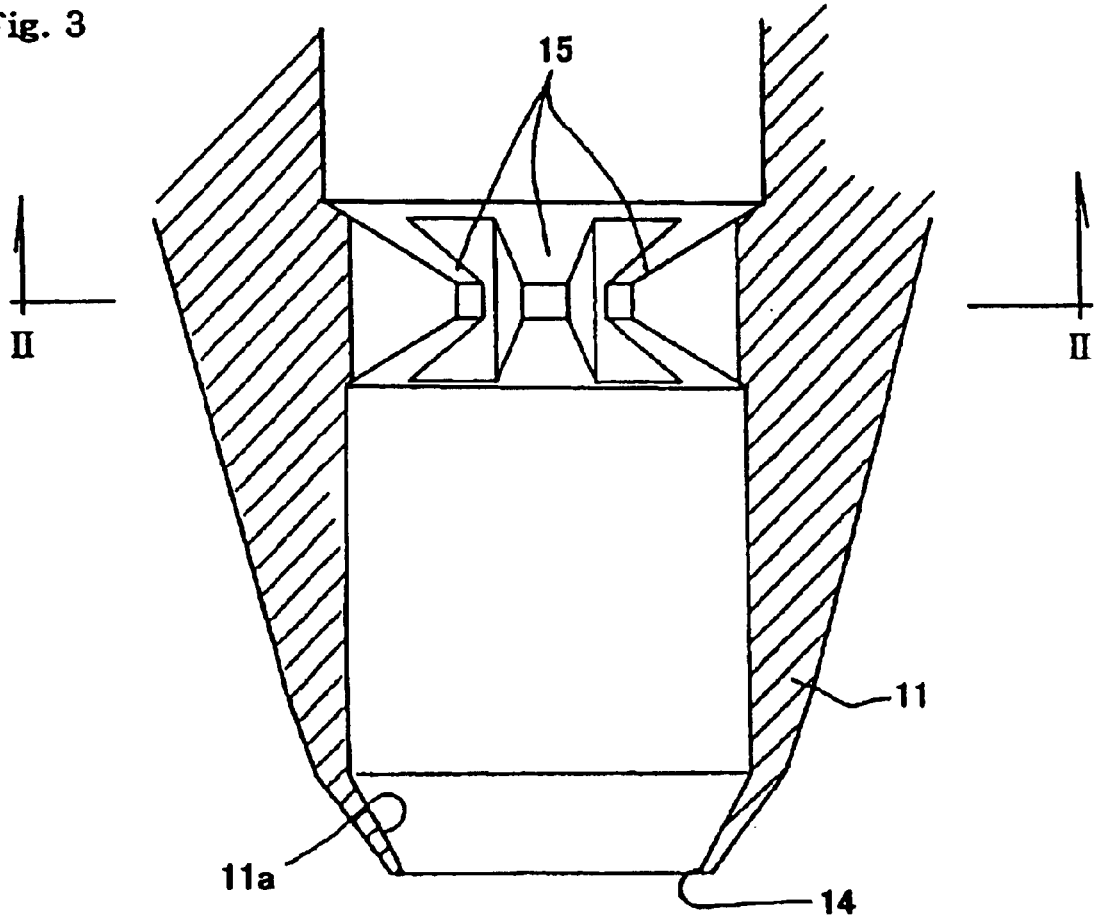
FIG. 3 is an enlarged fragmentary cross section of the distal portion of a valve housing included in the applicator shown in FIG. 1.

In a first mode of carrying out the invention to achieve the first object, the applicator comprises a reservoir for holding therein a given amount of the application liquid, and a liquid-supplying valve assembly disposed in a distal region of the reservoir. The valve assembly comprises a valve chamber having a valve seat opened forwardly, a valve body accommodated in the chamber and movable fore and aft to rest on and depart from the seat, and a flow restrainer also placed in the chamber and movable fore and aft and disposed in rear of the valve body. The valve assembly further comprises a biasing member disposed in rear of the flow restrainer such that this member urges the valve body through the restrainer towards the seat.

The applicator may for example be a writing tool, a cosmetic tool or the like. The application liquid may either be an aqueous one or a lipophilic or oily one, such as any ink or any mass-coloring agents, depending on usage of the applicator. The reservoir is preferably of a cylindrical shape. In a case wherein the cylindrical reservoir (viz., an ink cartridge) is opened at its proximal end, a back-flow inhibitor may be installed in the reservoir and behind a column of such an ink. The present invention may also apply to another case wherein the cylindrical reservoir is closed at its proximal end to thereby form an air-replacement type. Preferably, the valve body is of a spherical shape, with the distal region of the valve chamber being of a funnel-like shape constricted forwardly. In this case, the distal end opening of said chamber has a diameter a little smaller than that of the spherical valve body. It may be possible to form in the valve chamber a shoulder portion behind the valve body, so as to prevent it from entirely sinking into the chamber.

A pen-point tip may be disposed in front of the liquid-supplying valve assembly provided in the first mode. A rear end of this tip will be held normally in contact with a front end of the valve body. In the inoperative state of this structure with the biasing member urging the valve body towards the seat, the opening formed in this seat will normally be closed. In other words, ink supply is interrupted due the reservoir shut up with the valve assembly so long as the applicator stands inoperative. If however the distal end of the tip is pressed on a paper sheet or the like to make some writings thereon, the proximal end of the tip will urge the valve body inwardly so as to open the opening in the valve seat. If the valve body is spherical in shape, then it will be able to tightly close the opening whichever position it may take, and it will provide a reliable clearance around it to pass a flow of the ink even it were pushed inwards a small distance. Further, the flow restrainer as a discrete member employed in addition to the valve body does render it unnecessary to rely on the interstice that is present between the valve body and the inner peripheral wall of the chamber, for the purpose of flow control of the application liquid. The valve body can thus be made relatively smaller in diameter without any fear of bringing about an excessive flow rate of the ink, because a narrow passage will naturally be provided between it and the chamber inner wall. It is now easy to machine the valve seat and to incorporate the valve body and flow restrainer in the assembly, thereby improving yield of products passing every test and thus lowering the overall manufacture cost. The small diameter valve body that has a small radius of curvature makes larger its portion protruding forward through the opening formed in the valve seat, so that somewhat poor precision of assembly will not affect adversely the required performance of the applicator, but ensuring a greater stroke for the valve body.

It is preferable in the first mode that the clearance appearing between the valve chamber inner wall and the valve body having departed from its seat be designed larger than the clearance between the flow restrainer and said wall. This is possible by employing a smaller valve body in combination with a larger flow restrainer.

The valve body may preferably be a ball, with the restrainer being another ball or a column whose diameter is larger than that of the valve body.

Also preferably, the pen-point tip disposed in front of the liquid-supplying valve assembly in the first mode may have its rear end in contact with the distal portion of the valve body. In use, application pressure unparted to the tip will push back the valve body so that the liquid is fed thereto through the valve at a moderately low rate. The tip may be made of a material such as a fiber bundle through which the liquid can be exuded due to capillary phenomenon or the like. Diameter of the tip rear end may be designed larger than that of the valve opening so that the liquid such as an ink flowing out through this opening can surely be absorbed by the tip, without dripping.

Also in the first mode, the reservoir may be a cylindrical member disposed in an external cylinder having a distal end to which the tip is connected to be retractable. Such a double-wall structure enables on one hand the replacement of only the reservoir, and increases freedom in selecting and designing the material and its strength forming the reservoir.

In a second mode of carrying out the invention to achieve the second object, the applicator comprises a reservoir for holding therein a given amount of the application liquid, and a valve assembly disposed in a distal region of the reservoir. The valve assembly comprises a valve chamber having a forward opening, a valve body accommodated in the chamber and movable fore and aft to rest on and depart from the seat, and a biasing member for urging the valve body to be pressed against a circular rim around the opening so as to close it. The applicator comprises a tip in front of the valve so that a distal portion of the valve body is in contact with a rear end of the tip. The applicator may for example be a writing tool, a cosmetic tool or the like. The application liquid may either be an aqueous one or a lipophilic or oily one, such as any ink or any mass-coloring agents, depending on usage of the applicator. The reservoir is a cylindrical member (viz., an ink cartridge) that is opened at its proximal end. Preferably, the valve body is of a spherical shape, with the distal region of the valve chamber being of a funnel-like shape constricted forwardly. In this case, the distal end of the chamber is constricted towards its frontal extremity to assume a funnel-like shape, and the opening of said chamber has a diameter a little smaller than that of the spherical valve body. It is also preferable to form in the valve chamber a shoulder portion behind the valve body, so as to prevent it from entirely sinking into the chamber. The tip may be made of a material such as a fiber bundle through which the liquid can be exuded due to capillary phenomenon or the like. A proximal end of the tip is preferably in contact with the distal end portion of the valve body protruding forward through the valve chamber opening.

In the second mode, and in nonuse, the valve body within the chamber of the applicator does remain urged by the biasing member towards the opening of said chamber, thereby closing the reservoir in nonuse not to supply any amount of ink. With the tip's distal end being pressed on a paper sheet or the like to perform writing thereon, the tip's proximal end will push backwards and upwards the valve body a small distance to open the chamber opening. If a ball is used as the valve body, then it can surely and tightly close the opening, irrespective of its rotational positions. Retraction by the small distance of such a ball will be sufficient to provide a desired clearance for dispensing the ink. The reservoir may be a cylindrical member disposed in an external cylinder to thereby form a double-wall structure. This structure will enable on one hand the replacement of only the reservoir, and increase freedom in selecting and designing the material and its strength forming the reservoir. It is also possible that one portion of a principal body of the applicator defines the reservoir, wherein the tip will be attached to the distal end of said portion so as to slide fore and aft.

In the second mode, the application liquid stored in the reservoir may have a viscosity of 100 mPa·s or less. In this connection, the applicator may comprise a follower in the reservoir and in rear of the column of the liquid so as to control flow rate of the liquid flowing out through the valve chamber opening. Such a follower will also serve as a back-flow inhibitor for the application liquid. A viscous material forming the follower has to show the value of '2' or less as the ratio of its viscosity at 5° C. to that at 35° C. More preferably, the ratio is 1.5 or less so that change in viscosity is as small as possible. The viscous material may either comprise only a grease-like substance, or a combination of a float submerged in the substance. This float will be made of a plastics or the like and has a specific gravity substantially equal to that of said substance.

The flow rate controlling follower in this mode will not show any undesirable extent of change in viscosity between winter and summer, so that stable ink supply is ensured all the year around, without causing any dripping of the ink.

The present inventors conducted a series of study to seek an appropriate viscous material whose viscosity is not noticeably susceptive to temperature change, and has found silicone oils to be one of such desirable materials. According to their experiments, back-flow inhibitors composed of silicone oils showed merely small change in viscosity between higher and lower temperatures. All of those inhibitors proved to have a value of '2' or less as the ratio of their viscosity at 5° C. to that at 35° C. On the basis of such a finding, the present invention provides herein an applicator comprising a reservoir for holding therein a given amount of the application liquid, a valve assembly disposed in a distal region of the reservoir; the valve assembly comprising a valve chamber having a forward opening, a valve body accommodated in the chamber and movable fore and aft to rest on and depart from the seat, and a biasing member for urging the valve body to be pressed against a circular rim around the opening so as to close it, the applicator further comprising a tip in front of the valve so that a distal portion of the valve body is in contact with a rear end of the tip, wherein the application liquid stored in the reservoir may has a viscosity of 100 mPa·s or less, and the applicator further comprises a back-flow inhibitor in the reservoir and in rear of the column of the liquid so as to control flow rate of the liquid flowing out through the valve chamber opening, the back-flow inhibitor being basically formed of a silicone oil. This applicator will also function in a similar manner to those already described hereinbefore. The silicone oil as the principal material forming such a back-flow inhibitor may either be any silicone oil alone, or a mixture thereof with an additive such as a hydrophilic silica. Silicone oils usable herein are: dimethylsilicone oil, methlyphenyl silicone oil, alkylated silicone oil, carboxylated silicone oil and any mixture of two or more of them.

The absolute viscosity of the viscous material forming the follower, or the grease-like composition containing the silicone oil, is not of any decisive meaning or effect, insofar as the ratio of their viscosity at 5° C. to that at 35° C. is 2 or less. Amount of these material or composition used, and/or clearance between such a float (viz., follower) and the reservoir inner wall, may be adjusted to afford an optimum flow rate of the application liquid, for any level of viscosity of the material or composition.

In a third mode of carrying out the invention to achieve the third object, the applicator comprises a reservoir for holding therein a given amount of the application liquid, and a valve assembly disposed in a distal region of the reservoir. The valve assembly comprises a valve chamber having a forward opening, a valve body accommodated in the chamber and movable fore and aft to rest on and depart from the seat, and a biasing member for urging the valve body to be pressed against a circular rim around the opening so as to close it. The applicator comprises a tip in front of the valve so that a distal portion of the valve body is in contact with a rear end of the tip protruding forwardly from the distal opening. The applicator may for example be a writing tool, a cosmetic tool or the like. The application liquid may either be an aqueous one or a lipophilic or oily one, such as any ink or any mass-coloring agents, depending on usage of the applicator. In an example, the reservoir may be a cylindrical member (viz., an ink cartridge) opened at its proximal end. In this case a back-flow inhibitor is preferably disposed in the reservoir and in rear of the column of an ink. As another example of this third mode of the invention, the cylindrical reservoir has its proximal end closed to form an air-replacement type applicator. Preferably, the valve body is of a spherical shape, with the distal region of the valve chamber being of a funnel-like shape constricted forwardly. In this case, the distal end of the chamber is constricted towards its frontal extremity to assume a funnel-like shape, and the opening of said chamber has a diameter a little smaller than that of the spherical valve body. It is also preferable to form in the valve chamber a shoulder portion behind the valve body, so as to prevent it from entirely sinking into the chamber. The tip may be made of a material such as a fiber bundle through which the liquid can be exuded due to capillary phenomenon or the like.

In the third mode in non-use, the valve body within the chamber of the applicator does remain urged by the biasing member towards the opening of said chamber, thereby closing the reservoir in nonuse not to supply any amount of ink. With the tip's distal end being pressed on a paper sheet or the like to perform writing thereon, the tip's proximal end will push back and up the valve body a small distance to open the chamber opening. If a ball is used as the valve body, then it can surely and tightly close the opening, irrespective of its rotational positions. Retraction by the small distance of such a ball will be sufficient to provide a desired clearance for dispensing the ink. The reservoir may be a cylindrical member disposed in an external cylinder to thereby form a double-wall structure. This structure will enable on one hand the replacement of only the reservoir, and increase freedom in selecting and designing the material and its strength forming the reservoir.

The tip used in the third mode may be coated with a plastics or with a metal, and more preferably a sleeve may be incorporated to cover only the proximal portion of said tip, which portion would otherwise be exposed inside an external cylinder. This sleeve may be made of a material scarcely permeating a solvent contained in the application liquid that is stored in the reservoir. Preferably, the rear face of such a tip is not covered with the plastics or metal, but its material absorbing the liquid is exposed. Thus, the liquid flowing out from the valve opening will surely migrate through the tip, and its distal and outer periphery covered with such a sleeve will diminish evaporation of the solvent out of the tip.

Preferably in the third mode, a proximal portion of the tip, that is coated with plastics or metal to avoid solvent evaporation from the liquid and to protect it from drying up, and the valve assembly are accommodated in an external cylinder together with the reservoir. This structure will be effective to further suppress solvent evaporation from the rear face of the applying tip.

The tip may be composed of a smaller diameter distal portion and a larger diameter proximal portion continuing therefrom. Only the larger diameter portion is coated with the plastics or metal, with the smaller diameter portion fitted in the distal cylindrical region of the external cylinder. In this way, the smaller diameter portion can slide in axial direction within an allowed range not to slip off the external cylinder.

The valve chamber may be a cylindrical member constricted at its distal end, and preferably the tip has its proximal face of a diameter larger than that of the chamber distal end. This cylindrical member disposed in the external cylinder may be held in place in and by a distal stopper that is secured to the distal end of the reservoir. It is noted here that the forward end of the distal stopper is located in rear of the forward end of the valve body protruding out of the valve opening, but in front of the forward end of the cylindrical member forming the valve chamber. Further, the plastics or metal sleeve covering the outer periphery of the tip preferably has to abut against the forward end of the distal stopper. This arrangement of the relevant members or parts will cause the application liquid being discharged from the cylindrical member to surely transfer into the rear end of the tip, also owing to its diameter larger than that of said cylindrical member. As noted above, the forward end of the distal stopper is located intermediate the forward end of the valve body and the forward end of the cylindrical member, so that a writing pressure exerted on the tip and pushing back same will force the valve body backwards against the biasing member so as to open the valve. In this state, the rear end of plastics or metal sleeve is in a forced contact with the forward end of the distal stopper, whereby the tip can not move back any more. Thus, a central region of the tip rear face that will no longer be pressed on the valve body or the valve chamber forward end is now protected well from deformation.

In a modification of the third mode of carrying out the invention to achieve the third object, the applicator comprises a reservoir for holding therein a given amount of the application liquid, a distal stopper disposed in a distal region of the reservoir, an application liquid-feeding valve assembly secured in the distal stopper and a tip disposed in front of the valve assembly. The valve assembly comprises a valve chamber having a valve seat with a forward opening and having a proximal region opened into the reservoir, a valve body accommodated in the chamber and movable fore and aft to rest on and depart from the seat, and a biasing member disposed behind the valve body so as to urge it to rest on the seat. The distal portion of the valve body is in contact with a rear end of the tip. The applicator may for example be a writing tool, a cosmetic tool or the like. The application liquid may either be an aqueous one or a lipophilic or oily one, such as any ink or any mass-coloring agents, depending on usage of the applicator. In an example, the reservoir may be a cylindrical member (viz., an ink cartridge) opened at its proximal end. In this case a back-flow inhibitor is preferably disposed in the reservoir and in rear of the column of an ink. As another example of this third mode of the invention, the cylindrical reservoir has its proximal end closed to form an air-replacement type applicator. Preferably, the valve body is of a spherical shape, with the distal region of the valve chamber being of a funnel-like shape constricted forwardly. In this case, the distal end of the chamber is constricted towards its frontal extremity to assume a funnel-like shape, and the opening of said chamber has a diameter a little smaller than that of the spherical valve body. It is also preferable to form in the valve chamber a shoulder portion behind the valve body, so as to prevent it from entirely sinking into the chamber.

In this modification of the third mode in non-use, the valve body within the valve chamber of the applicator does remain urged by the biasing member towards the seat in said chamber, thereby closing the reservoir in nonuse not to supply any amount of ink. With the tip's distal end being pressed on a paper sheet or the like to perform writing thereon, the tip's proximal end will push back the valve body a small distance to open the chamber opening. If a ball is used as the valve body, then it can surely and tightly close the opening, irrespective of its rotational positions. Retraction by the small distance of such a ball will be sufficient to provide a desired clearance for dispensing the ink. The tip may be made of a material such as a fiber bundle through which the liquid can be exuded due to capillary phenomenon or the like. More preferably, the tip may have its rear end of a diameter larger than that of the valve opening (for example, the area of that rear end may be designed to be about four times or more that of said valve opening). This feature will allow the tip rear end to easily absorb the application liquid such as an ink, surely preventing the problem of ink dripping.

In this modification, the distal stopper is entirely or partially made of a material (referred to as 'gas-permeating material' hereinafter) of a desired degree of gas permeability. This material is exposed inside the reservoir and in a space around the tip. By virtue of this feature, the solvent (e.g., water in the case of aqueous inks, or any organic solvent such as alcohols in the other case of lipophilic inks) will evaporate on the surface of such a gas-permeating material and its vapor will diffuse through this material to be spread around tip. Consequently, ambient air surrounding the tip will be saturated with the solvent vapor, thus inhibiting the solvent from evaporating from the tip so as to protect it from drying up. The degree of gas permeability of such a material may be a matter of design choice, depending what kind of material to be employed. In a case wherein resistance-to-drying is required for long-term storage, relatively low permeability will suffice. If resistance-to-drying has to meet the condition for short-term-storage, then a considerably higher permeability will be required for protection of the tip.

In this modification, the outer diameter of the tip rear end is designed twice or more as large as the inner diameter of the distal opening of the liquid-supplying valve assembly. In addition to this, a certain stopping protrusion may be formed on the outer periphery of the valve chamber so as to occasionally bear against the rear face of the tip for the purpose of restricting its retraction. This feature will assist the tip to more surely absorb the ink or the like liquid effluent from the valve's distal opening to thereby avoid the ink dripping on one hand, and will protect the tip's rear face at its central region from becoming dimpled or suffering from any deformation that would otherwise be caused by the distal opening, on the other hand. The latter effect is obtained, even if an abnormally strong writing pressure would occasionally be imparted to the tip, since such a stopping protrusion can support a peripheral region around the center and withstand well such strong pressure.

The ink reservoir described above is cylindrical in shape, and the distal stopper consists of a stopper body and an (annular and desirably porous) sealant. The stopper body made of a metal or a hard plastics has a large diameter portion and a small diameter portion fitted in the sealant. This sealant intervenes between the outer periphery of the small diameter portion and the inner periphery of the reservoir. The large diameter portion of the distal stopper is in a direct contact with the reservoir inner periphery. Communication holes penetrate the large diameter portion fore and aft, so that the sealant has its surface areas exposed to openings of those communication holes. By virtue of this structure, the hard stopper body can firmly hold the valve assembly and the sealant will surely stop the ink or the like liquid not to leak forward from the reservoir. The solvent vapor which the ink will emit can migrate forwards through the sealant and to the vicinity of the tip. Since the tip is surrounded with an air saturated with that vapor, a fraction of the ink will not tend to dry shortly within the tip. The sealant is a ring that may be formed of a silicone rubber or any other appropriate material.

In an alternative example, the distal stopper is a ring entirely formed of an elastic material, with the valve chamber being inserted in and through such a stopper. In this case, any strong writing pressure which the tip is receiving will be absorbed and cushioned by the distal stopper that elastically deforms itself as a whole. Any dimple will not be produced in the tip's rear face engaging with the valve body. Also, this stopper may be formed of a silicone rubber or any other appropriate material.

Also in this modification, the reservoir may be a cylindrical member disposed in an external cylinder having a distal end to which the tip is connected to be retractable. Such a double-wall structure enables on one hand the replacement of only the reservoir, and increases freedom in selecting and designing the material and its strength forming the reservoir. Alternatively, a part of such an external cylinder may be formed as an ink reservoir, thus providing a single-wall structure which is also included in the present invention.

In a further modification of the third mode of carrying out the invention to achieve the third object, the applicator comprises a reservoir for holding therein a given amount of the application liquid, and a valve assembly disposed in a distal region of the reservoir. The valve assembly comprises a valve chamber having a forward opening, a valve body accommodated in the chamber and movable fore and aft to rest on and depart from the seat, and a biasing member for urging the valve body to be pressed against a circular rim around the opening so as to close it. The applicator comprises a tip in front of the valve so that a distal portion of the valve body is in contact with a rear end of the tip protruding forwardly from the distal opening. The applicator may for example be a writing tool, a cosmetic tool or the like. The application liquid may either be an aqueous one or a lipophilic or oily one, such as any ink or any mass-coloring agents, depending on usage of the applicator. In an example, the reservoir may be a cylindrical member (viz., an ink cartridge) opened at its proximal end. In this case a back-flow inhibitor is preferably disposed in the reservoir and in rear of the column of an ink. As another example of this third mode of the invention, the cylindrical reservoir has its proximal end closed to form an air-replacement type applicator. Preferably, the valve body is of a spherical shape, with the distal region of the valve chamber being of a funnel-like shape constricted forwardly. In this case, the distal end of the chamber is constricted towards its frontal extremity to assume a funnel-like shape, and the opening of said chamber has a diameter a little smaller than that of the spherical valve body. It is also preferable to form in the valve chamber a stopping protrusion behind the valve body, so as to prevent it from entirely sinking into the chamber.

Also in this modification of the third mode in non-use, the valve body within the valve chamber of the applicator does remain urged by the biasing member towards the seat in said chamber, thereby closing the reservoir in nonuse not to supply any amount of ink. With the tip's distal end being pressed on a paper sheet or the like to perform writing thereon, the tip's proximal end will push back the valve body a small distance to open the chamber opening. If a ball is used as the valve body, then it can surely and tightly close the opening, irrespective of its rotational positions. An upward retraction by small distance of such a ball will be sufficient to provide a desired clearance for dispensing the ink.

It is noted here that the tip's rear portion, the valve assembly and the ink reservoir are all disposed inside an external cylinder. There are formed two closed spaces, one between the rear portion and the external cylinder, the other between the reservoir and this cylinder. In the latter closed space communicating with the former, an anti-drying agent for the tip is disposed. The term 'closed spaces' used here is not exclusively meant as any absolutely closed space, but includes some spaces that slightly communicates with ambient atmosphere.

The anti-drying agent mentioned above is such a material as absorbing and retaining a solvent of the ink or the like application liquid stored in the reservoir. If the ink is an aqueous one, then a sponge or a block of a highly water-absorptive polymer may be employed as that anti-drying agent. If the ink is a lipophilic one, then a sponge or the like porous material soaked with an alcohol or the like organic solvent may be used, or alternatively, a grease-like paste substantially formed of such a solvent may substitute for the sponge. It will be understood that even if any solvent different from that contained in the ink is used to impregnate the anti-drying agent, its vapor diffusing throughout and in the external cylinder will increase total vapor pressure and thus suppress the succeeding evaporation of the ink solvent, thus affording the same effect as noted above.

In any case, the solvent contained in the anti-drying agent will evaporate to emit into the closed spaces an innumerable number of vapor molecules at ambient temperatures so that the air saturated with them will hinder the ink solvent to further evaporate.

The applicator of this type may be such that both the ink reservoir and external cylinder are cylindrical, with the latter having its rear end closed so that the anti-drying agent will be held in and near the rear end. A proximal stopper having the anti-drying agent secured therein may be used to close that rear end. This double-cylindrical structure will give an aesthetic appearance to the applicator. The anti-drying agent disposed in and near the external cylinder rear end will simplify in structure and render more compacted a zone where the applying tip and the valve assembly are located. Such an applicator will be convenient to use as a pen-type writing tool or as a cosmetic tool. The proximal stopper can more readily be filled with the anti-drying agent, as compared with other cases.

If necessary or desirable, a valve holder for fixedly supporting the valve assembly may be formed in and at a middle region of the external cylinder. In this case, some holes penetrating the holder will provide fluid-communication between the first and second closed spaces.

In a fourth mode of carrying out the invention to achieve the fourth object set forth above, the applicator comprises a reservoir for holding therein a given amount of the application liquid, and a valve assembly disposed in a distal region of the reservoir. The valve assembly comprises a valve chamber having a forward opening, a valve body accommodated in the chamber and movable fore and aft, and a biasing member for imparting an urging elastic force to the valve body to close the opening. The applicator further comprises a tip in front of the valve so that a distal portion of the valve body is in contact with a rear end of the tip. The 'spring factor' of the biasing member is 0.1 kgf/mm or higher. This mode of the invention is useful particularly to the applicator of the type that the tip and the valve body are retracted 0.01 mm to 1 mm due to a writing pressure imparted to the tip and against the urging force of the biasing member.

In the fourth mode, the urging force will sharply increase with a retraction by a small distance of the tip and valve body, due to the writing pressure. Accordingly, the biasing member's urging force exerted while it is causing the valve body to close the valve chamber opening can be predetermined so small as to permitting the valve body to be pushed back easily and surely due to the writing pressure. On the other hand, the biasing member can also be designed at the same time to match the writing pressure during retraction which the valve body will make once writing is started. In this manner, the biasing member may have an urging force that will withstand the writing pressure, thus dispensing well with any special valve supporter disposed behind the valve body and nevertheless inhibiting the valve from opening to an excessive extent. However in a case wherein such a valve supporter is formed in the assembly, shock which the supporter suffers when colliding with the valve body will be buffered somewhat or sufficiently, thereby diminishing unpleasant bumping or clunking feeling when writing is done.

There may be a case wherein writing tools are used with a relatively low writing pressure of about 30 gf causing retraction by about 0.2 mm of the tip and valve body. If the biasing member has a 'spring constant' of 0.1 kgf/mm, then retraction by 0.2 mm of the tip will increase the urging force of the biasing member by about 20 gf. Accordingly, the initial urging force (observed while the valve body is in its state of closing the valve chamber opening) of about 20 gf will allow the valve to open smoothly when writing is started with about 30 gf of the writing pressure. Thereafter, the biasing member (i.e., typically a spring) will expand or be compressed in response to change in the writing pressure during the writing operation. The biasing member will thus balance itself against the varying writing pressure, thus avoiding any bumping or clunking shock.

The application pressure (e.g., writing pressure) in use of the applicator will naturally vary influenced by many factors that are for example usage of the applicator, designed function thereof, size, shape and material of its applying tip, type of the application liquid, shape, structure and size of the valve body, and so on. The urging force sufficient for the biasing member to tightly close the valve will also vary, similarly to the writing pressure. It may however be possible to appropriately determine the 'spring constant' and the initial urging force of the biasing member, taking into account of those factors. In an exemplary case wherein the tip adapted for use to draw thin strokes is of a round columnar shape having a diameter falling within a range of 0.5 mm to 2 mm, the optimal initial urging force may preferably be designed to be from 20 gf to 80 gf. In another case wherein the tip for drawing medium strokes and having a diameter of 2 mm to 5 mm, the optimal initial urging force may 30 gf to 100 gf. In a further case wherein the tip for drawing thick strokes and having a diameter of 5 mm to 15 mm, or the tip being of a rectangular shape with major sides 3–10 mm long and minor sides 5–20 mm long, the preferable initial force may be 50–150 gf In addition, a higher 'spring constant' of 0.5 kgf/mm or more may be employed to improve performance, if necessary or appropriate.

In summary, the biasing member has to be designed such that the valve body does close surely and tightly the valve chamber opening (formed in the seat) with a forward force weaker than its intrinsic force, under the condition that the valve body can be retracted by an actual and external backward force away from the seat until it takes a lifted position where the intrinsic and external forces will be balanced with each other. Here, the 'intrinsic force' is the so-called and presupposed 'application pressure (or writing pressure)' which will act on the applying tip during application of an ink or the like liquid. When designing the applicator, such an 'intrinsic force' or application pressure is predetermined usually in view of various factors such as usage of the applicator, the material, diameter and shape of the applying tip, and so on.

As described above, the applicator in accordance with this mode has its tip whose rear end is in contact with the forward end of the valve body, which is exposed forwards out of the valve opening. This tip will be pressed back by the application pressure and against the urging force, until it departs from the opening. The valve body is preferably a ball, and the valve chamber constricted forwardly to be of a funnel-like configuration so that its forward opening has a diameter slightly smaller than the ball. A protrusion may preferably be formed in the valve chamber so as to bear against the rear portion of the ball. Such a protrusion will prevent the ball from sinking too deeply into the valve chamber. The application tip may be a felt or the like allowing capillary exudation of an ink, or a thin metal tube. It is also preferred and important that the biasing member, having undergone elastic deformation due to the writing pressure transmitted through the tip and ball, will exert an increased force that is 1.5 times or more as strong as the initial valve closing force. The application pressure is not of any unchangeable nature, but will variably be designed depending on diameter, hardness, material and the like of pen-point tip. A spring having a spring constant of 0.1 kgf/mm or more, or more preferably of 0.5 kgf/mm may be employed as the biasing member.

In the described mode of the invention, the biasing member will show its urging force sharply increasing so as to withstand the writing pressure, as it elastically deforms itself when writing is done. Consequently, any type of supporter need not necessarily be disposed behind the valve body in this applicator. However even in a case wherein incorporation of such a supporter is required, there will arise no problem of producing any strong shock that would cause unpleasant writing. In any case, since a half or less of the writing pressure is charged on the valve body while the applicator is not in use, the writing can be started or resumed by easily reopening the valve to supply the tip with the ink.

A lower limit of retraction distance by which the valve body moves when writing can be selected in this mode from the values such as: 0.01 mm, 0.02 mm, 0.05 mm, 0.1 mm, 0.2 mm, 0.3 mm, 0.4 mm, 0.5 mm, 1.0 mm and so on. An upper limit of the retraction distance may also be selected from the values such as: 0.2 mm, 0.3 mm, 0.4 mm, 0.5 mm, 0.6 mm, 0.7 mm, 0.8 mm, 0.9 mm, 1.0 mm and so on. A preferable retraction distance is from 0.1 mm to 1 mm, and more preferably from 0.1 mm to 0.3 mm. The initial urging force of the biasing member acting on the valve body to close the valve opening may be designed to be: ≧10 gf, ≧20 gf, ≧30 gf, ≧40 gf, ≧50 gf, ≧60 gf, ≧70 gf or ≧80 gf, on the condition that the force be selected at the same time to be: ≦20 gf, ≦30 gf, ≦40 gf, ≦50 gf, ≦60 gf, ≦70 gf, ≦80 gf, ≦90 gf, ≦100 gf, ≦200 gf or ≦500 gf.

Similarly, the urging force of the biasing member having been elastically deformed by the writing pressure acting thereto through the tip may be designed to be: ≧30 gf, ≧40 gf, ≧50 gf, ≧60 gf, ≧70 gf, ≧80 gf, ≧90 gf, ≧100 gf, ≧120 gf, ≧140 gf, ≧160 gf, ≧180 gf or ≧200 gf, on the condition that the force be selected at the same time to be: ≦70 gf, ≦80 gf, ≦90 gf, ≦100 gf, ≦110 gf, ≦120 gf, ≦130 gf, ≦140 gf, ≦150 gf, ≦160 gf, ≦170 gf, ≦180 gf, ≦190 gf, ≦200 gf, ≦300 gf, ≦400 gf, or ≦500 gf.

Exemplary and preferably, the biasing member may be designed herein so that it shows the initial urging force acting on the valve body to close the valve opening is from 40 gf to 60 gf, with the 'increased' urging force of the biasing member having elastically deformed due to the tip retracted 0.2 mm being set at from 120 gf to 180 gf. The applicator designed in this manner will retract its valve body and open its valve opening, upon retraction of the tip merely by 0.2 mm that is almost insensible to the user usually applying to the tip a writing force of 120 gf to 180 gf. A small clearance thus appearing around the valve body will then permit the ink to pass thereby for the writing purpose. His or her writing pressure will thus withstand well the 'increased' urging force of 120 gf to 180 gf intrinsic to the writing tool being used. Thus, he or she will sense no shock of bumping or clunking, whether or not any internal members or parts would collide with each other. The initial urging force of 40 gf to 60 gf remaining imparted to the resting writing tool is much less than the said writing pressure, so that the user can easily open the valve when his or her writing is started or resumed. A fiber bundle may be an appropriate applying tip in this mode of the invention, and a spring of a non-linear character may be used as the biasing means, if necessary.

In a fifth mode of carrying out the invention to achieve the fifth object set forth above, an applicator is provided herein which comprises a reservoir for storing therein an amount of an application liquid, a liquid-supplying valve assembly disposed in a distal portion of the reservoir. The valve assembly comprises a valve body and an urging member so that the valve body accommodated in a valve chamber having a forward opening will be urged by the biasing member to bear against a rim around the opening so as to close it. The applicator further comprises an applying tip disposed in front of the valve assembly, so that a rear end of the tip is kept in contact with a forward portion of the valve body. This applicator is characterized in that a check valve is interposed between the valve assembly and the reservoir. The applicator may for example be a writing tool, a cosmetic tool or the like. The application liquid may either be an aqueous one or a lipophilic or oily one, such as any ink or any mass-coloring agents, depending on usage of the applicator. This mode of the invention is particularly suited for the reservoir that a cylindrical member is opened at its rear end, because leakage of the ink out of this open rear end is surely prevented herein. In this case a back-flow inhibitor is preferably disposed in the reservoir and in rear of the column of an ink. Preferably, the valve body is of a spherical shape, with the distal region of the valve chamber being of a funnel-like shape constricted forwardly. In this case, the distal end of the chamber is constricted towards its frontal extremity to assume a funnel-like shape, and the opening of said chamber has a diameter a little smaller than that of the spherical valve body. It is also preferable to form in the valve chamber a shoulder behind the valve body, so as to prevent it from entirely sinking into the chamber. The application tip may be a fiber bundle allowing capillary exudation of an ink, or may be a thin metal tube.

Also in this fifth mode in non-use, the valve body within the valve chamber of the applicator does remain urged by the biasing member towards the seat in said chamber, thereby closing the reservoir in nonuse not to supply any amount of ink. With the tip's distal end being pressed on a paper sheet or the like to perform writing thereon, the tip's proximal end will push backwards and upwards the valve body a small distance to open the chamber opening. If a ball is used as the valve body, then it can surely and tightly close the opening, irrespective of its rotational positions. Retraction by the small distance of such a ball will be sufficient to provide a desired clearance for dispensing the ink. The reservoir may be disposed in an external cylinder to thereby form a double-wall structure. This structure will enable on one hand the replacement of only the reservoir, and increase freedom in selecting and designing the material and its strength forming the reservoir. The diameter of the tip rear end may be larger than that of the valve opening so that the application liquid flowing out of the opening is surely absorbed by and in the tip rear end, preventing the problem of ink dripping. Thus, the tip rear end may have an area that is 4 times or more as broad as the valve opening.

The check valve provided in this mode will be closed when the applicator is put upside down when using, so as to inhibit the ink from flow in a reverse direction. Normal position of the applicator will however open the check valve so that the liquid flows out of the reservoir, through the valve chamber towards the applying tip, at a moderate flow rate.

The check valve consists of a spherical valve body and a valve seat having a bore. This valve body will close the bore when the applicator is put upside down. The bore communicates with the interior of the reservoir, with the valve body being capable of moving fore and aft (viz., up and down) due to gravitational force. This structure is simple, but the check valve will automatically open or be closed following the actual position of the applicator. Thus, back-flow of the ink is surely prevented, whilst allowing it flow into the valve chamber of the valve assembly for the normal writing use. A valve chamber formed for this check valve for accommodation of the valve body may be a cylinder whose diameter is a little larger than said body, in order that the application liquid flows at a moderate and relatively low rate.

In this mode, a distal stopper may further be incorporated which is disposed in a forward end of the reservoir and has an axially extending aperture for feeding the application liquid. The valve assembly is secured in a distal region of the distal stopper, with the check valve being likewise secured in a proximal region of said stopper. The distal stopper having integral therewith the valve assembly and check valve can be treated as a single composite part, affording easier storage management of the applicator parts and enhancing efficiency of manufacture.

Alternatively, a valve seat of the check valve is formed in the proximal region of the distal stopper and around the axially extending aperture or bore so that distal end thereof serves as the valve opening. The spherical valve body of the check valve will, in this case, be placed in a middle region of said aperture of bore. A displacement-limiting member also formed in said middle region is located ahead the spherical valve body, thereby keeping forward motion thereof within limits. This structure will further reduce the number of discrete parts, because the distal stopper itself is utilized as the housing for the check valve. Its structure is more simplified and manufacture cost lowered.

The displacement-limiting member prevents the valve body of check valve from advancing forwards beyond the limit and thus interfering with the parts constituting the liquid-supplying valve assembly. Thus, reliable function of the check valve is ensured. The limiting member may be lugs jutting from the inner periphery of the axially extending aperture or bore. Alternatively, a middle region of this aperture may be formed as a square hole through which the check valve body cannot pass and which thus serves as the limiting member. Any proper spring disposed in front of the check valve body may also operate as such a limiting member. Further, some constituent pieces may build up the limiting member, or the prior art structure as disclosed in the drawings and specification of PCT/JP98/05456 may be employed wherein cutouts or indentations are formed in and around the proximal inner periphery of the housing which is included in the liquid-supplying valve assembly. In the latter case, the check valve body engaging with such indentations will be stopped not to further move forwards, but allowing the application liquid flowing through said indentations into the valve chamber of the supplying valve assembly.

In a sixth mode of carrying out the invention to achieve the sixth object set forth above, the applicator comprises in principle a cylindrical reservoir holding therein an application liquid and discharging it from the forward end of said reservoir, a back-flow inhibitor incorporated in the applicator and capable of sliding in axial direction to inhibit the liquid from flowing back, and an obstructer for preventing the back-flow inhibitor from moving in a reverse direction. Preferably and in more detail, this applicator may comprise a cylindrical reservoir for storing therein a given amount of the application liquid, and a valve assembly secured to the distal region of the reservoir. The valve assembly in turn comprises a valve chamber having a forward opening, and a valve body placed in the chamber, and a biasing member for urging the valve body to be pressed on a rim defining the opening so as to close it. The applicator further has an applying tip whose rear end is in contact with the valve body, and a back-flow inhibitor arranged in rear of the column of the liquid. This inhibitor is capable of sliding within the reservoir to follow the column, as the liquid is gradually consumed. An air inlet is formed in the rear end of the reservoir, together with an obstructer for preventing the back-flow inhibitor from moving in a reverse direction. The applicator may for example be a writing tool, a cosmetic tool or the like. The application liquid may either be an aqueous one or a lipophilic or oily one, such as any ink or any mass-coloring agents, depending on usage of the applicator. The back-flow inhibitor may be a simple viscous material such as a polybutene gel, or a float tightly surrounded with such a gel or the like viscous fluid.

Also in this mode of the invention and the applicator standing in non-use, the valve body within the valve chamber of the applicator does remain urged by the biasing member towards the seat in said chamber, thereby closing the reservoir in nonuse not to supply any amount of ink. With the tip's distal end being pressed on a paper sheet or the like to perform writing thereon, the tip's proximal end will push backwards and upwards the valve body a small distance to open the chamber opening. If a ball is used as the valve body, then it can surely and tightly close the opening, irrespective of its rotational positions. Retraction by the small distance of such a ball will be sufficient to provide a desired clearance for dispensing the ink. The back-flow inhibitor employed in this mode will move forwards as the application liquid is consumed. The obstructer will protect this back-flow inhibitor from undesirably move backwards even if the applicator is put or held upside down, whereby the inhibitor will not be allowed to slip off through an opening, such as the air inlet in this case, present in the reservoir rear end.

Such an obstructer may be formed herein by deforming a portion of the reservoir. For this purpose, the rear end of the cylindrical reservoir can be caulked, or a portion or portions thereof can be formed to protrude in a centripetal direction. These configurations of the obstructer are suited particularly to the back-flow inhibitor comprising a float tightly surrounded with a polybutene gel or the like viscous fluid.

In the other case wherein the obstructer comprises solely the polybutene gel or the like, the obstructer may be a plug-shaped member fixedly fitted in the rear opening of the reservoir. The air inlet to be formed as an aperture penetrating this plug has to be designed such that the back-flow inhibitor is protected well from slipping out, with the ambient air freely flowing into the reservoir. A desirable configuration of the aperture is for example a helical shape meeting this requirement. A plurality of fine apertures may instead be formed through the plug so that the highly viscous material as the back-flow inhibitor can not escape therethrough, while allowing the ambient air to freely enter the reservoir. In any case, internal air pressure will be balanced well with the external one, thereby enabling the inhibitor to smoothly follow the liquid column whose volume is decreasing due to consumption thereof.

A resin foam fitted in the rear opening of the reservoir may serve as both the obstructer and the air inlet, at the same time. This is because such a foam has a number of voids continuing one from another, also permitting air flow therethrough but preventing any viscous liquid or solid from passing therethrough. This example is most simple in structure, and thus saves expenses in manufacture.

The reservoir may be installed in an external cylinder having a proximal stopper attached thereto, such that forward portion of the proximal stopper is exposed in the reservoir so as to serve as the obstructer. This example is advantageous in that the obstructer is provided by only putting the proximal stopper in place, reducing labor in assembling the parts and also reducing the number thereof to thereby lower manufacture cost.

In a seventh mode of carrying out the invention to achieve the seventh object set forth above, the applicator comprises a cylindrical reservoir for storing therein a given amount of the application liquid and a valve assembly secured to the distal region of the reservoir. The valve assembly comprises a valve chamber having a forward opening, a valve body placed in the chamber; and a first biasing member for urging the valve body to be pressed on a rim defining the opening so as to close it. The applicator further has an applying tip whose rear end is in contact with the valve body. The applicator may for example be a writing tool, a cosmetic tool or the like. The application liquid may either be an aqueous one or a lipophilic or oily one, such as any ink or any mass-coloring agents, depending on usage of the applicator. In an example, the reservoir may be a cylindrical member (viz., an ink cartridge) opened at its proximal end. In this case a back-flow inhibitor is preferably disposed in the reservoir and in rear of the column of an ink. As another example of this third mode of the invention, the cylindrical reservoir has its proximal end closed to form an air-replacement type applicator. Preferably, the valve body is of a spherical shape, with the distal region of the valve chamber being of a funnel-like shape constricted forwardly. In this case, the distal end of the chamber is constricted towards its frontal extremity to assume a funnel-like shape, and the opening of said chamber has a diameter a little smaller than that of the spherical valve body. It is also preferable to form in the valve chamber a shoulder behind the valve body, so as to prevent it from entirely sinking into the chamber. The tip may be a fiber bundle exuding the liquid due to capillary phenomenon, or a thin metal tube.

Also in this seventh mode in non-use, the valve body within the valve chamber of the applicator does remain urged by the biasing member towards the seat in said chamber, thereby closing the reservoir in nonuse not to supply any amount of ink. With the tip's distal end being pressed on a paper sheet or the like to perform writing thereon, the tip's proximal end will push back the valve body a small distance to open the chamber opening. If a ball is used as the valve body, then it can surely and tightly close the opening, irrespective of its rotational positions. Retraction by the small distance of such a ball will be sufficient to provide a desired clearance for dispensing the ink. The reservoir may be disposed in an external cylinder to thereby form a double-wall structure. This structure will enable on one hand the replacement of only the reservoir, and increase freedom in selecting and designing the material and its strength forming the reservoir.

Characteristic to this seventh mode, a second biasing member is incorporated in the applicator so that it urges backwards the tip with an urging force weaker than that of the first biasing member. By virtue of this feature, the tip interposed between those two biasing members is gripped by them with their forces facing one another. Thus, the tip is no longer rickety and there is no fear of unintentional opening of the valve because the second biasing member is weaker than the first one.

The tip may be composed of a distal small diameter portion integral with a proximal large diameter portion, the latter diameter being considerably greater than the former. The small diameter portion of this tip fits in the distal tubular portion of the applicator body, to be capable of sliding in axial direction but impossible to slip off. The second biasing member may be disposed in a stepped region present between those small diameter and large diameter portions.

The second biasing member may for example be a cylindrical polyurethane piece fitted on the small diameter portion, though it may be replaced with any other member such as a rubber ring or a coiled spring.

The second biasing member fitted on the small diameter portion of the tip may alternatively be a liquid-absorptive cylindrical piece that can absorb the application liquid. In this case, an excessive amount of the ink can be absorbed by and temporarily stored in such a second biasing member, whereby this member tip will make up a deficiency in ink in the tip. The liquid-absorptive second biasing member may typically be a polyurethane foam, a sponge or the like.

In an eighth mode of carrying out the invention to achieve the eighth object set forth above, the applicator comprises a cylindrical reservoir for storing therein a given amount of the application liquid and a valve assembly secured to the distal region of the reservoir. The valve assembly comprises a valve chamber having a forward opening, a valve body placed in the chamber; and a biasing member for urging the valve body to be pressed on a rim defining the opening so as to close it. The applicator further has an applying tip whose rear end is in contact with forward end of the valve body protruding forwards from the valve opening. The applicator may for example be a writing tool, a cosmetic tool or the like. The application liquid may either be an aqueous one or a lipophilic or oily one, such as any ink or any mass-coloring agents, depending on usage of the applicator. In an example, the reservoir may be a cylindrical member (viz., an ink cartridge) opened at its proximal end. In this case a back-flow inhibitor is preferably disposed in the reservoir and in rear of the column of an ink. As another example of this third mode of the invention, the cylindrical reservoir has its proximal end closed to form an air-replacement type applicator. Preferably, the valve body is of a spherical shape, with the distal region of the valve chamber being of a funnel-like shape constricted forwardly. In this case, the distal end of the chamber is constricted towards its frontal extremity to assume a funnel-like shape, and the opening of said chamber has a diameter a little smaller than that of the spherical valve body. It is also preferable to form in the valve chamber a shoulder behind the valve body, so as to prevent it from entirely sinking into the chamber. The tip may be a fiber bundle exuding the liquid due to capillary phenomenon. The tip rear face may be of an area 4 times or more as broad as the distal end of the valve opening.

Also in this eighth mode in non-use, the valve body within the valve chamber of the applicator does remain urged by the biasing member towards the seat in said chamber, thereby closing the reservoir in nonuse not to supply any amount of ink. With the tip's distal end being pressed on a paper sheet or the like to perform writing thereon, the tip's proximal end will push back the valve body a small distance to open the chamber opening. If a ball is used as the valve body, then it can surely and tightly close the opening, irrespective of its rotational positions. Retraction by the small distance of such a ball will be sufficient to provide a desired clearance for dispensing the ink. The reservoir may be disposed in an external cylinder to thereby form a double-wall structure. This structure will enable on one hand the replacement of only the reservoir, and increase freedom in selecting and designing the material and its strength forming the reservoir.

Characteristically, a tip stopper is incorporated in the applicator so that tip retraction beyond a limit is inhibited, and the distal end of valve chamber is located in rear of the proximal end of the tip which the tip stopper supports, wherein the valve chamber is a cylinder whose distal end portion constricted forwards (viz., tapered towards forward extremity). This feature is beneficial in that the cylinder as the valve chamber will lower manufacture cost and improve mass-productivity, and in that the tip will never pressed on the constricted end of the chamber nor on the valve body whereby the tips rear face is protected from being damaged, thus enhancing durability.

An alternative example of this mode resides in that: the tip stopper is disposed around the forward end of the valve chamber and has an engageable portion capable of bearing against the rear face of the tip that is retracted. This engageable portion is located behind the valve body's distal portion protruding forwards from the valve opening, but ahead the distal end of the valve chamber. The tip stopper in this example is also effective to withstand a strong writing pressure that will be imparted to the tip during use.

The applicator of this mode may further comprise a valve rest that will delimit retraction distance of the valve body. There is thus provided a space between the rest and the forward opening of the valve chamber, in which space the valve body can reciprocate fore and aft. With the valve body engaging the valve rest, its forward end will be at a position behind the valve chamber's forward end. Due to this feature, the valve body is now capable of being completely retracted in the chamber, so that this body's forward end will never forced onto the central region of the tip's rear end face, protecting this region from damage.

The applicator of this mode may alternatively comprise a valve rest that will delimit retraction distance of the valve body. There is thus provided a space between the rest and the forward opening of the valve chamber, in which space the valve body can reciprocate fore and aft. With the valve body engaging the valve rest, its forward end will protrude forwards from the valve opening but behind the tip stopper's engageable portion then in contact with the tip's rear end face. In short, the valve body is capable of retraction a decreased distance to suppress the ink flow rate, and the tip stopper is located ahead the rear end of the retracted tip. Due to this feature, whereby the valve body's forward end will never forced onto the central region of the tip's rear end face, also protecting this region from damage.

In a ninth mode of carrying out the invention to achieve the ninth object set forth above, the applicator comprises a reservoir for storing a given amount of an application liquid, a tip disposed in front of the reservoir and movable fore and aft, and a valve assembly for enabling and disabling feed of the liquid from the reservoir to the tip. The valve assembly comprises a valve seat having a forward opening, a valve body disposed behind the valve seat, a valve stopper for supporting the valve body at its rear end so as to press the valve body onto the seat to thereby close the forward opening, and a valve chamber defined as a space between the valve stopper and the seat so that the valve body is accommodated in the chamber. Formed through the valve stopper is a passage for allowing the liquid to flow from the reservoir into the chamber. The valve body is formed of an elastic material compressible in a fore-and-aft direction when pushed with the tip moving backwards. The applicator may for example be a writing tool, a cosmetic tool or the like. The application liquid may either be an aqueous one or a lipophilic or oily one, such as any ink, any mass-coloring agent or any manicure liquid, depending on usage of the applicator. The reservoir may preferably be a cylindrical member (viz., an ink cartridge) opened at its proximal end. In this case a back-flow inhibitor is preferably disposed in the reservoir and in rear of the column of an ink. The tip may be a fiber bundle such as a felt exuding the liquid due to capillary phenomenon. The rear end of the tip, or the rear end of an additional member moving in unison with the tip, may be positioned to contact the forward end portion of the valve body. The distal end of the chamber may be constricted towards its frontal extremity to assume a funnel-like shape, and the opening of said chamber has a diameter a little smaller than that of the spherical valve body. The reservoir may be disposed in an external cylinder to thereby form a double-wall structure. This structure will, as described above repeatedly, enable on one hand the replacement of only the reservoir, and increase freedom in selecting and designing the material and its strength forming the reservoir.

Also in this ninth mode in non-use, the valve body within the valve chamber of the applicator is normally at its position closing the forward opening of the reservoir not to supply any amount of ink. With the tip's distal end being pressed on a paper sheet or the like to perform writing thereon, the tip's proximal end will push the valve body upwards a small distance to open the chamber opening and start to supply ink to the tip. The valve body in this case is formed of a material capable of elastic deformation, so that it will deform itself elastically until it inhibits the tip from moving backwards any more. This feature is effective to diminish shock caused by the members colliding with each other.

The valve body that is preferably of a spherical shape may be designed to have a property that it closes the passage in the valve stopper, in response to a predetermined pressure. Depending on the level of this predetermined pressure, only an extraordinary strong writing pressure applied to the tip may cause the closing of said passage to thereby stop feed of the ink and prevent the dripping thereof. The level of that predetermined pressure can be changed so that even an ordinary writing pressure will close the passage. In the latter case, the valve body functions as a kind of check valve that will inhibit the ink from flowing back when writing is done onto an overhanging object.

In a preferable or typical example, a spherical valve body is placed in a cylindrical valve chamber. The valve body will engage at its entire circumference along 'equator' with the inner periphery of the chamber, in response to a pressure above a predetermined value, so as to close the forward valve opening. In other words, the valve body compressed in axial direction of the chamber tends to expand sideways in a direction perpendicular to the axial direction, whereby the equator zone in its entirety does contact the complete inner periphery to seal up the chamber. Therefore as noted above, a writing pressure stronger than a given limit will cause interruption of ink feed to avoid the ink dripping. The valve body may serve in this way as a check valve, as also already discussed above.

This ninth mode provides also an application liquid-supplying valve assembly for the applicator. This assembly, designed to feed the liquid from a reservoir to a writing tip upon retraction thereof, does comprise a valve chamber having a liquid supplying forward opening. The assembly further comprises a valve body accommodated in the chamber, and a valve stopper for supporting the valve body to cause it to close the forward opening, wherein a passage for the liquid is formed in the valve supporter and the valve body is made of a material such as silicone rubber capable of elastic deformation. By virtue of elastic deformation, the valve body will be compressed or expanded fore and aft in axial direction, the forward opening can be opened or closed.

Also preferably and typically, this valve assembly comprises a spherical valve body. This valve body is capable of closing the passage formed in and through the valve supporter, in response to a pressure above a predetermined value. The valve chamber may preferably be a cylinder, so that the valve body will contact the valve chamber's inner periphery, all around its equator under a pressure stronger than a predetermined value acting on it.

In a tenth mode of carrying out the invention to achieve the tenth object set forth above, the applicator comprises an applying tip and an application liquid-storing reservoir. The tip is held in place either by a body of the applicator or by a tip holder secured to a distal portion of the applicator body so as to move fore and aft. The reservoir is designed to dispense therefrom the application liquid, in response to retraction of the tip. The applicator further comprises a resistant member for restricting displacement of the tip within limits, and this resistant member is made of a buffering material such as a silicone rubber. The applicator may for example be a writing tool, a cosmetic tool or the like. The application liquid may either be an aqueous one or a lipophilic or oily one, such as any ink, any mass-coloring agent or any manicure liquid, depending on usage of the applicator. The reservoir may preferably be a cylindrical member (viz., an ink cartridge) opened at its proximal end. In this case a back-flow inhibitor is preferably disposed in the reservoir and in rear of the column of an ink. The tip may be a fiber bundle or the like material that exudes the application liquid due to capillary phenomenon.

In this tenth mode, the free end of the tip may be pressed on a paper sheet or the like to do writing thereon with the liquid that will then be fed to the tip. However retraction of the tip beyond a limit will be hindered by the resistant member, but collision of said tip with this member made of the cushioning material will produce no feeling of bumping or clunking.

The resistant member may be disposed at any location, so long as it can abut against any portion of the tip or against any part accompanying the tip to move in unison therewith. For example, it may be designed to engage with a stepped region formed in the tip and intermediate the forward and rearward ends thereof. Alternatively, the resistant member may be disposed to abut against the proximal end of the tip. In any case, the tip being retracted will come into direct contact with such a resistant member. In still another case, a valve body driven backward by the tip will engage the resistant member so as to stop the tip.

In an eleventh mode of carrying out the invention to achieve the eleventh object set forth above, the applicator comprise a liquid reservoir for storing therein an application liquid, an applying tip disposed in front of the reservoir and capable of moving fore and aft, and a valve assembly intervening between the reservoir and the tip. This applicator is characterized in that the valve assembly is normally closed, and capable of opening in response to retraction of the tip by a relatively short distance, in such a state that a further retraction of the tip by a relatively longer distance will close again the valve assembly. The tip may be formed of a fiber bundle or the like porous material that exudes the liquid due to capillary phenomenon.

In operation, this applicator in its non-use state will not supply the ink since the valve assembly intervening between the reservoir and the tip remains closed. With the tip being retracted the relatively small distance, the valve assembly will open to allow the liquid to flow from the reservoir towards the tip. Further retraction of the tip pressed back more intensively will however close again that valve assembly, to thereby interrupt ink feed, thus preventing the problem of ink dripping. An appropriate biasing member may be incorporated to urge the tip towards its forward home position. A portion of the valve assembly may be utilized to serve as such a biasing member. For example, the valve may comprise a slit valve made of an elastic material and having slits formed therein, so that the distal face of this slit valve can repel forwards the tip whose proximal end is in contact with said face.

In detail and preferably, the applicator of this mode will comprise a liquid reservoir, a slit valve disposed on the distal end of the reservoir, and a applying tip disposed in front of the slit valve and capable of moving fore and aft. The slit valve can deform itself elastically when pressed with the tip retracting in use, to thereby form a temporary opening through which the liquid will be delivered to the tip from the reservoir. This temporary opening will be closed when the tip returns to its forward home position. Further, the applicator comprises a passage disposed in rear of the slit valve's proximal portion so as to guide thereto the liquid from the reservoir. This passage will remain opened so long as elastic deformation of the slit valve is below a limit, but will be closed when the elastic deformation is increased to exceed the limit. Thus, the valve assembly mentioned above is composed of the slit valve and the passage, in this example.

The application liquid may either be an aqueous one or a lipophilic or oily one, such as any ink, any mass-coloring agent or any manicure liquid, depending on usage of the applicator. The reservoir may either be a discrete cylinder or a part of the applicator body. As the reservoir for a liquid of a relatively low viscosity, the cylinder having a closed rear end and having a front end facing the slit valve may preferably be used. Alternatively, another cylinder having an open rear end may be employed as the reservoir. In this case, a back-flow inhibitor or a sliding plug is preferably disposed in the reservoir and in rear of the column of an ink so that the inhibitor or plug will slide ahead within the reservoir, caused by decrease in amount of the ink therein.

The slit valve may be made of a sheet or plate of the elastic material, which slits penetrate for and aft.

Conveniently, a short elastic cylinder with a closed bottom through which such slits are formed may be employed as the slit valve. In operation of this example, the slits penetrating the bottom will be opened rearwards to communicate with the interior of the reservoir through a passage. However if the leaves in the bottom defining the slits are forcibly pressed against the reservoir, then the passage will be closed.

The passage may be formed in and through a partition closing the forward end of the reservoir. A main cavity for storing the liquid is defined upstreamly of the partition, with a narrower space intervening between this partition and the slit valve. The passage may be composed of a single throughhole, or two or more of them. This or these holes may be of any proper size and shape, but preferably, they are relatively small round holes as compared with the slit valve.

In a twelfth mode of carrying out the invention to achieve the twelfth object set forth above, the applicator comprises an application liquid-storing reservoir, a passage formed in the distal end so as to allow the liquid to flow therethrough, a valve assembly for opening and closing the passage, a biasing member urging forwards the valve assembly so as to close the passage, and a tip disposed in front of the reservoir. The tip has its rear end in engagement with the valve assembly such that the passage is opened to feed the liquid to and around the tip's rear end when the tip is pushed back against the urging force of the biasing member.

At least a rear portion of the tip is enclosed in an external cylinder together with the valve assembly and the reservoir so that two closed spaces are formed, one between the tip rear portion and the external cylinder, the other between the reservoir and the external cylinder. The former space communicates with the latter space in which an anti-drying agent is disposed. Those 'closed spaces' may however include those which communicate with ambient atmosphere to a somewhat noticeable extent. The applicator may for example be a writing tool, a cosmetic tool or the like. The application liquid may either be an aqueous one or a lipophilic or oily one, such as any ink, any mass-coloring agent or any manicure liquid, depending on usage of the applicator. Typically, the reservoir is a cylindrical member having its proximal end closed. In this case, air will continue to slowly enter the reservoir as the liquid is discharged continuously, thereby effecting gradual replacement of the ink space by the ambient air.

With the applicator not in use, the biasing member is urging forwards the valve assembly to stop the passage and thereby close the reservoir, disabling ink feed. If however the tip is pressed on a paper sheet to do writing thereon, then the tip's rear end will push backwards and upwards the valve body to open the passage. During storage of the applicator, the solvent will continuously and gradually evaporate from the anti-drying agent so as to almost saturate the air inside the external cylinder with the solvent vapor. The ambient air almost saturated with the solvent vapor will thus suppress evaporation of the solvent from the tip, thereby protecting it from drying up.

The anti-drying agent mentioned above is such a material as absorbing and retaining a solvent of the ink or the like application liquid stored in the reservoir. If the ink is an aqueous one, then a sponge or a block of a highly water-absorptive polymer may be employed as that anti-drying agent. If the ink is a lipophilic one, then a sponge or the like porous material soaked with an alcohol or the like organic solvent may be used, or alternatively, a grease-like paste substantially formed of such a solvent may substitute for the sponge. It will be understood that even if any solvent different from that contained in the ink is used to impregnate the anti-drying agent, its vapor diffusing throughout and in the external cylinder will increase total vapor pressure and thus suppress the succeeding evaporation of the ink solvent, thus affording the same effect as noted-above. In any case, the solvent contained in the anti-drying agent will evaporate to emit into the closed spaces an innumerable number of vapor molecules at ambient temperatures so that the air saturated with them will hinder the ink solvent to further evaporate.

The applicator of this type may be such that both the ink reservoir and external cylinder are cylindrical, with the latter having its rear end closed so that the anti-drying agent will be held in and near the rear end. A proximal stopper having the anti-drying agent secured therein may be used to close that rear end. This double-cylindrical structure will give an aesthetic appearance to the applicator. The anti-drying agent disposed in and near the external cylinder rear end will simplify in structure and render more compacted a zone where the applying tip and the valve assembly are located. Such an applicator will be convenient to use as a pen-type writing tool or as a cosmetic tool. The proximal stopper can more readily be filled with the anti-drying agent, as compared with other cases.

If necessary or desirable, a valve holder for fixedly supporting the valve assembly may be formed in and at a middle region of the external cylinder. In this case, some holes penetrating the holder will provide fluid-communication between the first and second closed spaces. By this feature, the holder keeps the reservoir in place in the external cylinder in a stable manner, and the holes in the holder serve as a passage for the solvent vapor diffusing from the anti-drying agent located behind the reservoir, allowing the vapor reaching the space around the tip.

THE PREFERRED EMBODIMENTS

Now, some preferable embodiments of the present invention will be described below referring to the drawings.

First Embodiment

FIGS. 1 to 5 show a first embodiment of the present invention, wherein a pen 1 having a fiber bundle tip using an aqueous ink is illustrated for exemplary purpose. This applicator 1 comprises a pen body 2 that is formed as an external cylinder or body, a proximal stopper 7, an ink supplying device 30, and a pen-point tip 5. The ink supplying device 30 is composed substantially of an ink reservoir 3, a distal stopper 4, an ink feed valve 6 and a follower (sealant) 8.

The pen body 2 is a cylindrical member made of a plastics such as a polypropylene, or made of a metal such as aluminum or a stainless steel. Preferably, this body 2 is made of a transparent or translucent hard synthetic resin. The pen body 2 is gradually decreased in diameter, thus constricted towards its distal end. The thinnest distal end of this pen body 2 is a tip-holding cylindrical portion 2*b*, in which the tip 5 is fitted tightly but capable of sliding fore and aft. Vertical grooves 25 and ribs 26 are formed in the inner periphery of the cylindrical portion 2*b*. A piece of a urethane foam 16 detailed below is secured in a space defined between those ribs 26 and the inner periphery of the pen body 2. Thus, air inlet is provided for ambient air. Such an air inlet may alternatively be formed in the periphery itself of said cylinder. A cap (not shown) is removably attached to the distal end of the pen body 2.

The ink supplying device 30 is disposed in the pen body 2, and supplies an ink at a moderately low rate only when writing is done. This device 30 comprises the cylindrical reservoir 3 for storing the ink (application liquid), and the distal stopper 4 disposed in the distal region of the reservoir 3 and having a ink feed bore 9 formed therethrough. The device further comprises the ink feed valve 6 secured in the bore 9 of distal stopper 4.

The ink reservoir 3 is a cylinder made of a plastics such as a polypropylene, or of a metal such as aluminum or stainless steel. This reservoir 3 and the pen body 2 holding it therein constitute a double-cylinder structure, in which the former is regarded as an internal cylinder, with the latter regarded as an external one. The ink reservoir 3 that is hollow to store the ink has an outer diameter smaller than the inner diameter of the pen body 2 so as to define a space between them.

The distal stopper 4, made of a hard resin such as a polypropylene or a proper metal, is located intermediate between the proximal and distal ends of the pen body 2. Axially formed through the distal stopper 4 is the ink feed bore (liquid-feeding bore) 9, whose inner diameter gradually increases towards its distal end.

A proximal portion 4*a* of the distal stopper 4 is a cylindrical part fitted in a cylindrical sealant 20. This sealant 20 intervening between the outer periphery of the proximal portion 4*a* and the inner periphery of the ink reservoir prevents the ink from leaking.

In this embodiment, a material forming the sealant 20 permeates or transmits through it the vapor of solvent contained in the ink. For aqueous inks, sealing materials having permeability coefficient of 2.5–10.0 $cm^3 \cdot cm/cm^2 \cdot s \cdot Pa$, or more preferably 3.0 $cm^3 \cdot cm/cm^2 \cdot s \cdot Pa$ or higher for water vapor, are desirable. Silicone rubbers or the like porous substances will qualify as such materials of the sealant 20. Silicone rubbers and their copolymers have each a fine texture in which molecules are coarsely packed and distance between adjacent molecules is so large that they are highly flexible and afford excellent permeation of vapor. Therefore, silicone rubbers or the like can be employed as the sealant 20 even in case of oily or lipophilic inks. Water vapor, that is a gas of solvent evaporated from the ink, will thus permeate the sealant 20 and reach a space around the tip 5, to thereby suppress natural and undesirable evaporation of the solvent from the tip.

The proximal portion 4*a* of the distal stopper 4 is tightly fitted in the distal end of the reservoir 3, with the sealant 20 intervening between them. A large diameter portion 4*b* protruding in radial direction is formed integral with a middle portion of the stopper 4 and firmly fitted in the pen body 2. A shoulder 2*a* formed in the inner periphery of the pen body 2 supports the distal face of the large diameter portion 4*b*. In this manner, the reservoir 3 is immovably connected by the distal stopper 4 to the pen body 2.

Figure 4:
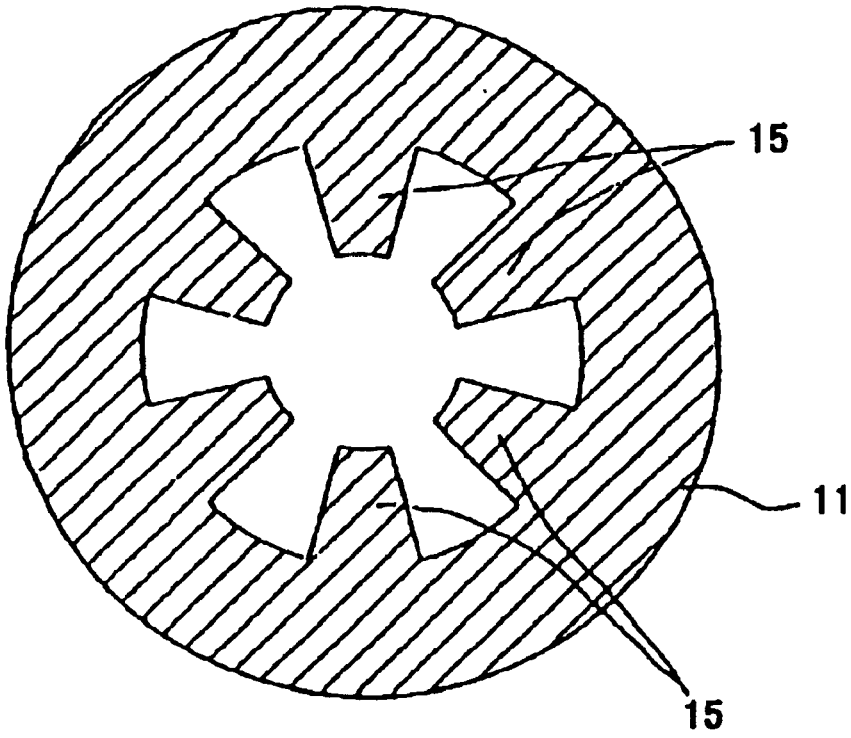
FIG. 4 is a cross section taken along the line II—II in FIG. 3.
Figure 5:
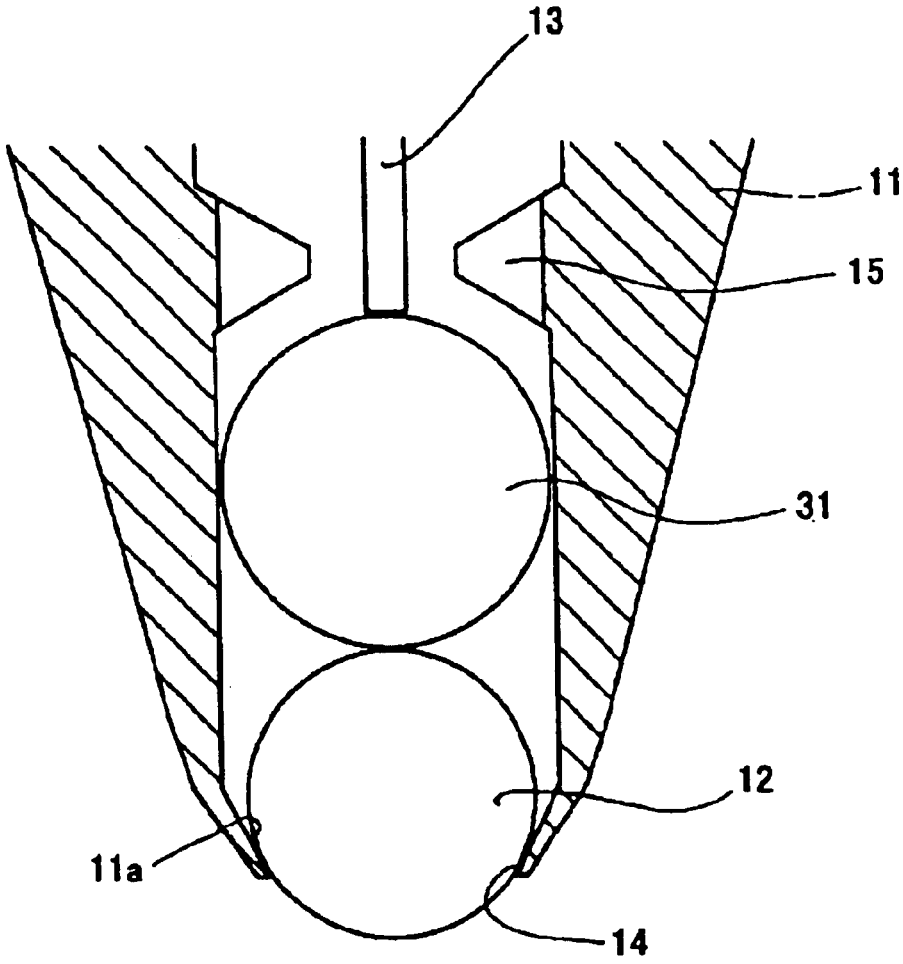
FIG. 5 is an enlarged fragmentary cross section of an example of the distal portion which one type of a device comprises, which device is intended to supply an application liquid and included in the applicator shown in FIG. 1.

As shown in FIG. 4, the large diameter portion 4*b* has holes 10 penetrating it to convey the gas permeating through the sealant 20 towards the space around the tip 5. Some sectors as such holes 10 are arranged at regular angular intervals in FIG. 4, though shape and the number of them are not delimited to those in this example. A distal portion 4*c* protrudes forwards from the distal face of large diameter portion 4*b*.

The ink feed valve 6 is composed of a housing (valve chamber) 11, a spherical valve body 12 held therein, a flow restrainer 31 also held in the housing but in rear of the valve body, and a spring (biasing member) 13 urging the valve body towards a valve seat through the restrainer 31. The housing 11, that is a plastics cylinder or a metal cylinder, has a forward end whose inner periphery serves as the valve seat.

The housing 11 fitted in the forward end of the ink feed bore 9 has a rear face bearing against a stepped shoulder that is formed at an intermediate region of said bore. The distal stopper 4 holding the housing 11 in this manner serves as a holder for the entirety of ink feed valve 6.

The housing 11 is generally of a structure similar to the distal end of each usual ball-point pens. Distal end of the cylindrical housing is constricted to reduce diameter towards the distal extremity, and has an interior in which the valve body 12 and the flow restrainer 31 are allowed to move a little distance fore and aft. This interior is a cylindrical space and has a uniform diameter over its full length in axial direction. A valve seat 11*a* is the foremost portion of this interior, which portion is tapered to reduce diameter towards the distal extremity. A (forward valve) opening 14 formed through the seat 11*a* has a diameter that is about 50% to 95% of the diameter of valve body 12. The distal end of the cylindrical housing 11 is smaller in diameter than the rear end face of the tip 5, whereby a central region of this face is in contact with the forward (distal) portion of the valve body 12 protruding forwards through opening 14 of the valve seat.

Details of the internal structure of valve housing 11 are as follows. As will be seen in FIGS. 2 to 5, lugs 15 protrude in a centripetal direction from the inner periphery of the housing 11, at its portion near the distal extremity. Those lugs 15 are spaced from each other in circular direction, thereby defining slits each between two adjacent lugs. The slits extend axially of the valve housing and across those lugs. Each lug 15 has its forward surface (lower surface in FIGS. 3 and 5) tapered towards the axis of cylinder so as to be retracted rearwards. Those lugs 15 as a whole do contact and support the flow restrainer 31. However, the present invention does not necessarily require such lugs 15 (support). In cases wherein, as illustrated, those lugs are formed, they may assume as a whole a kind of flange devoid of any slits or having its forward face formed with several circular recesses.

A round central cavity is defined between the lugs, and the distal portion of the spring 13 extends through this cavity. Defined by and between the valve opening 14 and the support for restrainer 31 is a relatively narrow cavity in which the valve body 12 and the restrainer can move a short distance fore and aft. When the tip 5 pushes back the valve body 12, the opening 14 will open to supply the tip with ink.

Distance between one position where the opening 14 remains closed with the valve body 12 and the other position where the flow restrainer 31 rests on the support (lugs 15), may be 0.01 mm to 0.5 mm in the illustrated example of the writing tool. More preferably, such distance of displacement may be selected from a range of 0.02 mm to 0.2 mm. In an air-replacement type in which the reservoir 3 has a closed bottom, the distance may be 0.1 mm to 2 mm, and more preferably 0.1 mm to 1 mm.

The valve body 12 is made somewhat smaller in diameter than the flow restrainer 31. Inner diameter of the housing 11 (space for accommodation of valve body 12) is slightly larger than that of flow restrainer 31. Clearance between the flow restrainer 31 and the inner periphery of housing 11 is designed to be noticeably smaller than that between the valve body 12 and the said periphery. Thanks to this feature, the restrainer 31 is effective to control the flow rate of ink at a desired moderately low level.

The valve body 12 may be formed of any plastics, but preferably of a metal such as used in the ordinary ball-point pens. Its diameter may be 0.3–20 mm, more preferably 0.6–2 mm. The restrainer 31 may also be made of a plastics or metal.

The spring 13 disposed in rear of flow restrainer may be made using a nylon fishing gut, a wire leader or the like thin elongate material, or alternatively a compression coiled spring may be employed. The spring 13 protrudes backwards through the rear opening of the housing 11 so that its rear end bears against another shoulder formed in the ink feed bore 9. The frontal end of the spring 13 remains in engagement with the flow restrainer 31. By this arrangement of the members, the spring 13 always urges the valve body 12 through the restrainer and forwards onto the seat 11*a* (rim of the opening 14). A distal portion of the valve body protrudes through and forwards from the opening 14.

The tip 5 is composed of any known material such as a resin or a fiber so that it can exude ink due to capillary action. Any proper material may be used alone to form the tip, although any composite rod consisting of a plastics piece and a fiber bundle connector bonded thereto are employable, too. Instead of them, any tip of the so-called 'writing brush' type or a length of thin metal tube may be used.

The distal end of the tip 5 protrudes forwards beyond the distal end 2*b* the pen body 2, for convenience in writing characters or drawing strokes, with the proximal end of the tip contacting the valve body 12 of the ink feed valve 6. The tip 5 consists of a distal small diameter portion 5*a* and a proximal large one 5*b* integral therewith. Diameter of this large diameter portion 5*b* is made somewhat smaller than that of the inner periphery of pen body 2, so as to define between them a small clearance. Thus, a narrow space around that tip's proximal larger portion communicates through the holes 10 (of the distal stopper 4) with the forward face of sealant 20.

The proximal portion 5*b* of tip has its outer surface exposed in the interior of pen body 2, as noted above. However, solvent vapor molecules emitted from the ink held in the reservoir 3 will permeate the sealant 20 and advance to the said interior, saturating it with them and thus inhibiting further evaporation of solvent from the tip.

In the pen body 2 and in rear of the tip holding portion 2*b* thereof, a mass of urethane foam 16 is secured. A superfluous amount of ink will be absorbed by this mass of urethane foam, and later this foam will occasionally supplement the ink in the tip from time to time. The urethane foam 16 has its inner end bearing against the shoulder formed between the small diameter and large diameter portions 5*a* and 5*b*. This arrangement, that the tip 5 is urged inwards by this foam 16 but with a force weaker than the spring 13 urging the tip outwards, is useful to avoid rickety motion of the tip and unintentional opening of the valve 6.

The ink reservoir 3 is filled, initially, with an aqueous ink or any other desired application liquid. Also incorporated in the reservoir is a closing or back-flow inhibiting member 8 that is composed of, in the illustrated example, a rubber or plastics float 8*a* and an agent 8*b* enclosing same. This agent 8*b* may be a polybutene or the like. The member 8 is located at a boundary between the ink column and a vacant space present behind same so as to seal the rear end of ink column. Such a back-flow inhibiting member will advance forward, following forward shrinkage of the column caused by consumption of the ink. It also may be possible that only the agent 8*b* constitutes the closing member 8.

A proximal stopper 7 is attached to the proximal end of the pen body 2. This stopper comprises a lid 7*a* and a short cylinder 7*b* continuing therefrom and protruding forwards. The short cylinder 7*b* has such a diameter as air-tightly fitting in the pen body 2.

In operation, the applicator 1 provided in this embodiment will have its valve 6 maintained closed so long as it is left non-used. This is because the spring 13 continues to urge the valve body 12 towards the rim around the opening 14 of the housing. Any positive feed of ink is not effected in this state. Since the rear face diameter of the tip 5 is twice or more as large as the opening 14, a little amount of ink that might be transferred un-intentionally to the tip during non-use will be absorbed well by same, not causing any problem of ink dripping.

When writing is done, the writing pressure will be imparted to the tip 5 to press it backwards, to thereby force inwards the valve body 12 and flow restrainer 31. The opening 14 in the valve housing 11 will open instantaneously in this manner. In the preset embodiment, stroke of the valve body 12 is 1 mm or less, and a force necessary for this extent of retraction is 100 gf or less. The users of this applicator will scarcely feel such a motion of the tip. The writing pressure opens the valve 6 automatically and sufficiently, so that the writing operation need no longer be interrupted by the users for the purpose of strongly pressing the tip to forcibly exude ink through it.

As already described above, the forward end of the distal portion 4*c* of the distal stopper 4 is located between the foremost end portion of the valve body 12 (protruding from the valve's opening 14) and the rearmost forward end of the valve hosing (cylinder) 11. Thus, with the valve body 12 being pushed back with the tip 5, said distal end of the stopper 4 will be brought into contact with the rear face at its outer circular zone of the tip's larger inner portion's 5*b*. Consequently, the tip is inhibited to move backwards any more, and no pressure stronger than the urging force of the spring 13 will be applied to the central region of the tip's rear face. In other words, writing pressure is always born by the distal end 4*c* of distal stopper 4 serving as a retraction delimiter, and thus tip's rear central zone will no longer be damaged.

Still in other words and in short, the tip 5 is prevented by the distal stopper 4 from being excessively pushed back to collide with the relatively acute valve housing 11, which would otherwise injure the said central zone of the tip rear portion. By virtue of this feature, the applicator of this embodiment can now be used more or less violently, without affecting the function of the valve 6 and durability of the applicator.

Figure 6:
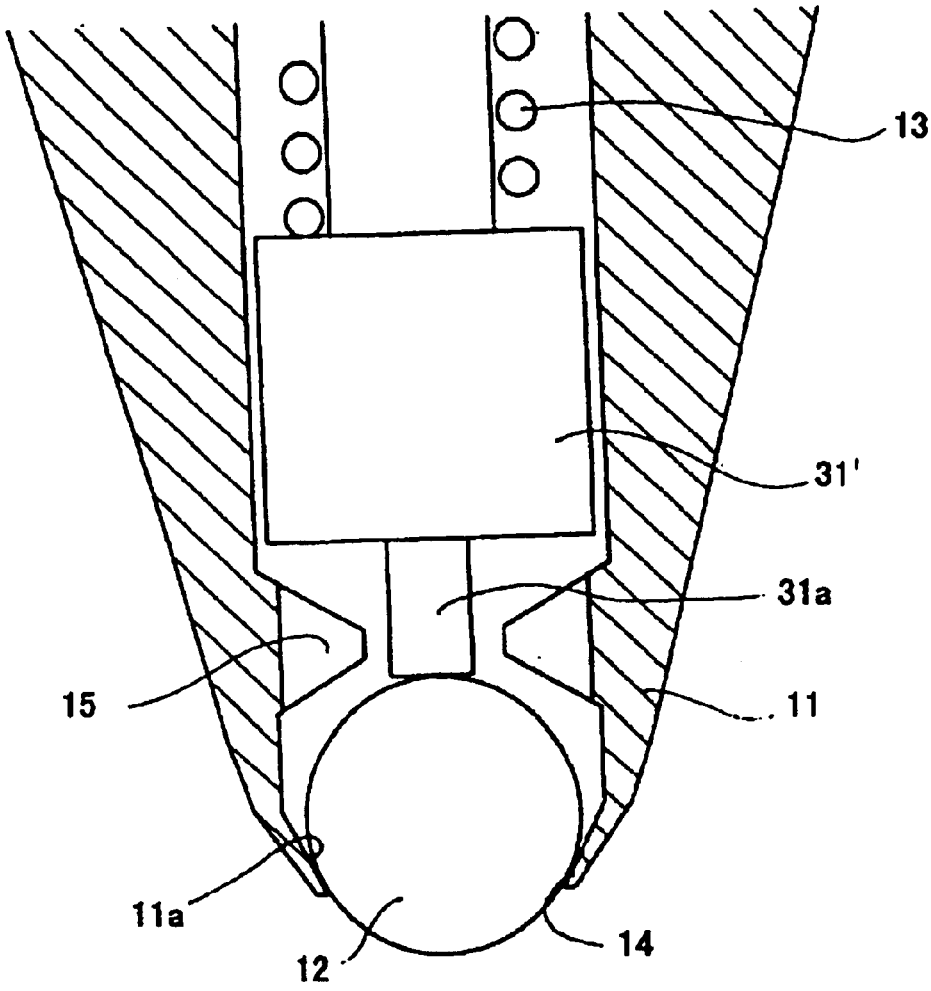
FIG. 6 is an enlarged fragmentary cross section of another example of the one type device.

The flow restrainer 31 need not necessarily be a ball but may be a columnar piece, as shown in FIG. 6. In this case the lugs 15 as the support for valve body 12 is interposed between it and the restrainer 31. A forward protrusion 31*a* is formed integral with the restrainer so as to extend through the central cavity surrounded by the lugs 15. The distal end of this protrusion 31*a* is kept in contact with the valve body 12. Instead of those spherical or columnar restrainer, any other one of different shapes and structures may be employed insofar as the necessary and moderate flow rate is ensure for the ink. Any valve body other than the spherical one may be used, instead thereof, and for example a conical valve body as used in the usual fiber bundle type pens is employable herein.

Second Embodiment

FIGS. 7 to 11 show a second embodiment, wherein a pen 1 having a fiber bundle tip using an aqueous ink is illustrated for exemplary purpose. This pen or applicator 1 comprises an external cylinder 2 as a pen body, an ink reservoir 3, a distal stopper 4, a pen-point tip 5 formed of a fiber bundle, a valve 6 and a proximal stopper 7. The applicator further comprises a follower (sealant) 8.

The external cylinder 2 is made of a plastics such as a polypropylene, or made of a metal such as aluminum or a stainless steel. Preferably, this external cylinder 2 is made of a transparent or translucent hard synthetic resin, and its diameter gradually decreases towards its distal end. The thinnest distal end of the external cylinder 2 is a tip-holding cylindrical portion 2*b*, in which portion the tip 5 is fitted tightly but capable of sliding fore and aft. An inlet for ambient air may be formed in any proper portion of the external cylinder. In the illustrated example, vertical grooves 25 and ribs 26 are formed in and extend along the inner periphery of the cylindrical portion 2*b*. A piece of a urethane foam 16 detailed below is secured in a space defined between those ribs 26 and the inner periphery of the external cylinder 2. Alternatively, air inlet for ambient air may be formed directly in the periphery itself of said cylinder. A cap (not shown) is removably attached to the distal end of the pen body 2.

The ink reservoir 3 is a cylinder made of a plastics such as a polypropylene, or of a metal such as aluminum or stainless steel. This reservoir 3 held in place in the external cylinder 2 is hollow to store the ink, and has an outer diameter smaller than the inner diameter of said cylinder so as to define a space between them. An aqueous ink stored in the reservoir 3 has a viscosity of 100 mPa·s or less. This viscosity is, as usual, somewhat higher than that of water due to dyestuffs and/or pigments contained in the functioning as a solvent. Thus, the ink filling this reservoir of the embodiment is of a viscosity from 1 mPa·s to 100 mPa·s.

The distal stopper 4, made of a hard resin such as a polypropylene or a proper metal, is located intermediate between the proximal and distal ends of the external cylinder 2. Axially formed through the distal stopper 4 is an ink feed bore 9. A proximal portion 4*a* of the distal stopper 4 is a cylindrical part fitted in a cylindrical sealant 20. This sealant 20 intervening between the outer periphery of the proximal portion 4*a* and the inner periphery of the ink reservoir 3 prevents the ink from leaking out.

Also in this embodiment, a material forming the sealant 20 permeates or transmits through it the vapor of solvent contained in the ink. For aqueous inks, sealing materials having permeability coefficient of 2.5–10.0 $cm^3 \cdot cm/cm^2 \cdot s \cdot Pa$, or more preferably 3.0 $cm^3 \cdot cm/cm^2 \cdot s \cdot Pa$ or higher for water vapor, are desirable. Silicone rubbers or the like porous substances will qualify as such materials of the sealant 20. Silicone rubbers and their copolymers have each a fine texture in which molecules are coarsely packed and distance between adjacent molecules is so large that they are highly flexible and afford excellent permeation of vapor. Therefore, silicone rubbers or the like can be employed as the sealant 20 even in case of oily or lipophilic inks. Water vapor (gaseous solvent evaporated from the ink) will thus permeate the sealant 20 and reach a space around the tip 5, to thereby suppress natural and undesirable evaporation of the solvent from the tip.

Figure 10:
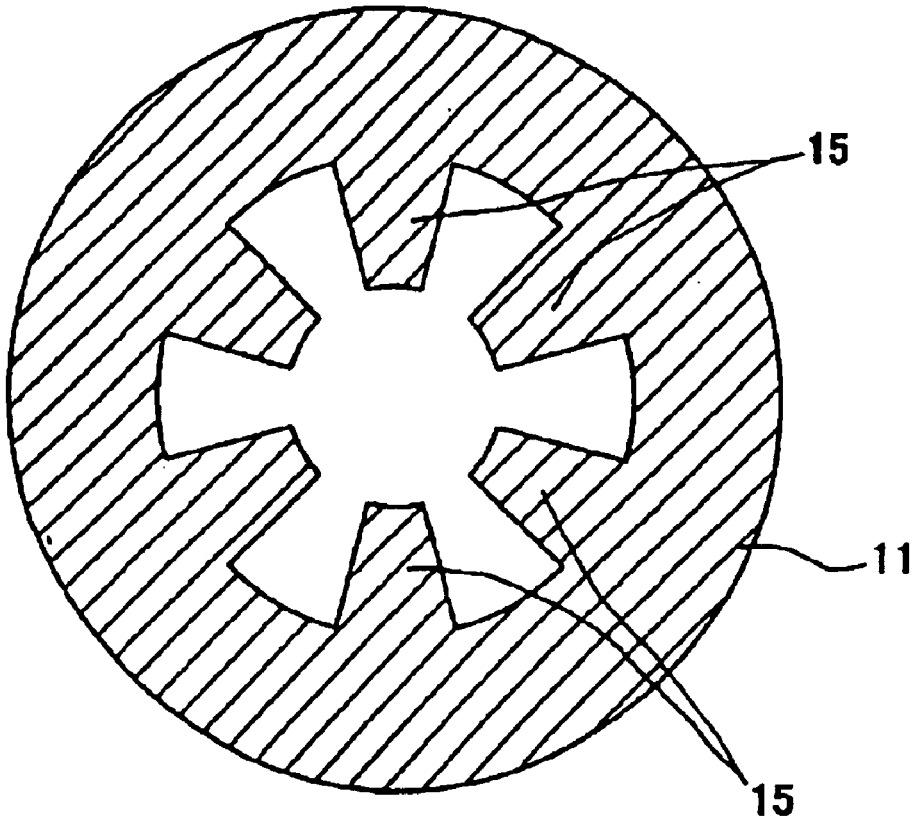
FIG. 10 is a cross section taken along the line IV—IV in FIG. 9.
Figure 11:
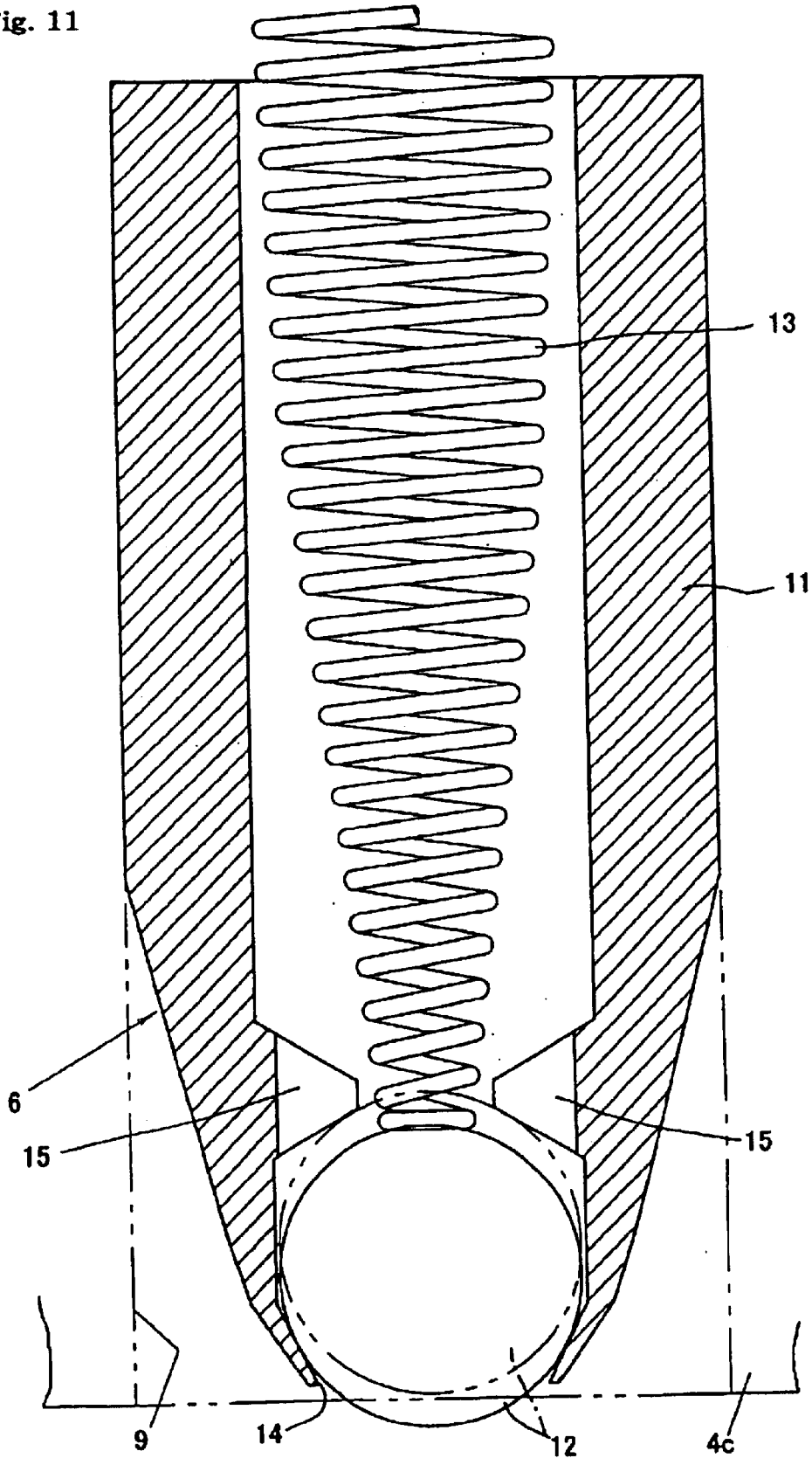
FIG. 11 is an enlarged fragmentary cross section of an example of the distal portion which one type of a device comprises, which device is intended to supply an application liquid and included in the applicator shown in FIG. 7.

The proximal portion 4*a* of the distal stopper 4 is tightly fitted in the distal end of the reservoir 3, with the sealant 20 intervening between them. A large diameter portion 4*b* protruding in radial direction is formed integral with a middle portion of the stopper 4 and firmly fitted in the pen body 2. A shoulder 2*a* formed in the inner periphery of the pen body 2 supports the distal face of the large diameter portion 4*b*. In this manner, the reservoir 3 is immovably connected by the distal stopper 4 to the pen body 2. As shown in FIG. 10, the large diameter portion 4*b* has holes 10 penetrating it to convey the gas permeating through the sealant 20 towards the space around the tip 5. Some sectors as such holes 10 are arranged at regular angular intervals in FIG. 4, though shape and the number of them are not delimited to those in this example. A distal portion 4*c* protrudes forwards from the distal face of large diameter portion 4*b*.

The valve 6 is composed of a housing (valve chamber) 11, a spherical valve body 12 held therein, and a spring 13 urging the valve body towards a valve seat. The housing 11 is fitted in the ink feed bore 9, so that the distal stopper 4 holding this housing serves as a holder for the valve 6 in its entirety.

The housing 11 is generally of a structure similar to the distal end of each usual ball-point pens. The cylindrical housing has a vacant interior in which the valve body 12 is accommodated, and whose forward portion is tapered to reduce diameter towards the distal extremity. A (forward valve) opening 14 formed in and through this distal extremity has a diameter that is preferably about 50% to 95% of the diameter of valve body 12. The distal end of the cylindrical housing 11 is smaller in diameter than the rear end face of the tip 5, whereby a central region of this face is in contact with the forward (distal) portion of the valve body 12. Details of the internal structure of valve housing 11 are as follows. As will be seen in FIGS. 9 to 11, lugs 15 protrude in a centripetal direction from the inner periphery of the valve housing. Those lugs 15 are spaced from each other in circular direction, thereby defining slits each between two adjacent lugs. The slits extend axially of the valve housing and across those lugs. Each lug 15 has its forward surface (lower surface in FIGS. 9 and 11) tapered towards the axis of cylinder so as to be retracted rearwards. Those lugs 15 as a whole do contact and support the valve body 12 at its proximal portion. On the other hand, the distal portion of the valve body 12 protrudes forwards through and from the forward valve opening 14.

Defined by and between the valve opening 14 and the support for valve body is a relatively narrow cavity in which the valve body 12 can move a short distance fore and aft. When the tip 5 pushes back the valve body 12 (as indicated at 'double-dots and dash' in FIG. 11), the opening 14 will open to supply the tip with ink. However, the present invention does not necessarily require such lugs 15 (support). In cases wherein, as illustrated, those lugs are formed, they may assume as a whole a kind of flange devoid of any slits or having its forward face formed with several circular recesses.

Figure 7:
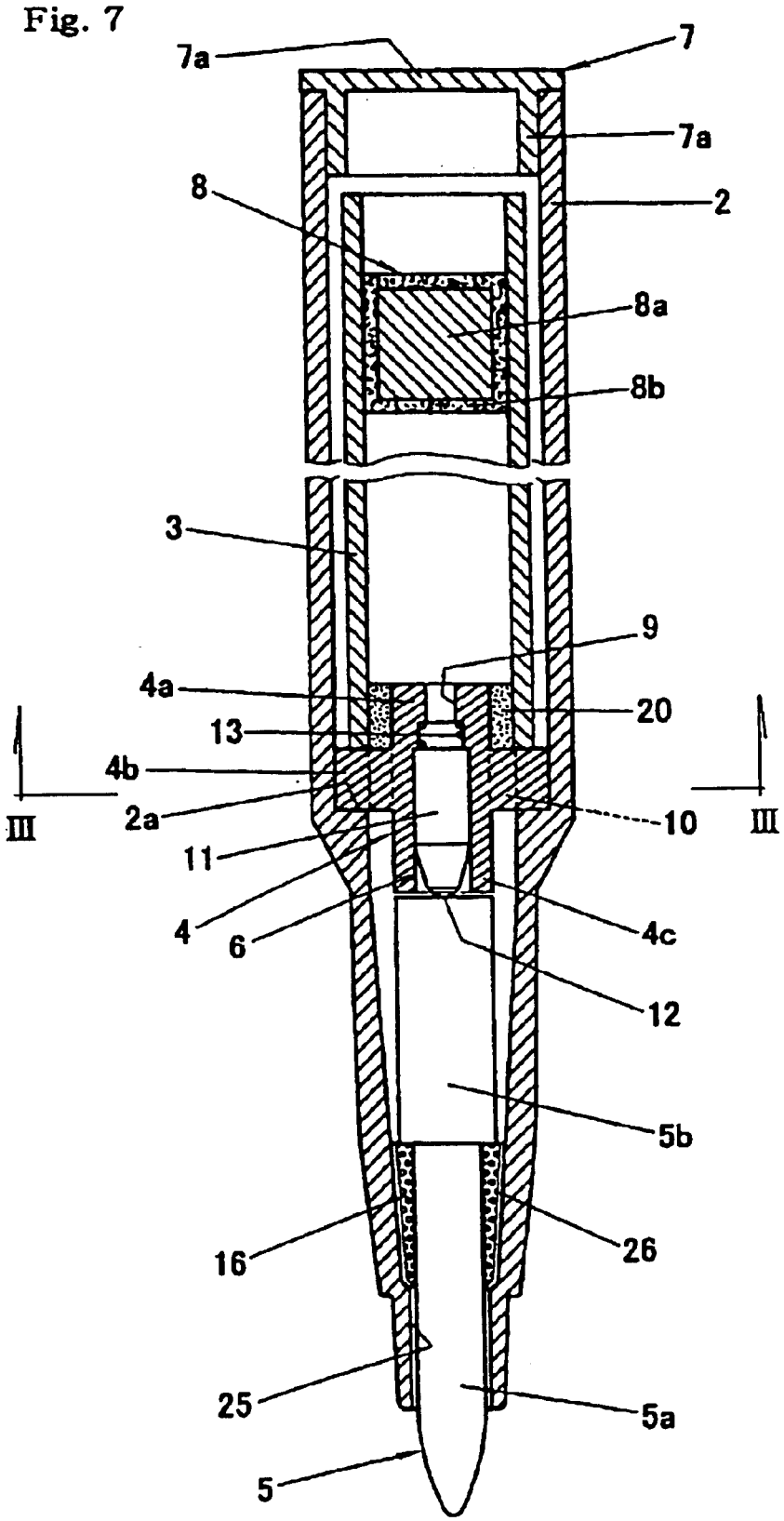
FIG. 7 is a vertical cross section of an applicator provided in another embodiment of the present invention.
Figure 8:
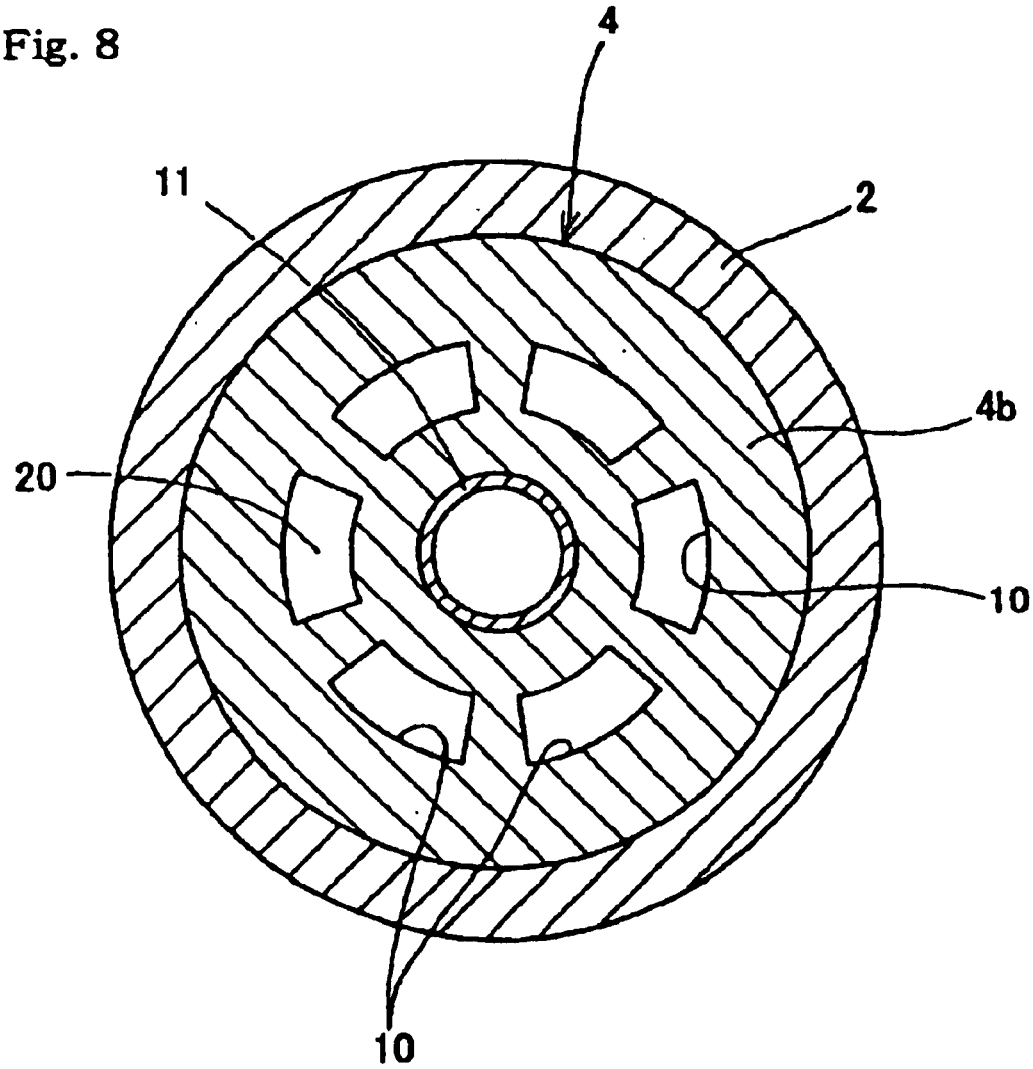
FIG. 8 is a cross section taken along the line III—III in FIG. 7.
Figure 9:
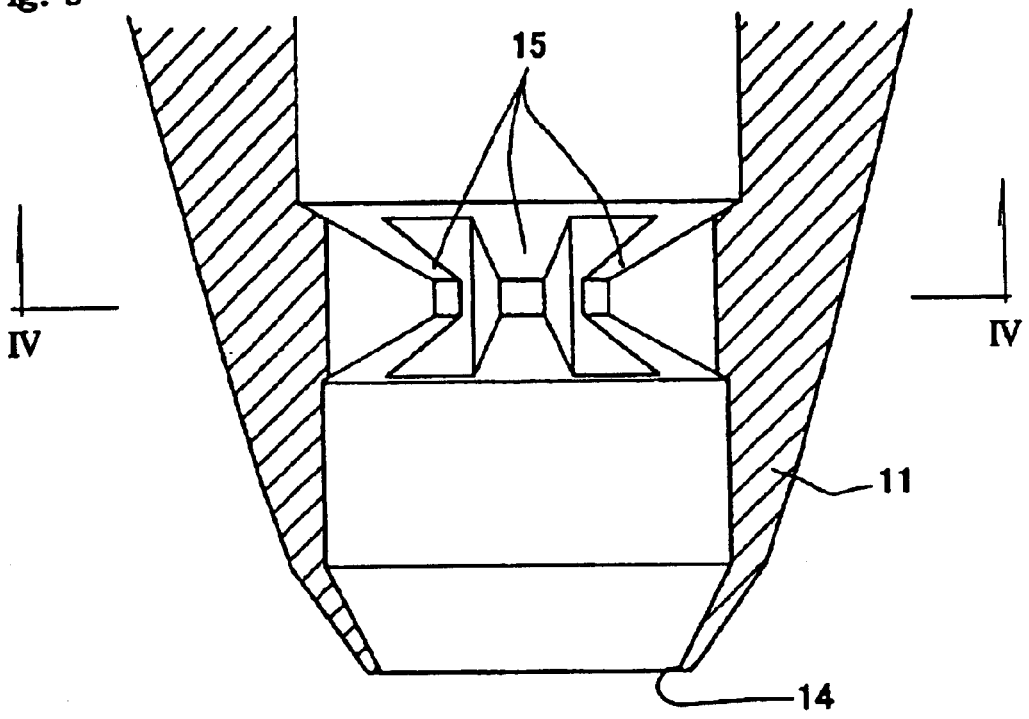
FIG. 9 is an enlarged fragmentary cross section of the distal portion of a valve housing included in the applicator shown in FIG. 7.

Distance between one position of the valve body 12 where it closes the opening 14 and the other position where it rests on the support (lugs 15), may be 0.1 mm to 1 mm, more preferably of 0.2 mm to 0.4 mm in the illustrated example of the writing tool shown in FIG. 7. Alternatively, such distance of displacement may be selected from a range of 0.01 mm to 0.5 mm, or form 0.02 mm to 0.2 mm. The valve body 12 is made somewhat smaller in diameter than the inner diameter of the housing 11 in order to maintain the flow rate of ink at a desired moderately low level.

The valve body 12 may be formed of any plastics, but preferably of a metal such as used in the ordinary ball-point pens. Its diameter may be 0.3–20 mm, more preferably 0.6–2 mm. The valve body need not necessarily be of a spherical shape, but may be of any other structure or shape such as a conical shape.

The spring 13 is disposed in rear of the valve body 12. This spring may be manufactured using a nylon fishing gut, a wire leader or the like thin elongate material. In the illustrated example, a compression coiled spring is employed. The spring 13 has its rear end bearing against a stepped shoulder formed in the proximal portion 4*a* of the distal stopper 4, with its frontal end engaging with the valve body 12. Thus, the spring 13 always urges the valve body 12 onto the rim defining the valve opening 14 in the housing 11. The distal portion of the valve body 12 protrudes through and forwards from the opening 14.

The tip 5 is composed of any known material such as a resin or a fiber so that it can exude ink due to capillary action. Any proper material may be used alone to form the tip, although any composite rod consisting of a plastics piece and a fiber bundle connector bonded thereto are employable, too. Instead of them, the so-called 'writing brush' type tip may be used.

The distal end of the tip 5 protrudes forwards beyond the distal end of the external cylinder 2, for convenience in writing characters or drawing strokes. The proximal end of the tip is in contact with the valve body 12 of the ink feed valve 6. The tip 5 consists of a distal small diameter portion 5*a* and a proximal large one 5*b* integral therewith. Diameter of this large diameter portion 5*b* is made somewhat smaller than that of the inner periphery of external cylinder 2, so as to define between them a small clearance. Thus, a narrow space formed around that tip's proximal larger portion communicates with the forward face of sealant 20, through the holes 10 of the distal stopper 4.

In the external cylinder 2 and in rear of the tip holding portion 2*b* thereof, a mass of urethane foam 16 is secured. A superfluous amount of ink will be absorbed by this mass of urethane foam, and later this foam will occasionally supplement the ink in the tip from time to time. The urethane foam 16 has its inner end bearing against the shoulder formed between the small diameter and large diameter portions 5*a* and 5*b*, whereby this urethane foam 16 constitutes the second biasing means as described above. This arrangement, that the tip 5 is urged inwards by this foam 16 but with a force weaker than the spring 13 (the first biasing means) urging the tip outwards, is useful to avoid rickety motion of the tip and unintentional opening of the valve 6.

The ink reservoir 3 is filled, initially, with an aqueous ink or any other desired application liquid. Also incorporated in the reservoir is a follower 8 that is composed of, in the illustrated example, a rubber or plastics float 8*a* and a viscous agent 8*b* (back-flow inhibiting agent) enclosing same. This follower 8 is located at a boundary between the ink column and a vacant space present behind same so as to seal the rear end of ink column. Such a follower will advance forward, following forward shrinkage of the column caused by consumption of the ink. The ink is thus prevented from flowing back, and ink discharge through the valve opening will be maintained at a controlled flow rate, both due to viscosity resistance which the agent 8*b* exerts.

The viscous agent 8*b* forming the follower 8 is such a viscous fluid that the ratio of its viscosity at 5° C. to that at 35° C. is 2 or less. Viscous liquids show in general their viscosity that will decrease more or less as temperature rises. The ratio of '2 or less' is selected herein, in view of the fact that the writing tool 1 of the present embodiment will usually be used within a range of temperatures of from about 5° C. (viz., room temperature in winter) to 35° C. (viz., room temperature in summer). Examples of such a viscous agent are silicone oils of the dimethyl-polysiloxane type (such as 'KF6' made by the Shin-etsu Silicone Co., Ltd.) In this embodiment, a silicone oil containing hydrophilic silica added thereto and showing viscosity varying from 45,978 mPa·s at 5° C. to 32,256 mPa·s at 35° C. is employed as the viscous agent 8*b*. Further details of this agent will be given below A proximal stopper 7 is attached to the proximal end of external cylinder 2. This stopper comprises a lid 7*a* and a short cylindrical portion 7*b* forwardly continuing therefrom. The cylindrical portion 7*b* of an outer diameter matching the inner diameter of the external cylinder 2 is fitted therein. Any inlet for introducing ambient air may be formed in the proximal stopper 7.

In operation, the applicator 1 provided in this embodiment will have its valve 6 maintained closed so long as it is left non-used. This is because the spring 13 continues to urge the valve body 12 towards the rim around the forward opening 14 of the housing 11. Any positive feed of ink is not effected in this state from the ink reservoir 3 to the tip 5.

When writing is done, the writing pressure will be imparted to the tip 5 to press it backwards, to thereby force inwards the valve body 12. The opening 14 in the valve housing 11 will open instantaneously in this manner. In the preset embodiment, stroke of the valve body 12 is about 0.01 mm to 05 mm, and a force necessary for this extent of retraction is about 100 gf to 200 gf. The users of this applicator will therefore scarcely feel such a motion of the tip. The writing pressure opens the valve 6 automatically and sufficiently, so that the writing operation need no longer be interrupted by the users for the purpose of strongly pressing the tip to forcibly exude ink through it.

The applicator 1, provided herein and shown in FIG. 7, has such a distal stopper 4 that its forward end of distal portion 4*c* is located behind the foremost end portion of the valve body 12 (protruding from the valve opening 14). The distal portion' forward end 4*c* is however located at the same time ahead the rearmost forward end of the valve hosing (cylinder) 11. Thus, with the valve body 12 being pushed back with the tip 5 for the writing purpose, said distal end of the stopper 4 will be brought into contact with the rear face of the tip 5. Consequently, the tip is inhibited to move backwards any more, and no pressure stronger than the urging force of the spring 13 will be applied to the central region of the tip's rear face. In other words, writing pressure is always born by the distal stopper 4, thereby protecting the tip 5 from being injured. In the event that the central zone of the tip rear face would be collapsed or otherwise damaged, it will no longer be able to forcibly retract the valve body 12 failing to continue ink feed. Therefore, the delimited displacement of the tip 5 is effective to enhance convenience in use and durability of the writing tool.

The back-flow inhibiting agent 8*b* in the follower 8 in this applicator 1 shows viscosity that is considerably less susceptive to change in temperature, as compared with those in the prior art. Usual change in atmospheric temperature from season to season will not affect adversely the function of follower 8 serving for stable ink feed. The applicator will no longer suffer from difficult ink feed in winter, nor from superfluous ink feed in summer. It will now work smoothly and in a stable manner all the year around.

This embodiment is not delimited to the described examples but may be modified in various manners. The ink reservoir may be formed integral with the distal stopper, and the valve may be directly attached to the distal end of the ink reservoir. Further, the reservoir and the external main body of the applicator are not necessarily be of a round cylindrical shape.

Details as to compositions forming the back-flow inhibiting agent (viscous agent) 8*b* are as follows.

This agent in the applicator may either be composed of a silicone alone, or of a gel prepared by adding a gelling agent to silicone to raise its viscosity.

Also employable as the back-flow inhibiting agent is a composition comprising a silicone oil, a gelling agent and a carboxylated silicone, so that the latter will act in a boundary layer between this composition and the ink reservoir inner periphery. In this case, the modified silicone will suppress adhesion of the agent to the inner periphery surface, thereby improving the agent's movability to enable it more smoothly follow ink column.

In place of or in addition to carboxylated silicone, a proper polyether-modified silicone may be used to afford similar effect.

Silicone Oils

Silicone oils for use herein include: methylsilicone oil, dimethylsilicone oil and derivatives thereof such as methylphenyl silicone oil, alkylated silicone oil and the like. It will be possible to use any one of these compounds alone or any combination thereof.

Examples of available silicone oils are: products whose trade names are 'KF-96', 'KF-50', 'KF-412' and 'KF-410', all made by the Shin-etsu Silicone Co., Ltd.

Content of silicone oil in the back-flow inhibiting agent is from 50.0%–99.8%, preferably 65.0%–98.5% thereof in weight.

The silicone oils exemplified above are of a sufficient transparency, good lubricating property, high resistance to heat and oxidation, and other advantageous properties. Further, they favorably show poor compatibility with usual aqueous inks and oily inks so that they are useful as a principal component of the back-flow inhibiting agent.

Gelling Agent

The gelling for use to increase viscosity of silicone oil may be selected from those which have been conventionally used in preparation of back-flow inhibiting agent.

Examples of such gelling agents employable herein include: fine silica, magnesium stearate, calcium stearate, aluminum stearate, zinc stearate, and the like metallic soaps, tribenzylidene sorbitol, hydrated castor oil, amino acid derivatives and the like. Among these, fine silica and particularly hydrophilic silica are most preferable.

Hydrophilic silica used as the gelling agent for silicone oil will give it a sufficient viscosity that is neither susceptive to higher shearing stress applied to a gel, nor to change in temperature. Thus, it will afford an excellent effect of inhibiting back-flow not only in finished applicators but also during manufacture of them.

Available products of hydrophilic silica are: 'Aerosil 200', 'Aerosil 130' and the like, all made by the Nippon Aerosil Co., Ltd.

Content of the gelling agent in the back-flow inhibiting agent is from 0.1%–10.0%, preferably 0.5%–5.0% thereof in weight. Richer content above the upper limit will impair the 'ink-following' property of the back-flow inhibitor, whilst poorer content below the lower limit will give an unsatisfactory gelling effect.

Carboxylated Silicone

Carboxylated silicones will, as mentioned above, act in a boundary layer between the back-flow inhibiting agent and the ink reservoir inner periphery. The modified silicones will suppress adhesion of the agent to the inner periphery surface of ink reservoir, thereby improving the agent's movability to enable it more smoothly follow ink column. Any ink residue sticking to the reservoir inner surface will be automatically removed, thanks to the agent's 'cleaning' property which modified silicones of this type do afford.

Additionally, carboxylated silicones will diminish the problem of occasional mixing of ink with the inhibitor during manufacture, caused by undesirably increased compatibility of the ink with the inhibitor and resulting in aesthetic value of the pens.

Available products of carboxylated silicones are: 'TSF4770' from the Toshiba Silicone Co., Ltd., 'X-22-162-A' and 'ibid.-C' from the Shin-etsu Silicone Co., Ltd. and the like.

Molar content of carboxyl group in carboxylated silicones is not so strictly delimited herein, but may be designed to be 5000 g/mol or less, or preferably selected from a range of 500–3000 g/mol. However, excessive molar content will undesirably render too viscous the back-flow inhibiting agent. There is no severe or lower limit for molar content of carboxyl group, because even a little content thereof will somewhat noticeable effect, even if not quite satisfactory. Thus, considerably low molar content may be decided and employed from the viewpoint of convenience in manufacture or merit in selling.

Content in weight of carboxylated silicone in the back-flow inhibiting agent is from 0.1%–40.0%, preferably 1.0%–30%. Richer content above the upper limit will impair the 'shock resistance' of the back-flow inhibitor, whilst poorer content below the lower limit will not possibly be sufficient to prevent the agent from sticking to the reservoir inner wall.

Polyether-Modified Silicone

Polyether-modified silicones will, as mentioned above, act in a boundary layer between the back-flow inhibiting agent and the ink reservoir inner periphery. The modified silicones will suppress adhesion of the agent to the inner periphery surface of ink reservoir, thereby improving the agent's movability to enable it more smoothly follow ink column. Any ink residue sticking to the reservoir inner surface will be automatically removed, thanks to 'cleaning' property afforded by modified silicones. Additionally, polyether-modified silicones will diminish the problem of occasional mixing of ink with the inhibitor during manufacture, caused by undesirably increased compatibility of the ink with the inhibitor and resulting in aesthetic value of the pens.

Available products of polyether-modified silicones are: 'Granol 100', 'ibid. 115', 'ibid. B-1484', 'ibid. 200', 'ibid. 400', 'ibid. 410', 'ibid. 420', 'ibid. 440', and 'ibid. 450', all made by the Kyoeisha Chemicals Co., Ltd.

Number-average molecular weight of polyether-modified silicones herein employed is not so strictly delimited herein, but may be designed to be 100 to 100000, or preferably selected from a range of 100–30000. However, excessive molecular weight above the upper limit will make it difficult for the modified silicone molecules to move towards the boundary, thereby impairing the 'cleaning property' of the back-flow inhibiting agent.

Content in weight of polyether-modified silicone in the back-flow inhibiting agent is from 0.1%–40.0%, preferably 1.0%–30.0%. Richer content above the upper limit will impair the 'shock resistance' of the back-flow inhibitor, whilst poorer content below the lower limit will not possibly be sufficient to prevent the agent from sticking to the reservoir inner wall.

Any proper compositions other than the examples given above may be used in this invention as the back-flow inhibiting agent (viz., viscous material constituting the follower).

Third Embodiment

Figure 12:
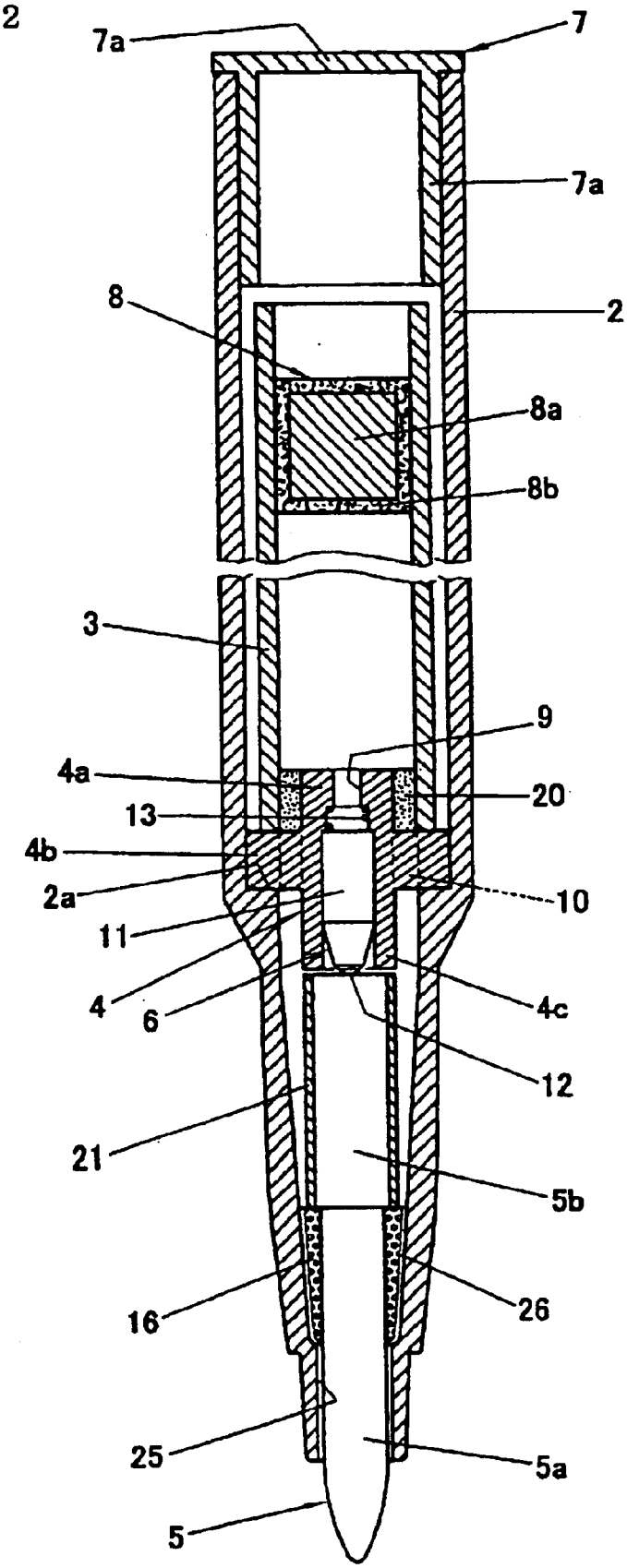
FIG. 12 is a vertical cross section of an applicator provided in still another embodiment of the present invention.

FIG. 12 shows a third embodiment of the applicator, wherein some of its structural features are the same as or similar to those in the preceding embodiments. They are not described here again, but merely denoted with the same reference numerals. Only other features different from those in the preceding ones in structure and/or function will be discussed below.

The large diameter portion 5*b* of the tip 5 in this case is covered with a sleeve 21 that is made from a relatively hard material. This material may be a hard synthetic resin such as polypropylene, polyacetal resin or the like, or a metal such as aluminum, stainless steel or the like. Such a coating will prevent the tip 5 from evaporating an aqueous ink with which it is impregnated, so that the tip is protected from drying up. Rear end face of this tip is exposed in the interior of the external cylinder 2, but vapor of ink solvent having permeated the sealant 20 and then present in said interior will suppress evaporation from the exposed end face.

Any proper method may be employed to provide hat tip with the sleeve 21. For example, a separate tubular member may previously be produced and then fitted on the tip later. Low-melting resin such as a polyester or acrylic fiber maybe fusion bonded to the tip to form the sleeve 21. Direct extrusion of a resin around and onto the tip as a core, that is the tip, may also be possible. Any proper adhesive may be used to firmly bod the sleeve 21 to the tip 5.

Figure 13:
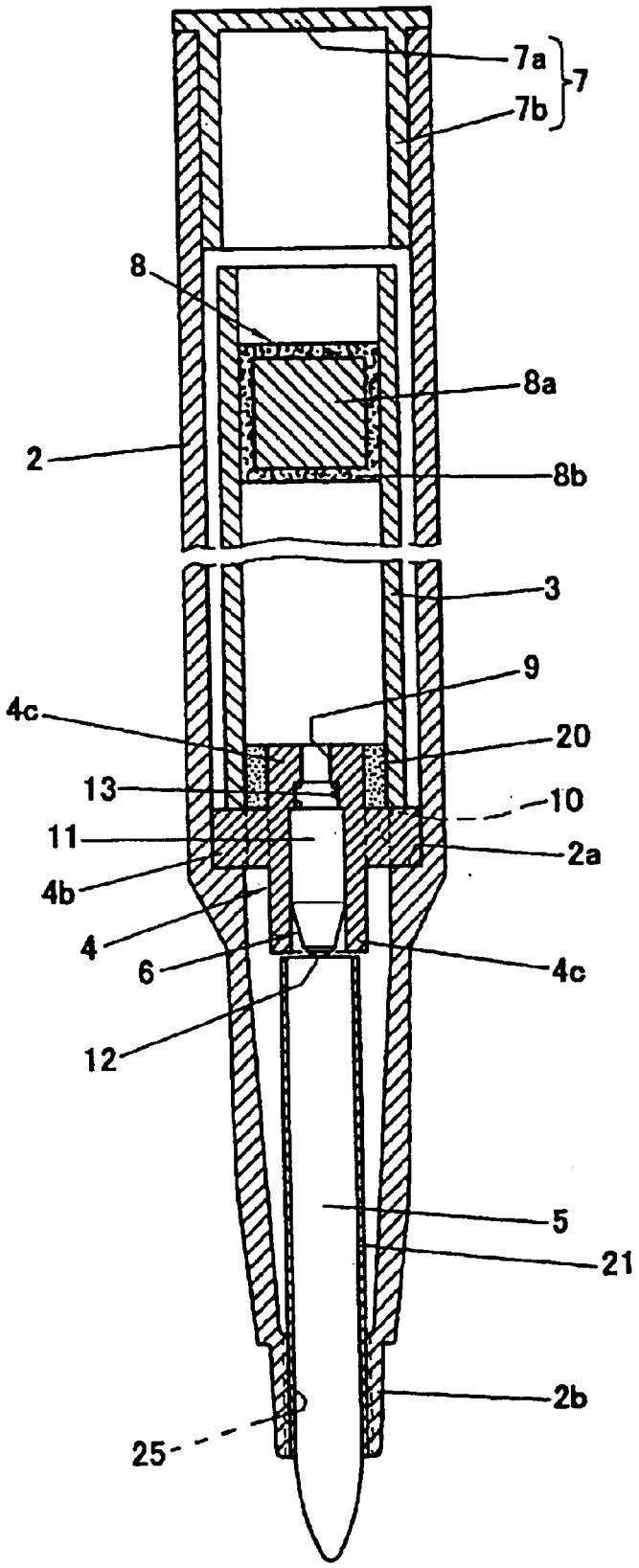
FIG. 13 is a vertical cross section of an applicator provided in yet still another embodiment of the present invention.

In a modification shown in FIG. 13, the sleeve 21 extends over substantially full length of the tip 5.

Fourth Embodiment

Figure 14:
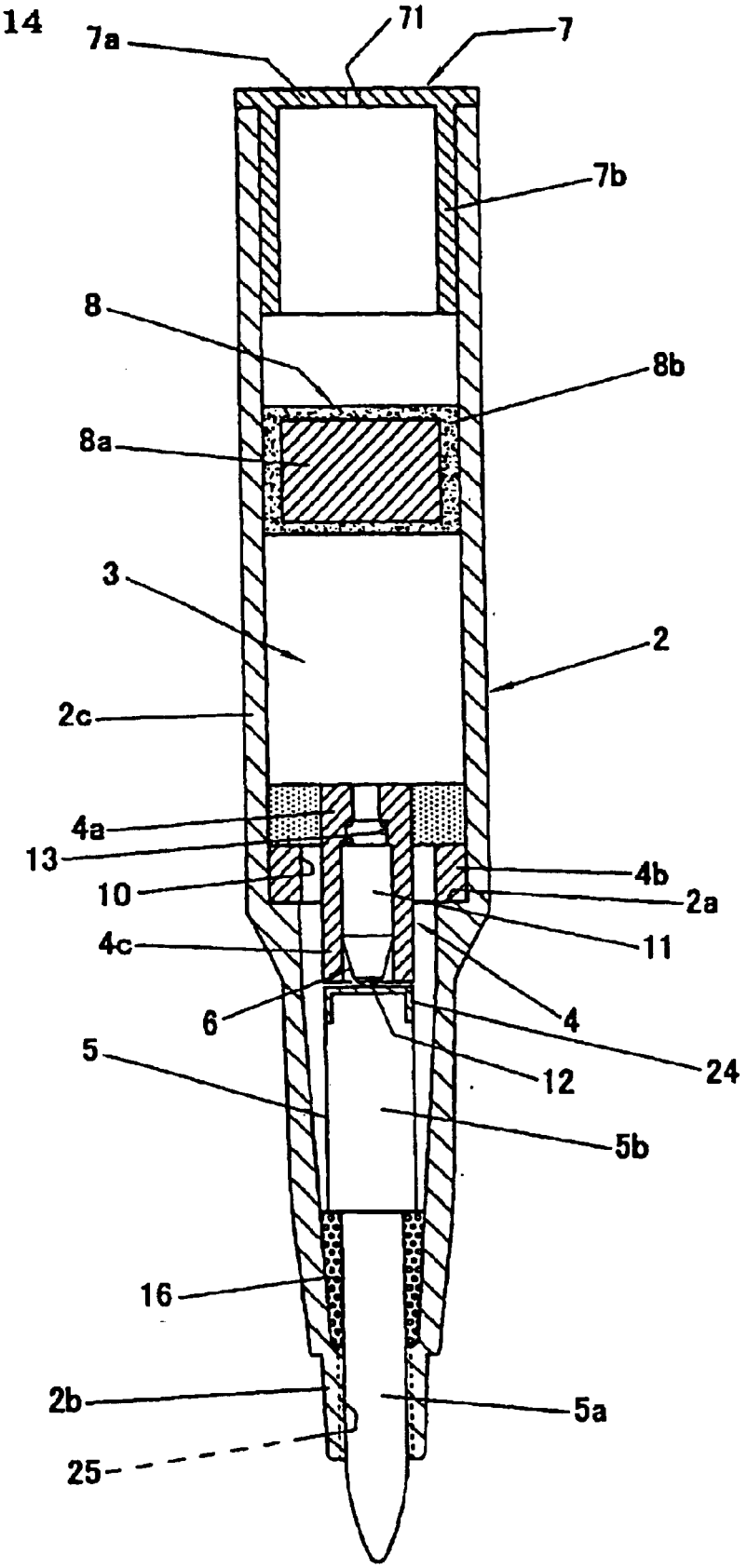
FIG. 14 is a vertical cross section of an applicator provided in a further embodiment of the present invention.

FIG. 14 shows a fourth embodiment of the applicator 1. Description of the same or similar components are abbreviated, by allotting to them the same reference numerals, with newly recited members only being described as to their structure and function.

A portion of the external cylinder 2 directly constitutes here the ink reservoir 3. The cylinder has a proximal large diameter region 2*c*, from which a distal region continues forwards while decreasing diameter towards a frontal end. The distal stopper 4 is fitted in the large diameter region 2*c*, with the sealant 20 intervening between this stopper and the inner periphery of this region 2*c*. The interior behind the stopper 4 is filled with an amount of an ink, with rear face of the mass of this ink is sealed with a closing member 8. The distal stopper 7 has an air inlet 71 formed in and through it, in order that the closing member 8 can move forwards within the reservoir (cylinder region 2*c*) following the mass of ink whose volume is decreasing due to consumption. A metal or hard resin cap 24 is fitted on the tip's 5 rear face so as to protect it from being damaged due to repeated collision thereof with the valve 12. An ink flowing aperture(s) may be formed in and through the cap 24, or alternatively the cap may have a structure like a wire net.

Fifth Embodiment

Figure 15:
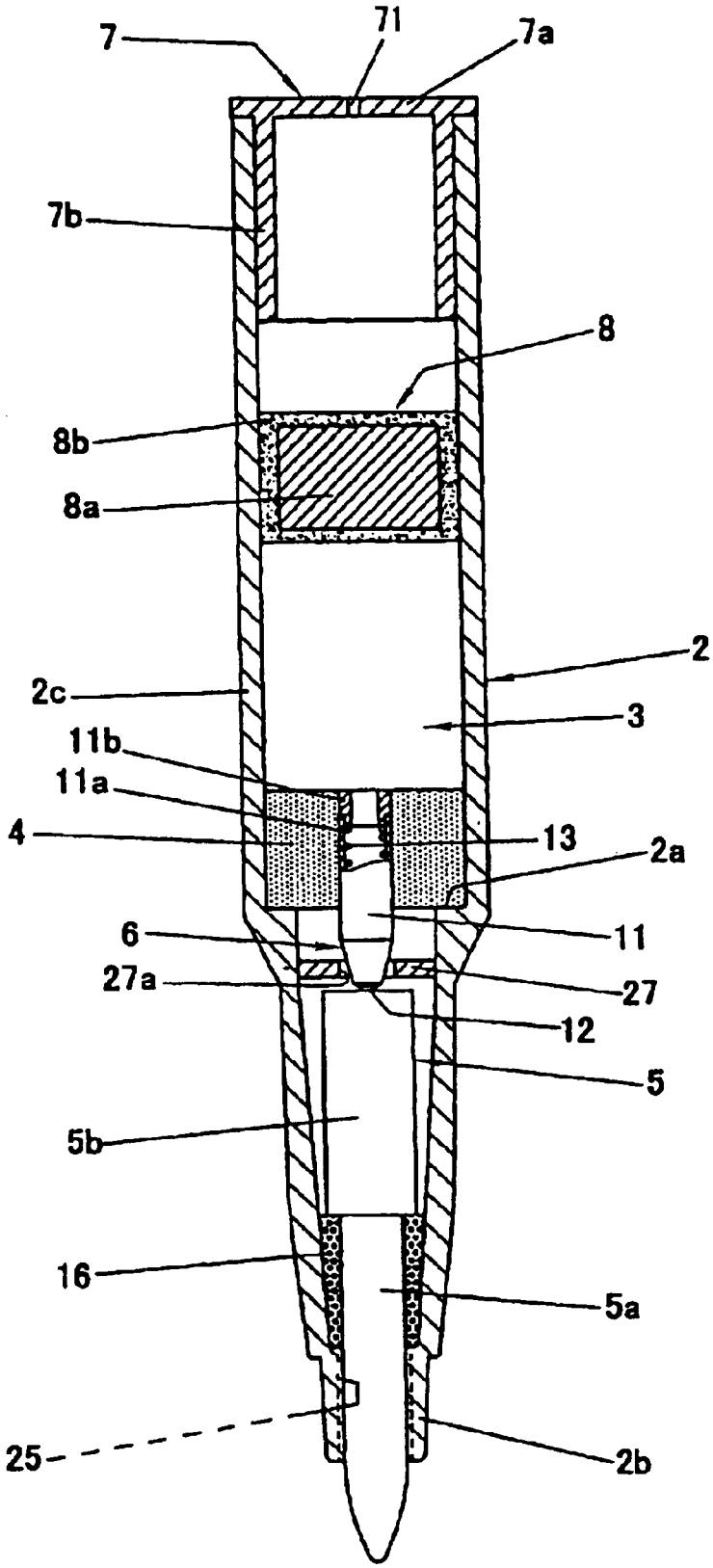
FIG. 15 is a vertical cross section of an applicator provided in a still further embodiment of the present invention.

FIG. 15 shows a seventeenth embodiment of the applicator. Description of components that are the same as or similar to those shown in FIG. 14 is abbreviated, by allotting to them the same reference numerals. Only the newly recited members will be described below on their structure and function.

The distal stopper 4 in this case is a ring of a rubber or other elastic material. Silicone rubbers are useful, though any other material showing a desired level of gas permeability may be used. The valve housing 11 is fitted in such a ring as the distal stopper 4, which in turn is fitted in the rear portion 2*c* of external cylinder 2 so as to stop the ink.

The forward end portion of this cylinder extends beyond the stopper 4, and a circular obstructer 27 of a disc shape is disposed ahead this stopper. This obstructer secured in the cylinder 2 has a distal face disposed behind the distal end of housing 11 a small distance. The distal face of obstructer 27 is able to contact the rear face of the tip 5 being pushed back. A central bore 27*a* of obstructer surrounds the distal end of housing 11 to thereby provide a clearance between them, so that solvent vapor having permeated the stopper 4 can reach the space around the tip distal portion 5*b*.

An extraordinarily strong writing pressure when using this applicator for doing writing will cause elastic deformation of distal stopper 4, displacing the housing 11 in its entirety. Thus, the strong pressure will be absorbed, cushioning pressure of valve body 12 onto the rear face of tip 5. Tendency of tip 5 to continue to move back will result in collision of its rear peripheral zone with the frontal face of obstructer 27, whereby such a backward movement is prevented to protect central area of the tip's rear face from damage.

The ink reservoir may be formed integral with the distal stopper, and the external cylinder may be utilized to serve also as the ink reservoir. A protector may be fitted on the rear end of the tip, for protection thereof from being depressed to produce a dimple by the valve body's forward end. A preferable example of the gas permeating material is the 'vapor-permeating water-repellent membrane (or fabric) made by the Gore-Tex Corp. This membrane is composed of a textile fiber that allows easy permeation of gas but not transmission of any liquid through it.

Sixth Embodiment

Figure 16:
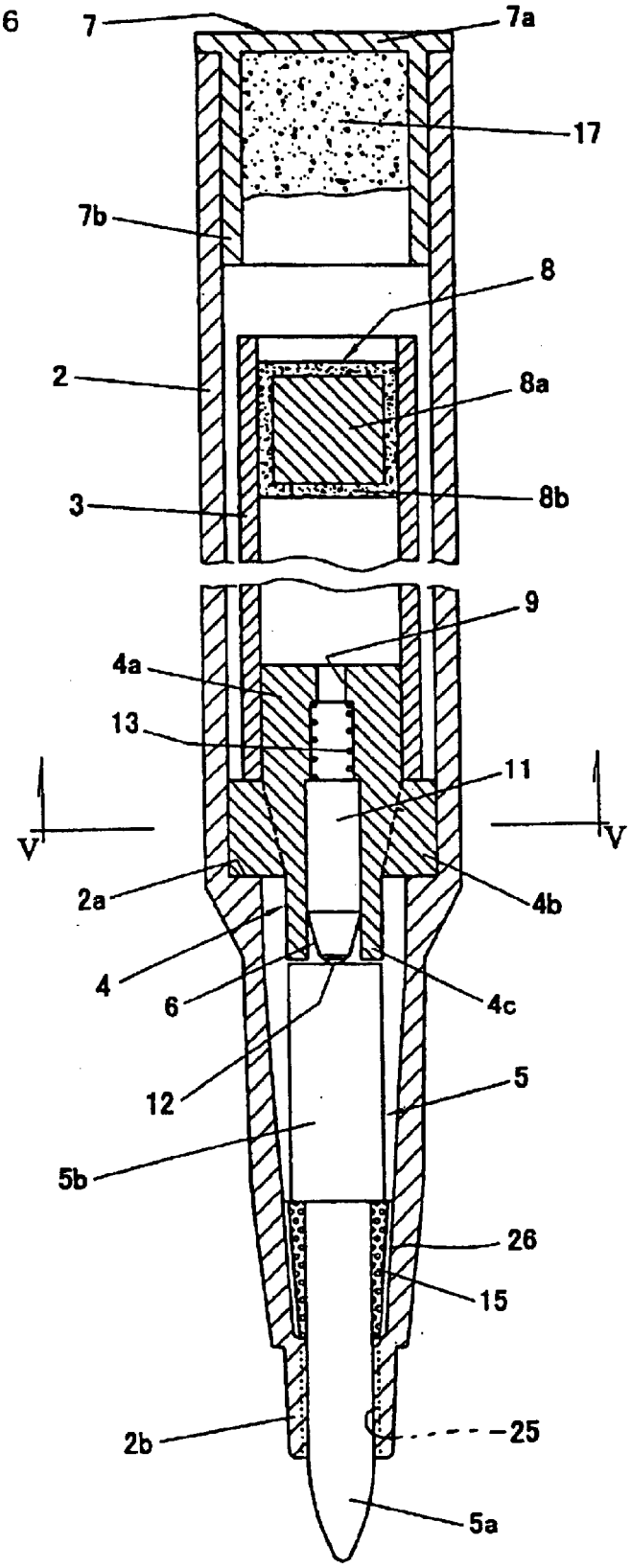
FIG. 16 is a vertical cross section of an applicator provided in a yet still further embodiment of the present invention.

FIG. 16 shows a sixth embodiment of the applicator 1. Description of the same or similar components is abbreviated, by allotting to them the same reference numerals, with newly recited members being described below.

The proximal stopper 7 in this case is composed of a lid 7*a* continuing forwards to a short cylindrical portion 7*b*, which is of such a diameter as tightly fitting in the external cylinder 2. An anti-drying agent 17 packed in the portion 7*b* is a piece of sponge or the like porous material, or a block of piece of such a highly water-absorptive polymer. The agent 17 is impregnated with water that is a solvent of the ink stored in the reservoir.

Figure 17:
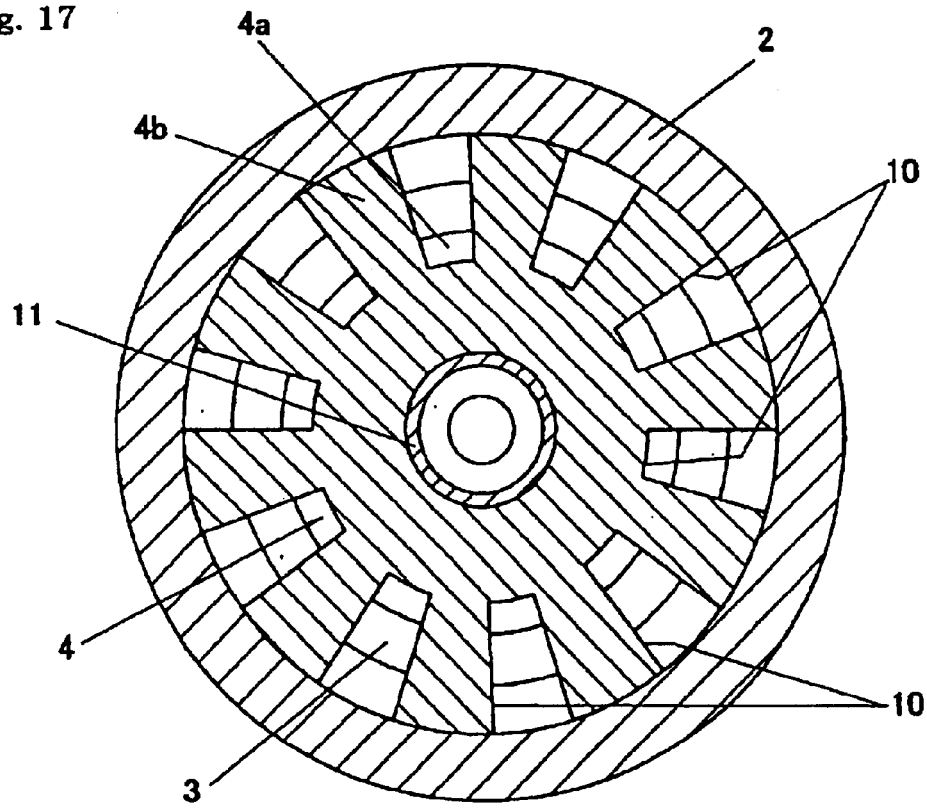
FIG. 17 is a cross section taken along the line V—V in FIG. 16.

The distal stopper 4 is made of a material that is the same as or similar to that which forms the ink reservoir 3. This stopper is located intermediate between the proximal and distal ends of the external cylinder 2, and ink feed bore 9 is formed axially of this cylinder. Proximal portion 4*a* of distal stopper 4 is cylindrical and fitted in the distal portion of reservoir 3. A radially protruding large diameter portion 4*b* is disposed integral with the stopper's 4 middle region, and fitted in external cylinder 2. The stepped shoulder 2*a* formed in the inner periphery of this cylinder supports the large diameter portion 4*b* at its distal end. As shown in FIG. 17, slits (holes) 10 are formed through this portion 4*b* in axial direction, and spaced from one another in circular direction. Distal end 4*c* is of a diameter a little smaller than the proximal end 4*a*, and protrudes forwards beyond the middle large diameter portion 4*b*.

Water contained in the anti-drying agent 17 will evaporate at ambient temperatures so as to diffuse into a space between the external cylinder 2 and ink reservoir 3. This space communicates, through the slits 10, with another space between said cylinder 2 and the tip's rear portion 5*b*. A certain level of vapor pressure will thus be maintained in the latter space, so that evaporation of water from the tip 5 is suppressed to preotect it from drying.

Seventh Embodiment

Figure 18:
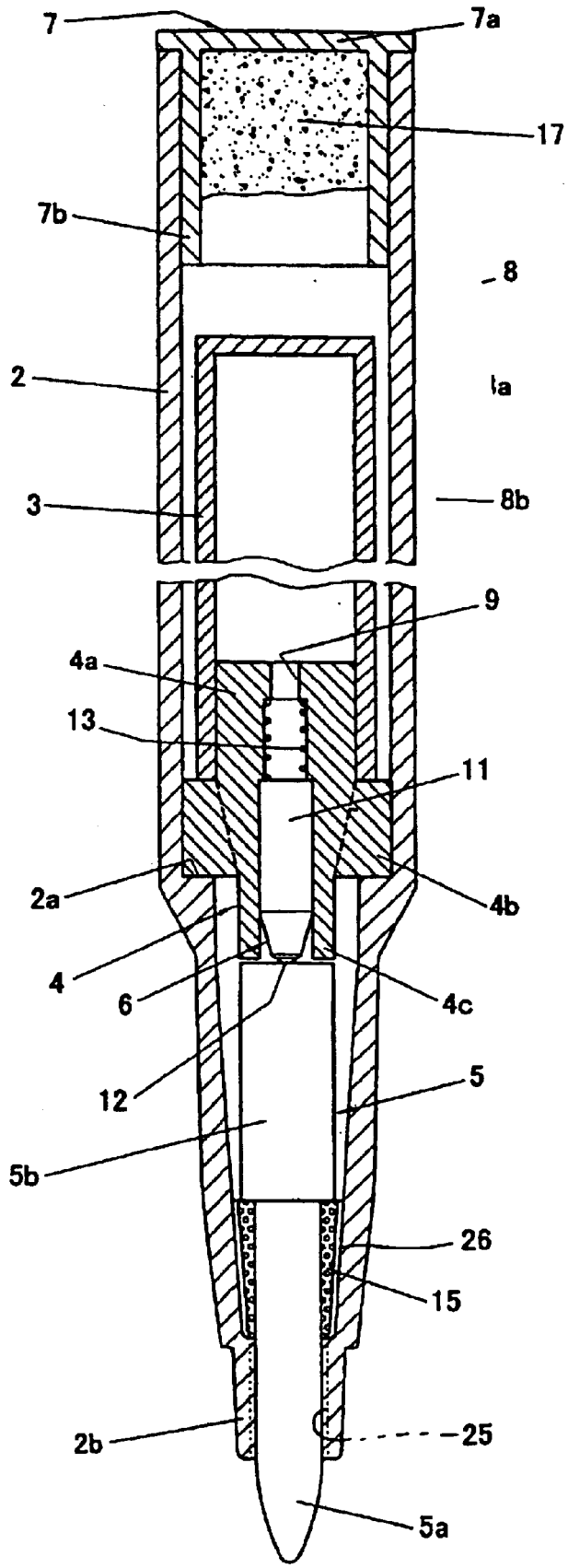
FIG. 18 is a vertical cross section of an applicator provided in a different embodiment of the present invention.

FIG. 18 shows a seventh embodiment of the applicator 1. Description of the same or similar components as in FIG. 16 is abbreviated. Different from the embodiment in FIG. 16 is a feature that the seventh applicator is devoid of the closing member 8 and is thus of the 'air-replacement' type. Its ink will gradually be replaced by air as writing proceeds.

In the foregoing embodiments, the springs 13 may have a 'spring constant (modulus)' such that the valve body 12 is urged towards the opening 14 with an urging force of 40–60 gf (preferably about 50 gf), and this urging force increases up to 120–180 gf (preferably about 150 gf) when the valve body 12 is retracted a distance of 0.2 mm along with the tip 5. In a case wherein such an initial urging force is 40 gf and the increased force is 180 gf caused by the valve body's retraction by 0.2 mm, the 'spring modulus' is calculated to be 0.7 kgf/mm. If the initial urging force is 60 gf and the increased force is 120 gf, then 'spring modulus' is calculated to be 0.3 kgf/mm. Thus, the springs 13 in the above embodiments have the 'spring modulus' of from 0.3–0.7 kgf/mm. In the 'writing brush' type tips, the writing pressure is remarkably low but accompanied by a relatively much consumption of ink. Accordingly, a much lower 'spring modulus' (around 0.1 kgf/mm) will suffice for the springs in this type tips.

As discussed above, the valve body moves a distance of 1 mm or less, and the force needed to open the valve is from 40 gf to 60 gf. Therefore, users will scarcely feel notion of the tip. It has been known the writing pressure is about 80 gf or more that is higher than that (40 gf to 60 gf) necessitated for opening the valve. It will thus be kept open during the writing operation, without interruption thereof to strongly press the tip inwards. As shown in FIG. 1, 'forward extremity' of distal end 4*c* of distal stopper 4 is located behind that of the valve body 12 protruding from the valve opening 14, but ahead that of the cylindrical valve housing 11. On the other hand, the distance between 'proximal end' of the non-working tip 5 and the 'forward extremity' of the distal stopper 4 is from about 0.2–1 mm. Due to these structure and feature, a strong writing pressure driving backwards the tip 5 will cause its peripheral zone in rear face to abut against the 'forward extremity' of distal stopper 4, inhibiting said tip from further backward movement. Central area in the tip's rear face 5 will receive no longer any excessive force stronger than the urging force of spring 13, because such a force is born by the distal stopper 4, thus protecting said rear face from being damaged by valve body. In view of the fact that any remarkably damaged rear face of tip will not be able to effectively push back the valve body 12, resulting in failure to feed the ink, the described restriction of tip's backward movement is beneficial in affording excellent performance to and enhancing durability of the applicator.

With the writing pressure occasionally increased to about 120 gf or up to 180 gf, the tip 5 will be retracted 0.2 mm and the spring's urging force (180 gf as noted above) will be brought into an equilibrium with that writing pressure. This means that the urging force does bear and withstand the writing pressure, avoiding collision of the tip's 5 rear end with the stopper's 4 forward end. In this way, the users of this applicator or pen will sense no shock of bumping or clunking of its parts, but can do their writing operation smoothly and pleasantly.

Eighth Embodiment

Figure 19:
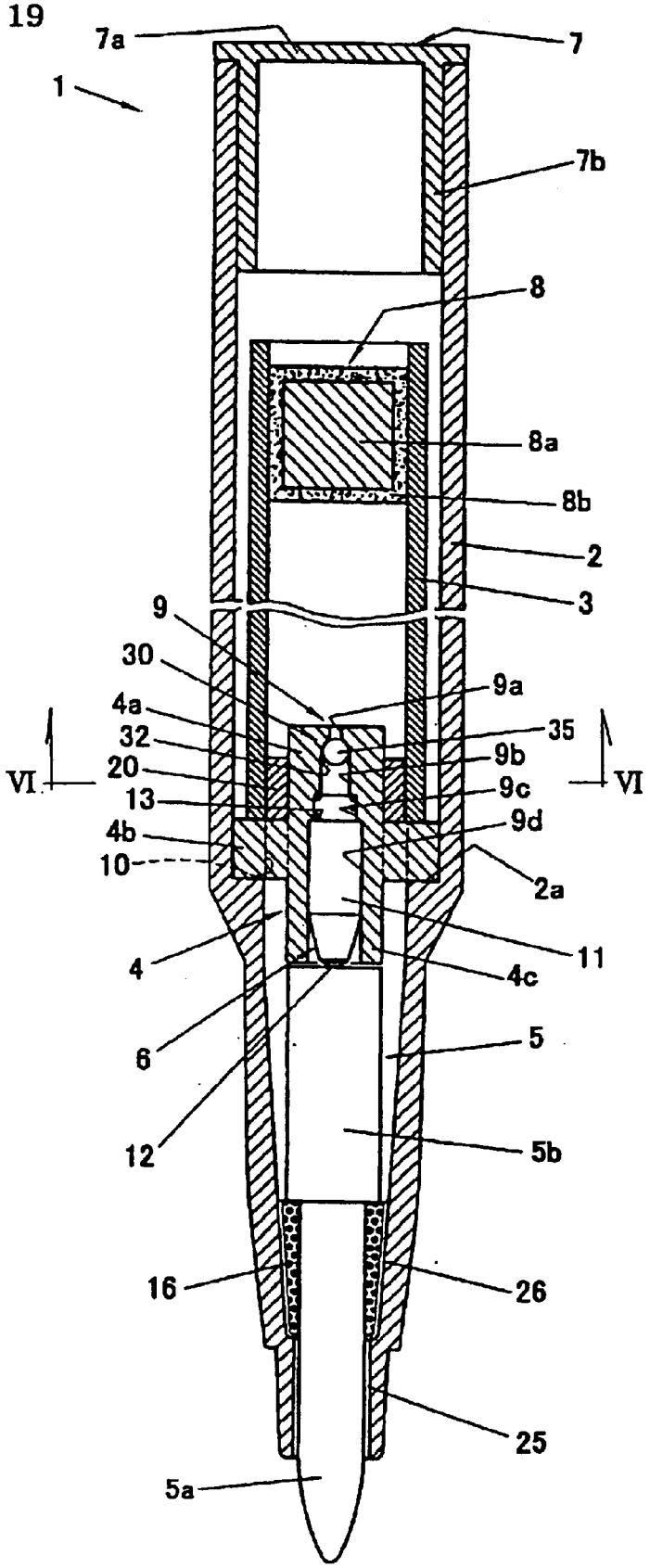
FIG. 19 is a vertical cross section of an applicator provided in a further different embodiment of the present invention.
Figure 20:
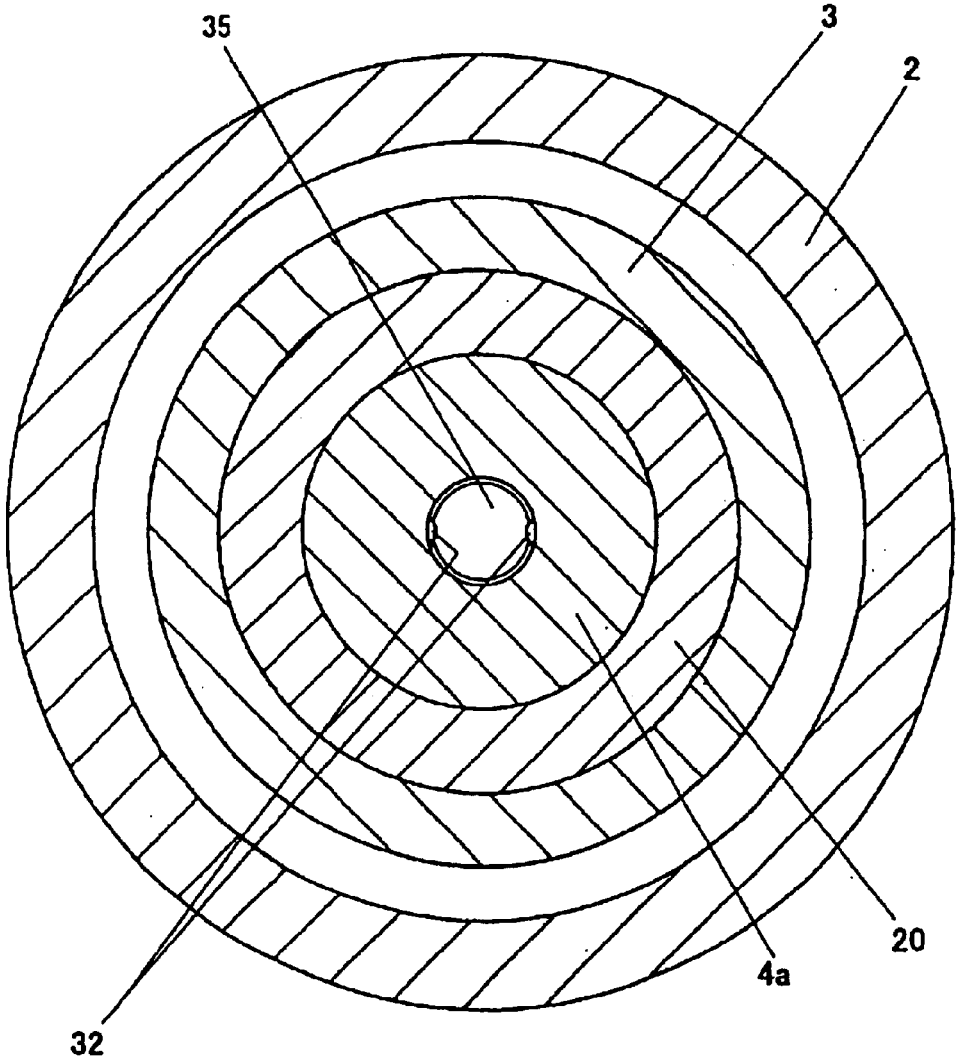
FIG. 20 is a cross section taken along the line VI—VI in FIG. 19.
Figure 21:
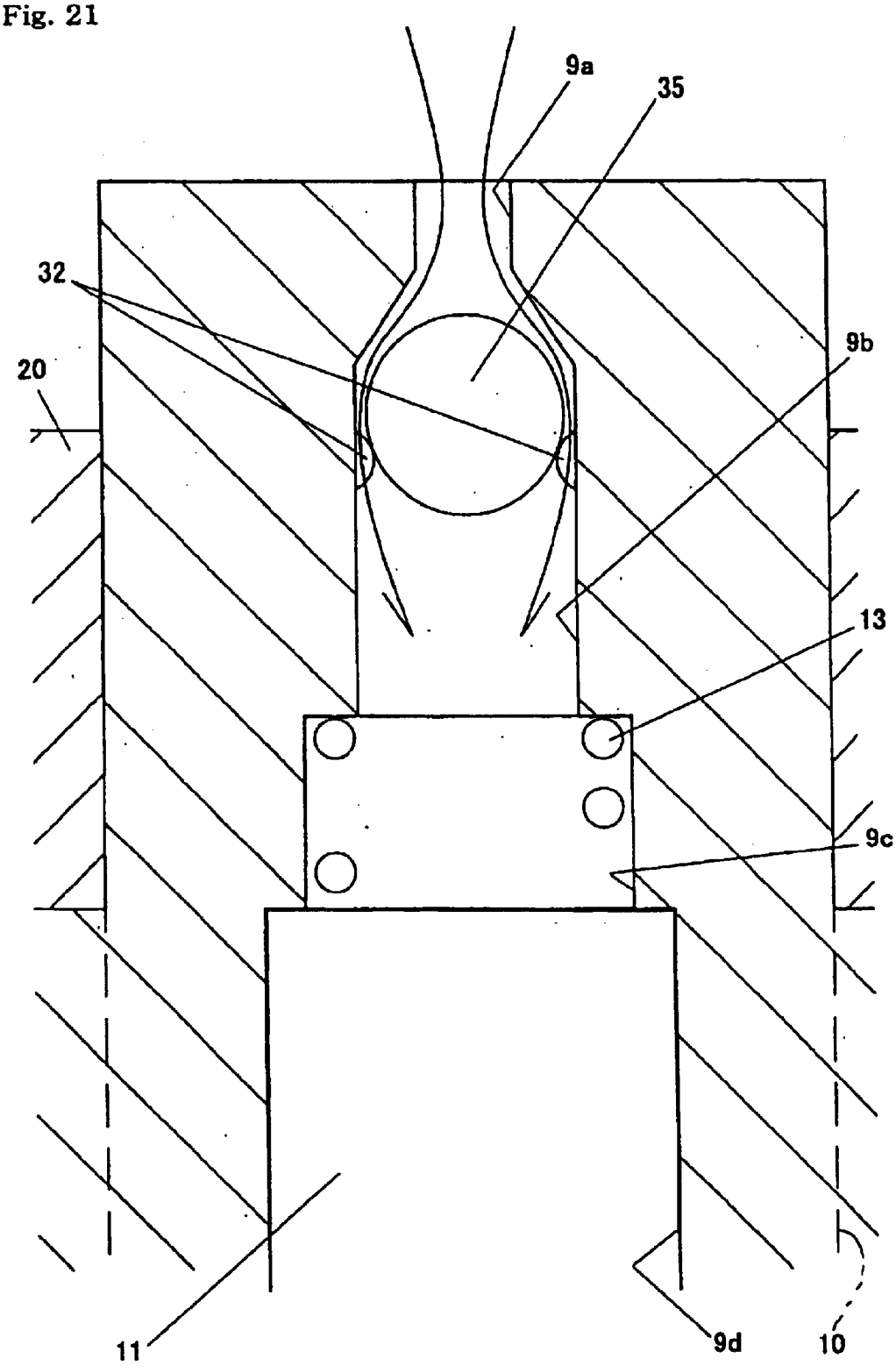
FIG. 21 is an enlarged fragmentary cross section of a check valve incorporated in a device that is intended to supply an application liquid and included in the applicator shown in FIG. 19.

FIGS. 19 to 21 show an eighth embodiment of the applicator 1. Description of the same or similar components is abbreviated, by allotting to them the same reference numerals, with newly recited members being described below in respect of their structure and function.

The ink feed bore 9 through distal stopper 4 of this applicator 1 increases diameter gradually and stepwise from rear end to forward end. In detail, the bore 9 consists of a first, second, third and fourth parts 9*a*, 9*b*, 9*c* and 9*d* that continue one from another in this order towards the forward end.

Further, this applicator 1 has a check valve 30 disposed in proximal region of distal stopper 4. This check valve intervenes between the ink-supplying valve assembly 6 and the ink reservoir 3 so that it will be opened when the pen-point faces downwards but will be closed when the applicator stands upside down to stop ink feed.

The check valve 30 has a housing (chamber) and a spherical valve body 35 placed therein. This housing is the proximal portion 4*a* of distal stopper 4. In detail, the valve body 35 is movably held in the second part 9*b* of ink feed bore 9. The inner periphery of this part 9*b* is of a diameter slightly larger than that of said valve body 35 in order to define between them a fine clearance through which ink can flow.

A valve seat for the body 35 is formed in the inner periphery of the stopper's rearward portion 4*a*, and in this embodiment the stepped shoulder between the first and second parts 9*a* and 9*b*. The first part 9*a* serves as the valve opening of this check valve. As clearly shown in FIG. 21, the stepped shoulder acting as the valve seat between the first and second parts 9*a* and 9*b* is tapered to be of a conical shape. The valve body 35 can surely take its position to shut the first part 9*a* (valve opening), when gravitational force puts the body 35 on the seat. The check valve 30 closed in this way will prevent the back-flow of ink readily and reliably.

Inward lugs 32 protruding from inner periphery of the second part 9*b* of ink feed bore 9 do allow the valve body 35 to make stroke between them and the seat, while inhibiting it from moving forwards over them. As will be seen in FIG. 21, the valve body will rest on the lugs 32 to provide an ink passage around it when the writing operation is done in normal manner with the pen-point tip facing downwards.

In short, normal writing is able with a moderately low rate of the ink that is delivered to the valve chamber 11 through the opened check valve 30, wherein a proper diameter may be designed for valve body 35 to enable optimal control of flow rate. When writing in a reverse direction, the check valve 30 is closed to seal the ink reservoir 3, to prevent both the ink and the closing member 8 from moving back and escaping through the open proximal end of reservoir.

Ninth Embodiment

Figure 22:
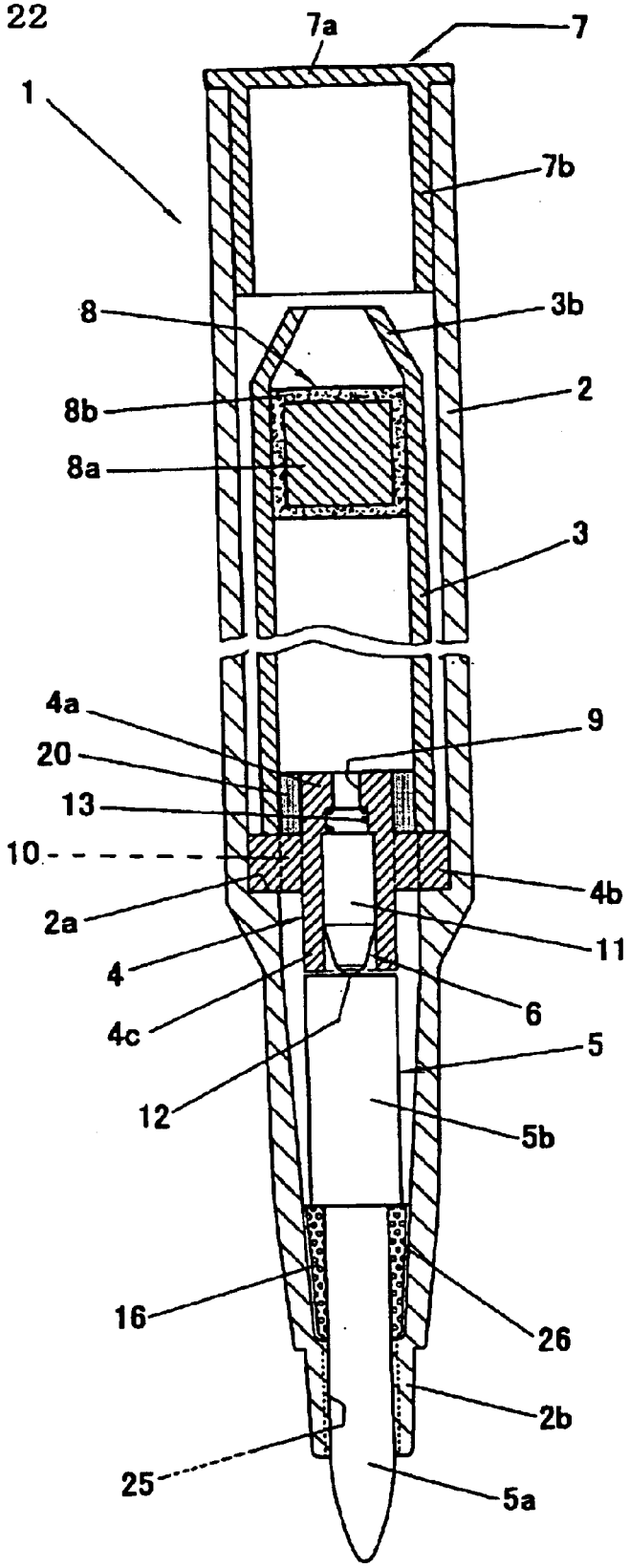
FIG. 22 is a vertical cross section of an applicator provided in a still further different embodiment of the present invention.

FIG. 22 shows a ninth embodiment. The applicator 1 in this embodiment has an ink reservoir 3 whose proximal end is caulked in a centripetal direction. This is for the purpose of preventing the rearward slipping off of the back-flow inhibitor 8. In detail, inner diameter of the reservoir's proximal end 3*b* is rendered smaller than outer of the float 8*a* of back-flow inhibitor. The inhibitor 8 is not able to move back beyond the reservoir's caulked end 3*b*, which is thus functioning as an obstructer in this case. This obstructer, that is the caulked end, however permits communication between the reservoir's rear internal cavity the ambient air, to thereby provide an air inlet for the reservoir 3.

Lest the internal pressure in the reservoir's main portion filled with an ink should decrease due to consumption thereof, the back-flow inhibitor 8 will smoothly slide forwards while normal writing is done. Even if the applicator not in use is reversed upside down, the reservoir's rear end 3*a* (obstructer) will not permit any unlimited backward slide of the inhibitor 8, so as to prevent it from slipping off and avoid leakage of the ink.

Tenth Embodiment

Figure 23:
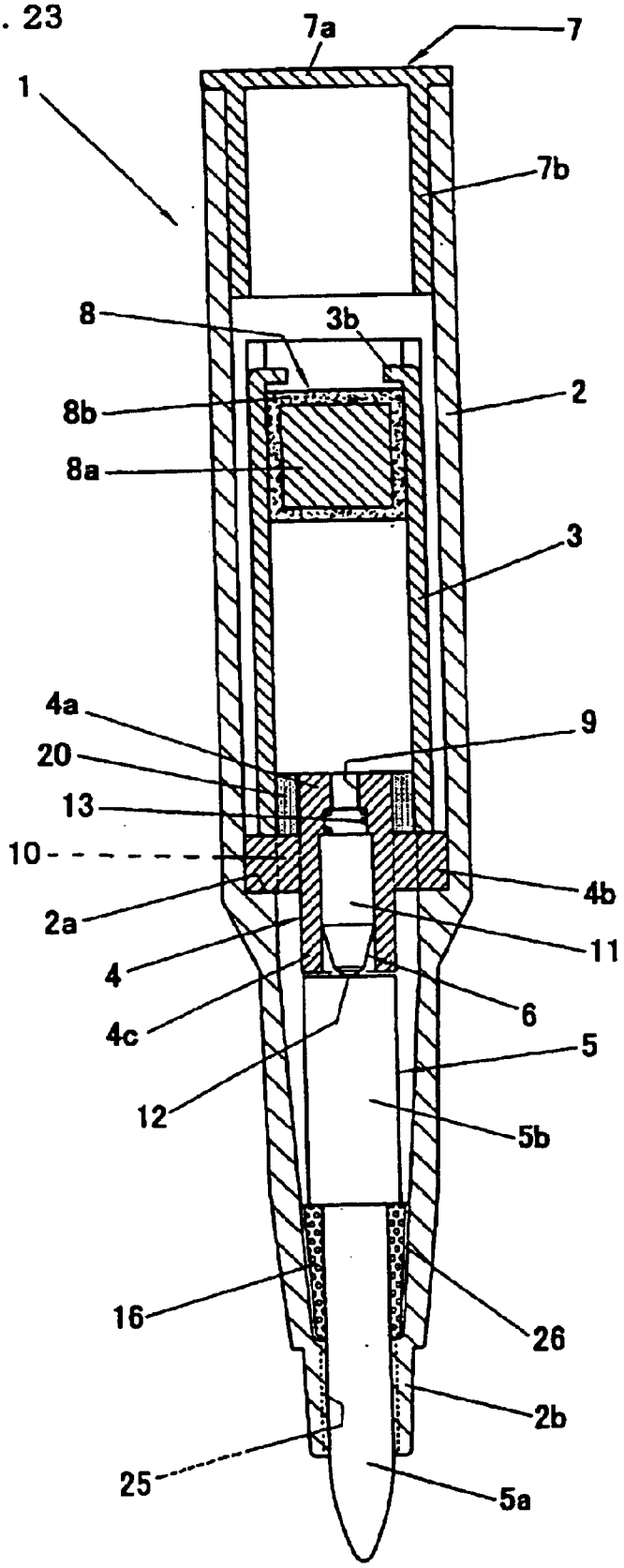
FIG. 23 is a vertical cross section of an applicator provided in a yet still further different embodiment of the present invention.

FIG. 23 shows a tenth embodiment of the applicator 1, which differs from that shown in FIG. 22 merely in that the rear end of reservoir 3 is not caulked but its portions are bent in a centripetal direction behind the inhibitor 8, likewise providing as whole an obstructer therefor.

Eleventh Embodiment

Figure 24:
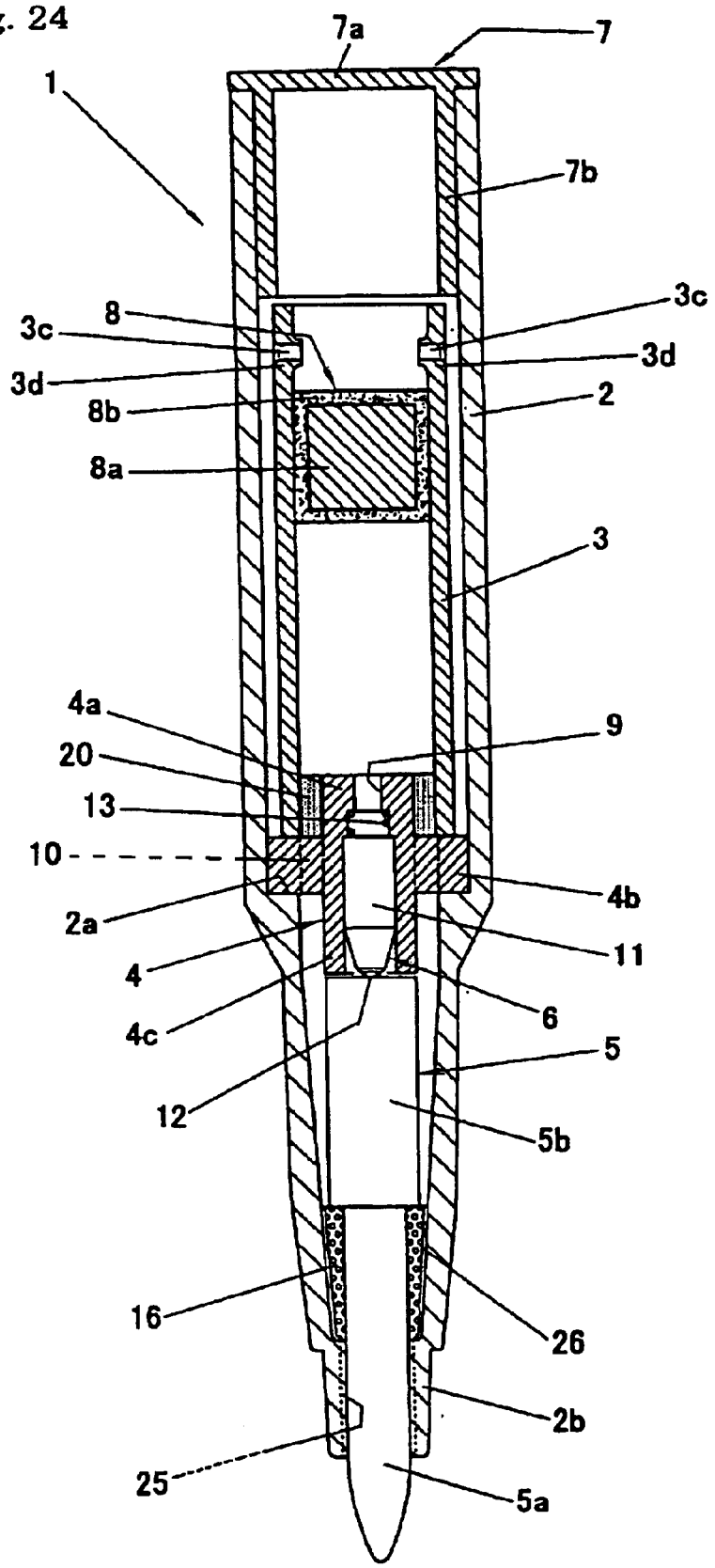
FIG. 24 is a vertical cross section of an applicator provided in one of the other embodiments of the present invention.

FIG. 24 shows an eleventh embodiment of the applicator 1, which differs from that shown in FIG. 22 also only in the shape of the obstructer. In this case, peripheral wall portions are punched inwards to form some holes 3*c*. Curved flashes 3*d* protrude centripetally to serve as a whole as the obstructer for the back-flow inhibitor.

Twelfth Embodiment

Figure 25:
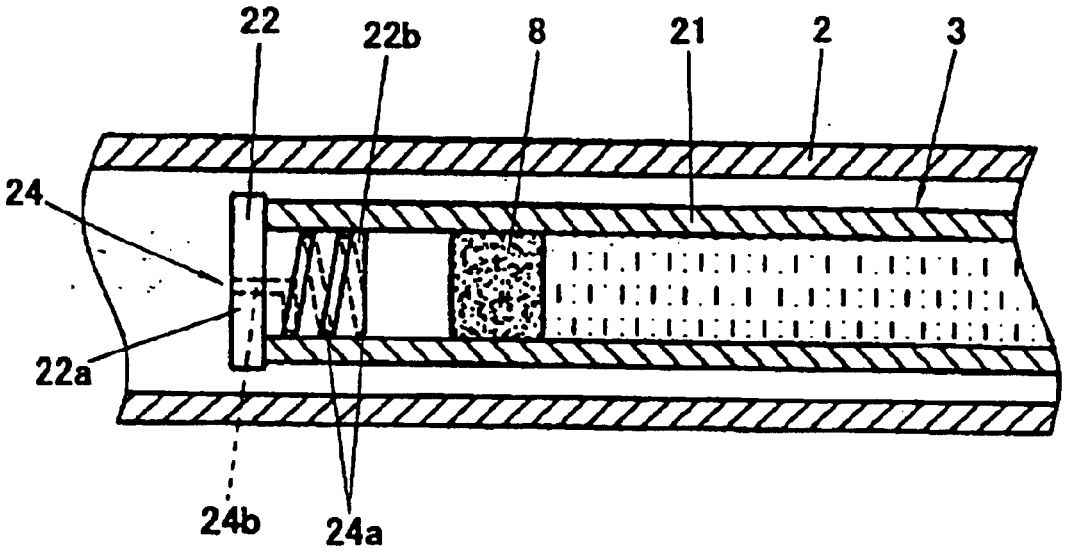
FIG. 25(*a*) is an enlarged fragmentary cross section of an applicator provided in another one of the other embodiments of the present invention.
Figure 25:
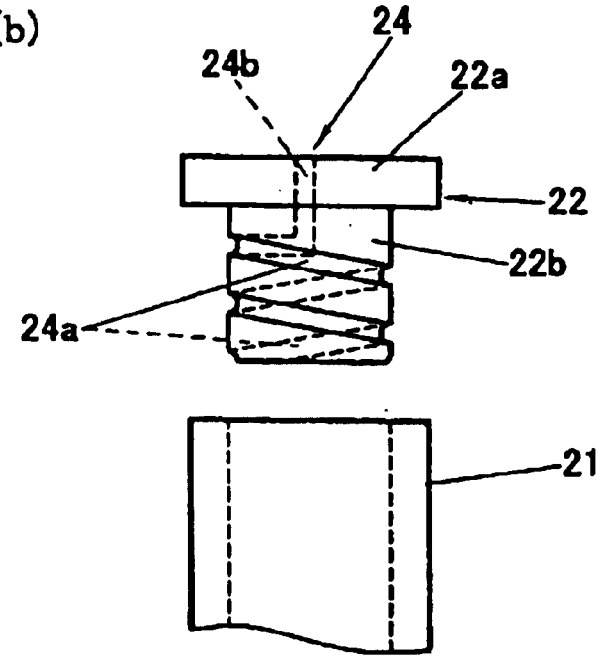

FIGS. 25(*a*) and 25(*b*) show a twelfth embodiment of the applicator 1, whose back-flow inhibitor 8 is composed solely of a viscous material, that is a polybutene gel. Ink reservoir 3 in this case is composed of a main body 21 and a plug 22 fitted therein. The plug 22 disposed at the rear end of said main body 21 comprises a lid 22*a* and a short columnar piece 22*b* continuing forwards therefrom. This columnar piece 22*b* of a diameter matching the reservoir's main body 22 has an air inlet 24 formed through said piece. A helical groove 24*a* is formed spirally in and around the periphery of the columnar piece 22*b*. An aperture 24*b* formed in the lid 22*a* communicates with the helical groove 24*a* so as to provide an air inlet 24 in this case. Am ambient air will thus be guided through this inlet, as in the preceding embodiments. However, it is difficult for the back-flow inhibitor 8 consisting of polybutene gel to flow out through the air inlet 24. Other structural features are the same as those included in the embodiment shown in FIG. 22. The helical groove may alternatively be formed in the inner periphery of the reservoir body 21, and correspondingly a cutout substituting for the aperture 24*b* in the lid may be formed in a boundary between the lidd 22*a* and the reservoir body 21.

Thirteenth Embodiment

Figure 26:
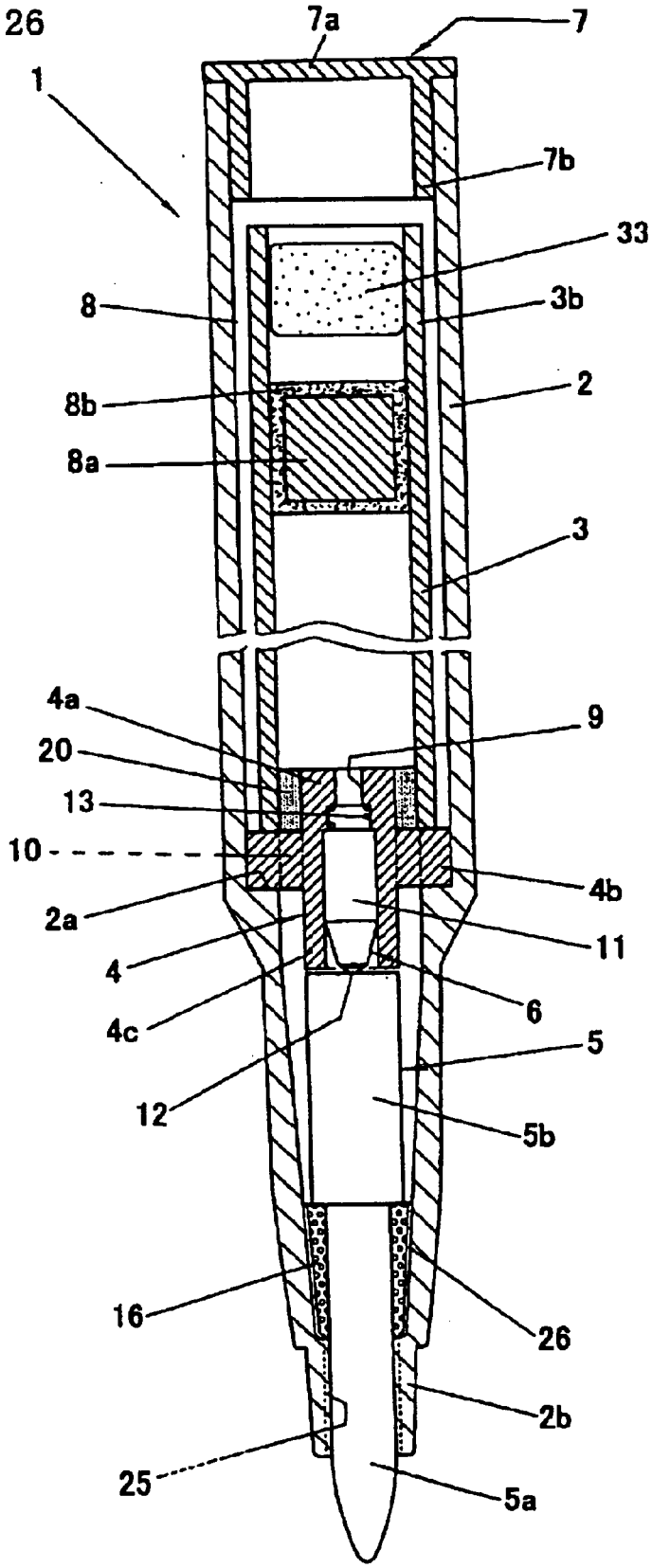
FIG. 26 is a vertical cross section of an applicator provided in still another one of the other embodiments of the present invention.

FIG. 26 shows a thirteenth embodiment of the applicator 1, which differs from that shown in FIG. 22 in that the reservoir's 3 rear end is not caulked, but instead of it, a urethane foam 33 is put in the rear end. Air can permeate this porous urethane foam, though back-flow inhibitor 8 can be stopped well. Thus, such a foam 33 functions as an air inlet on one hand, and as an obstructer on the other hand.

Fourteenth Embodiment

Figure 27:
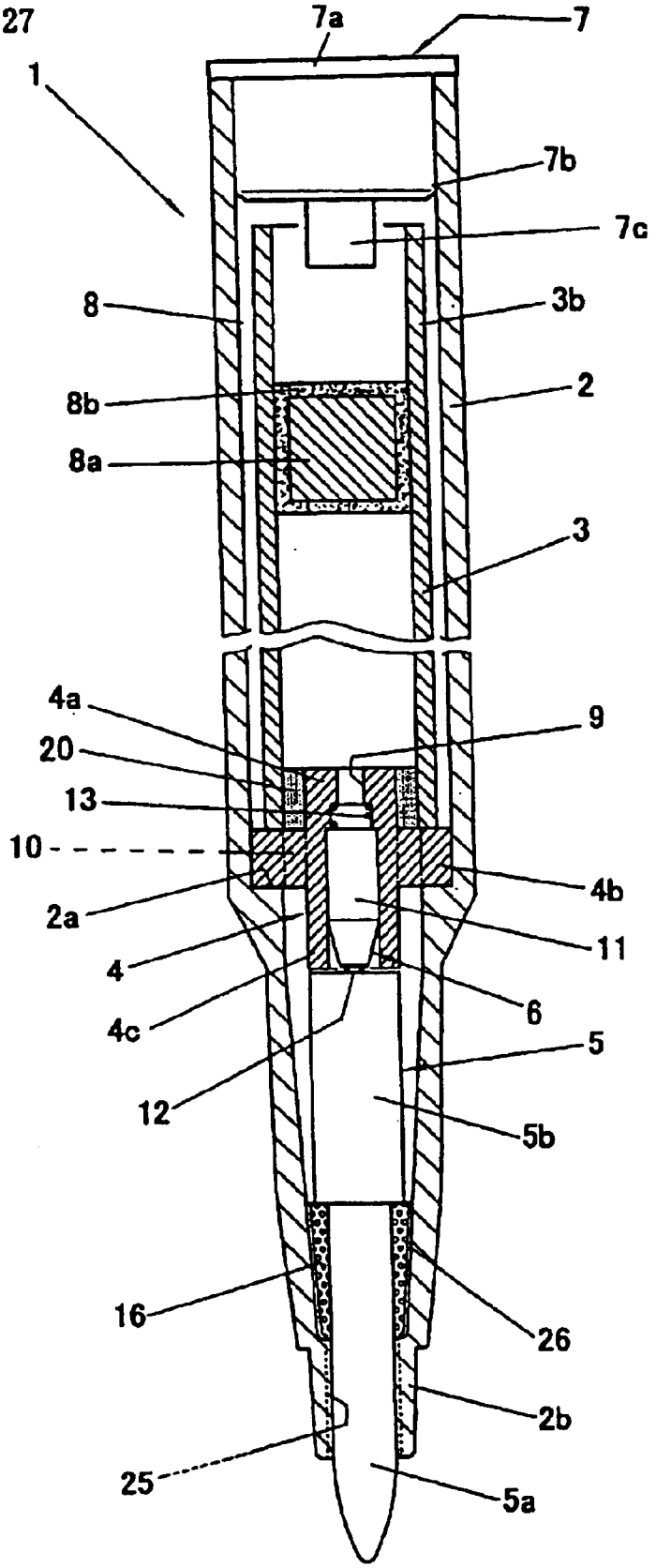
FIG. 27 is a vertical cross section of an applicator provided in yet still another one of the other embodiments of the present invention.

FIG. 27 shows a fourteenth embodiment of the applicator 1. In this case, a short columnar lug 7*c* is formed integral with the proximal stopper 7 fitted in the external cylinder 2. This lug 7*c* protruding forwards from the forward face of the stopper is located in the rear end of the cylinder 2, and has a diameter remarkably smaller (much smaller) than the inner diameter of said cylinder. Therefore, the back-flow inhibitor 8 will be stopped with the short columnar lug 7*c*, which thus serves as an obstructer as in the foregoing embodiments. The space present around said lug 7*c* will work as an air inlet in this case. Such a simple structure enables reduction in the number of constituent parts, while rendering it easier to assemble them.

Figure 28:
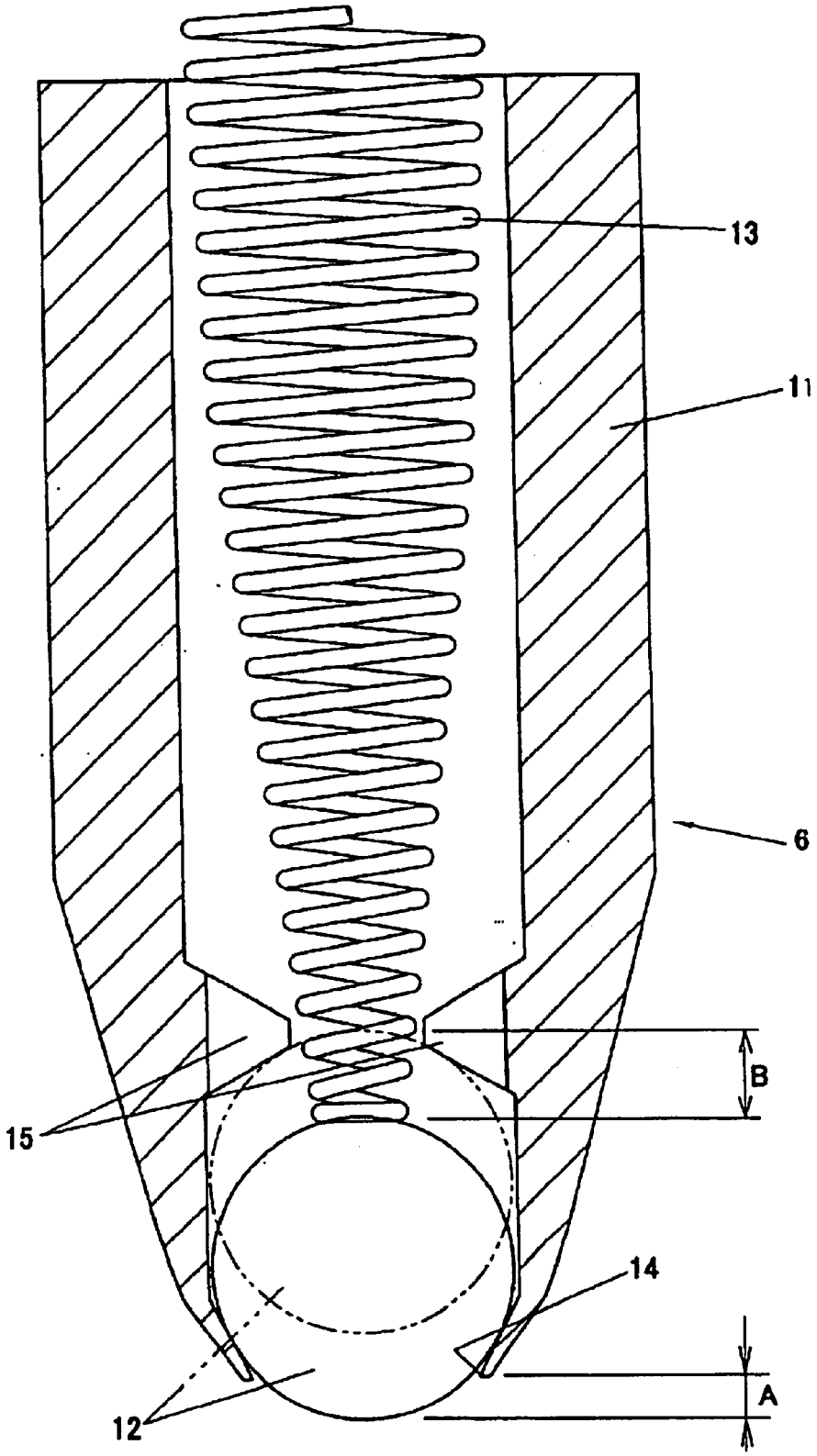
FIG. 28 is an enlarged fragmentary cross section of another example of a device for supplying an application liquid and included in the applicator provided herein.

FIG. 28 illustrates a modified example of the valve housing 11. In this case, a distance 'B' by which the valve body 12 can be retracted when in use is designed greater than another distance 'A' by which the valve body 12 protrudes away from the distal end of the valve opening 14 during non-use of the applicator. This feature enables that the valve body is wholly retracted into the opening 14 and thus into the housing 11

Fifteenth Embodiment

Figure 29:
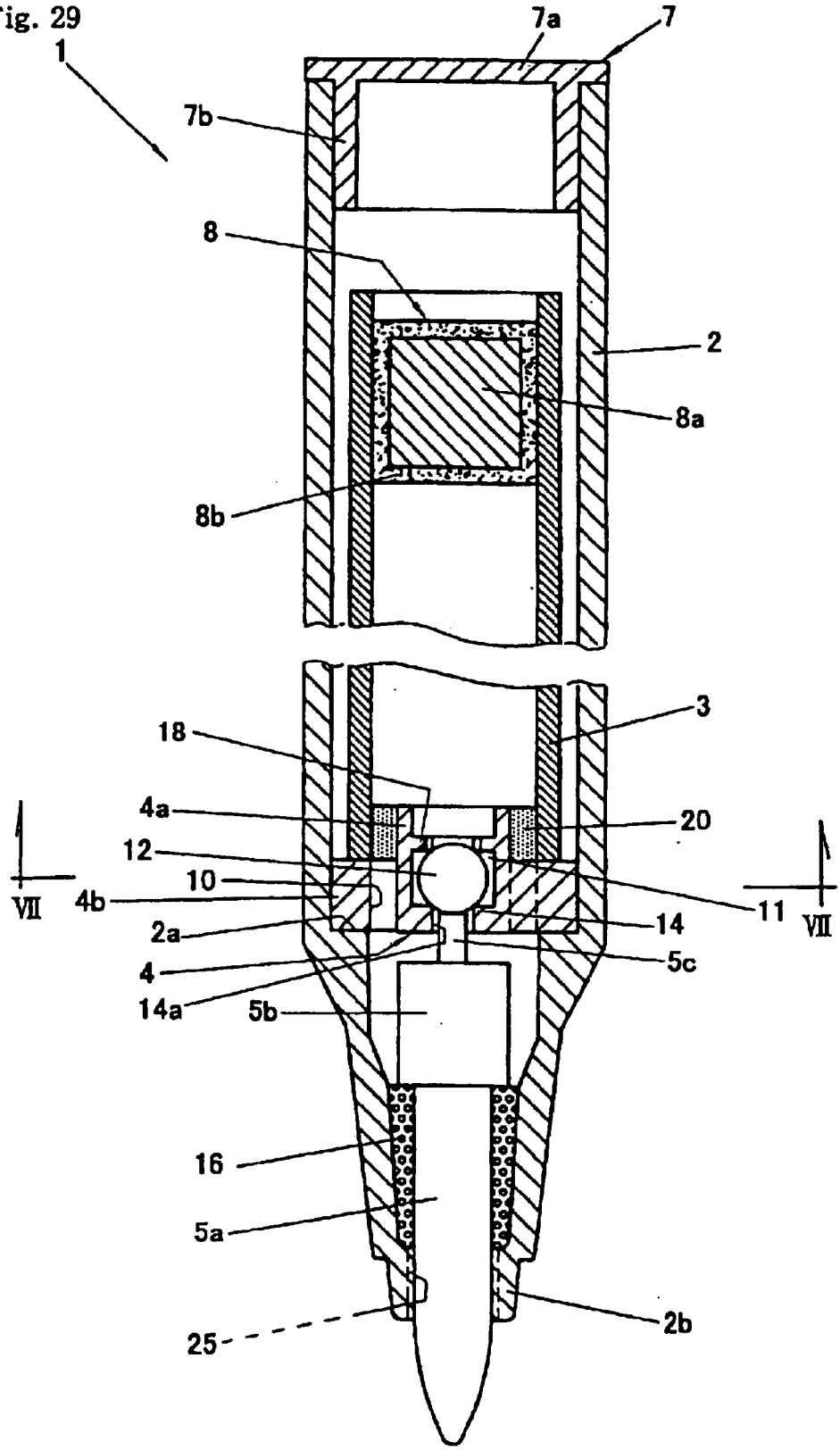
FIG. 29 is a vertical cross section of an applicator provided in a further one of the other embodiments of the present invention.
Figure 30:
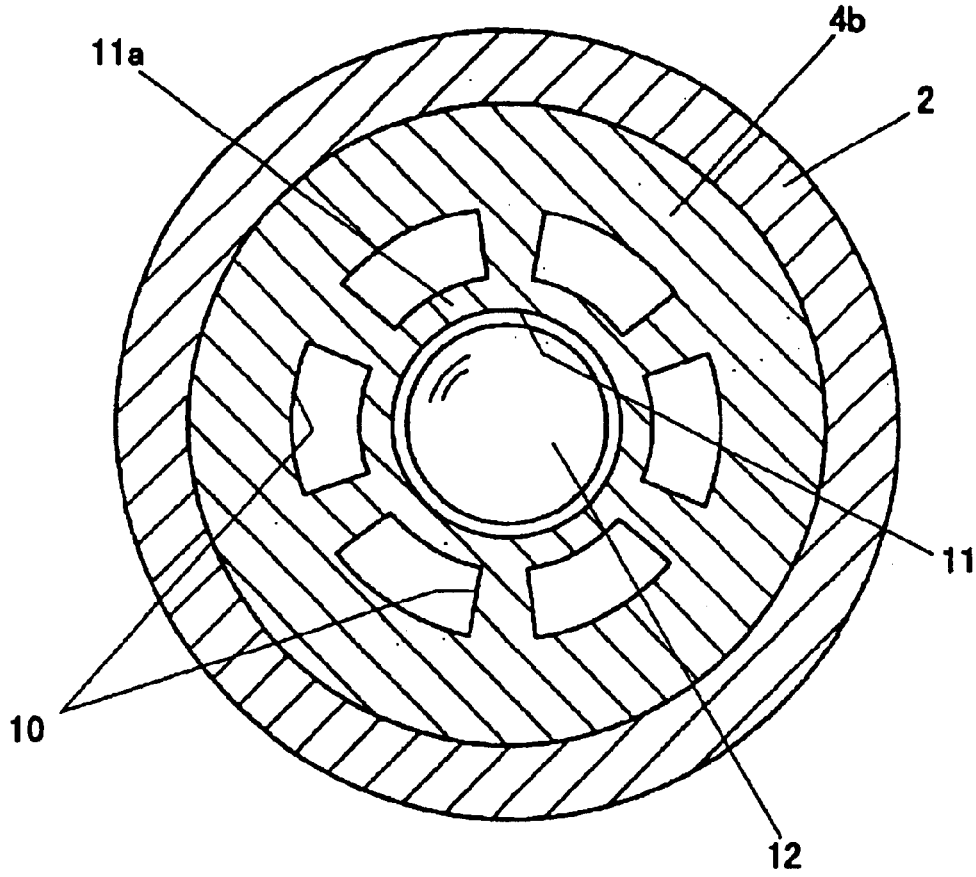
FIG. 30 is a cross section taken along the line VII—VII in FIG. 29.

FIGS. 29 and 30 show a fifteenth embodiment of applicator 1. This applicator 1 having a fiber bundle tip in combination with an aqueous ink does comprise a reservoir 3 for storing the ink, a liquid-supplying (that is 'ink-supplying') valve 6 disposed in front of the reservoir, and the tip 5 disposed fowardly thereof. This valve 6 consists of a valve seat 14 having a liquid feed opening 14*a*, a valve chamber 11 disposed in rear of the valve seat and a valve body 12 capable of elastic deformation. The opening 14*a* is formed in and through the seat 14. The valve body 12 is adapted to close the opening 14*a*. In detail, rear end 5*c* of the tip 5 is normally in contact with the forward portion of the valve body 12, while at the same the valve rest 18 is supporting the rearward portion of the valve body. In this state of them, the valve 12 rests on the seat 14 to close its opening 14*a*. Further, the applicator comprise an external cylinder (outer main body) 2, a distal stopper 4 attached to the distal end of reservoir 3, a proximal stopper 7 attached to the proximal end of the reservoir and a back-flow inhibitor 8 for preventing the application liquid from flowing backwards.

The external cylinder 2 is made of a plastics such as a polypropylene, or made of a metal such as aluminum or a stainless steel. Preferably, this external cylinder 2 is made of a transparent or translucent hard synthetic resin, and its diameter gradually decreases towards its distal end. The thinnest distal end of the external cylinder 2 is a tip-holding cylindrical portion 2*b*, in which portion the tip 5 is fitted tightly but capable of sliding fore and aft. Vertical grooves 25 may be formed in and extend along the inner periphery of the cylindrical portion 2*b*.

The ink reservoir 3 is a cylinder made of a plastics such as a polypropylene, or of a metal such as aluminum or stainless steel. This reservoir 3 held in place in the external cylinder 2 is hollow to store the ink, and has an outer diameter smaller than the inner diameter of said cylinder so as to define a space between them.

The distal stopper 4 is disposed partially in and almost in front of the ink reservoir 3. This stopper 4 is made of a hard resin such as a polypropylene or a proper metal, is located intermediate between the proximal and distal ends of the external cylinder 2. A proximal portion 4*a* of the distal stopper 4 is a cylindrical part fitted in a cylindrical sealant 20. This sealant 20 intervening between the outer periphery of the proximal portion 4*a* and the inner periphery of the ink reservoir 3 prevents the ink from leaking out.

Also in this embodiment, a material forming the sealant 20 permeates or transmits through it the vapor of solvent contained in the ink. For aqueous inks, sealing materials having permeability coefficient of 2.5–10.0 $cm^3 \cdot cm/cm^2 \cdot s \cdot Pa$, or more preferably 3.0 $cm^3 \cdot cm/cm^2 \cdot s \cdot Pa$ or higher for water vapor, are desirable. Silicone rubbers or the like porous substances will qualify as such materials of the sealant 20. Silicone rubbers and their copolymers have each a fine texture in which molecules are coarsely packed and distance between adjacent molecules is so large that they are highly flexible and afford excellent permeation of vapor. Therefore, silicone rubbers or the like can be employed as the sealant 20 even in case of oily or lipophilic inks. Water vapor (gaseous solvent evaporated from the ink) will thus permeate the sealant 20 and reach a space around the tip 5, to thereby suppress natural and undesirable evaporation of the solvent from the tip.

The proximal portion 4*a* of the distal stopper 4 is tightly fitted in the distal end of the reservoir 3, with the sealant 20 intervening between them. A large diameter portion 4*b* protruding in radial direction is formed integral with a distal portion of the stopper 4 and firmly fitted in the external cylinder 2. A shoulder 2*a* formed in the inner periphery of this cylinder 2 supports the distal face of the large diameter portion 4*b*. In this manner, the reservoir 3 is immovably connected by the distal stopper 4 to the pen body 2. As shown in FIG. 30, the large diameter portion 4*b* has holes 10 penetrating it to convey the gas permeating through the sealant 20 towards the space around the tip 5. Some sectors as such holes 10 are arranged at regular angular intervals as shown in the drawings, though shape and the number of them are not delimited to those in this example.

In the illustrated example, the valve chamber 11, the valve seat 14 and the valve rest 18 are formed in the distal stopper 4 so as to make it function as a valve housing. Alternatively, it may be possible to use instead of such a stopper a special, discrete and separate member as the valve housing.

This ink feeding valve 6 consists of, in the illustrated example, the distal stopper 4 and the spherical valve body 12 placed therein, wherein this stopper is cylindrical in shape and has an inner surface around the opening 14*a*, with this surface serving as the valve seat 14. In view of these structural features, the distal stopper 4 will be referred to as 'internal housing' hereinafter in the present embodiment.

The valve body 12 is a ball formed of a silicone rubber, or any other kind of rubber or the like so as to be capable of elastic deformation, particularly capable of compression in axial direction.

The internal housing 4 is of such a cylindrical in shape as defining therein the valve chamber 11 also cylindrical to hold therein the valve body 12. Formed in the forward wall of this internal housing 4 is the opening 14*a* through which the valve body 12 is exposed to the outside in part. The tip's proximal end 5*c* is inserted in this opening 14*a*, whose diameter may be about 50–90% of that of valve body 12. It may be possible to modify this structure such that an intermediate piece intervenes between the rearward end 5*c* of the tip 5 inserted in the opening and the valve body. In this case retraction of the tip will be indirectly transmitted to the valve body 12.

Figure 31:
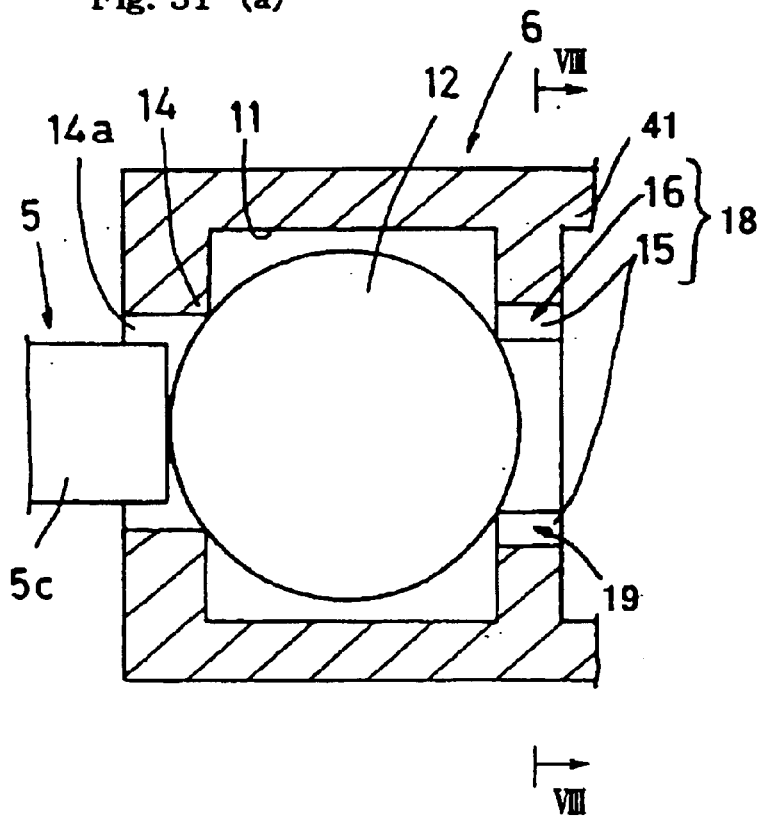
FIG. 31(*a*) is an enlarged fragmentary cross section of the distal portion of a valve housing (viz., valve chamber) included in the applicator shown in FIG. 29, wherein a distal opening of the housing is closed because an applying tip included in this applicator has not yet made action relative to the housing.
Figure 31:
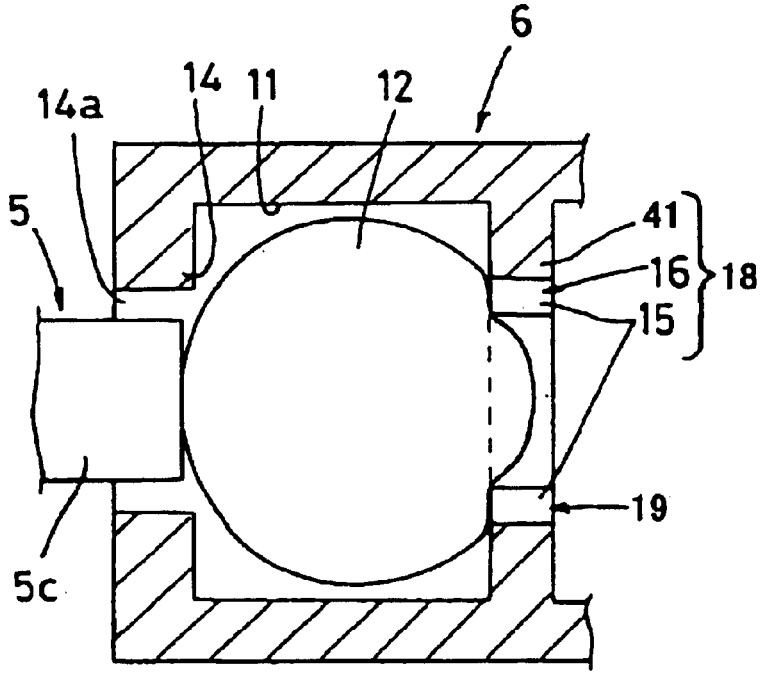
Figure 32:
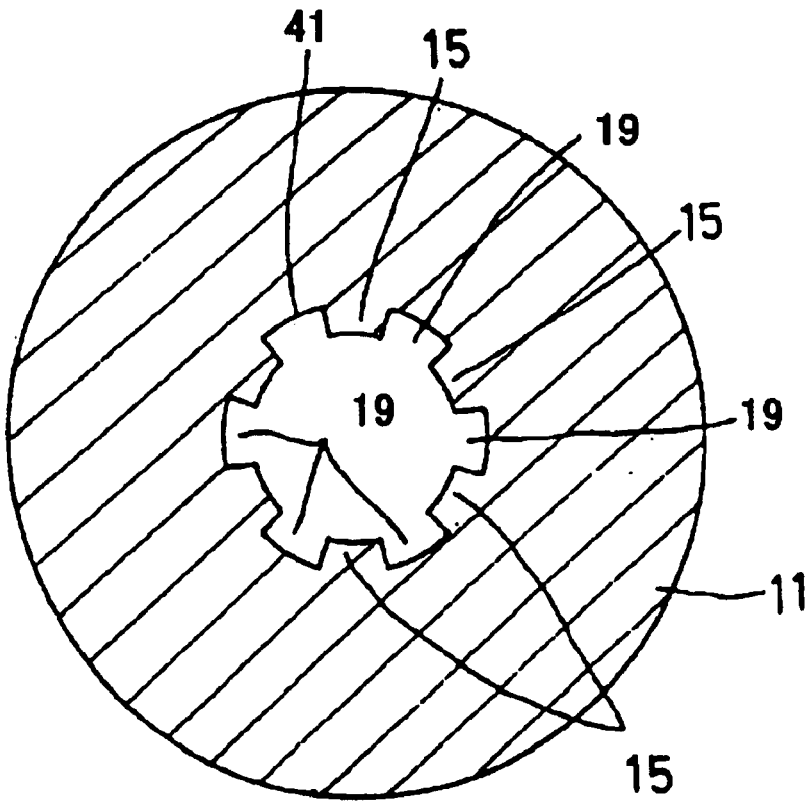
FIG. 32 is a cross section taken along the line VIII—VIII in FIG. 31(*b*)

FIGS. 31(*a*), 31(*b*) and 32 show the interior of the internal housing 4 of this valve 6, in more detail. There is formed a transverse wall at a middle region of the internal housing 4, and a constricted central hole 41 penetrates the wall in axial direction (thus the said wall may be referred to as 'small diameter portion' of the internal housing). A plurality of lugs 15 spaced from each other in circular direction protrude integrally with and radially from the rim of hole in the 'small diameter portion' 41, in a centripetal direction. Ends of the lugs 15 are in contact with a circumference of the valve body 12. Slits 19 thus defined each between adjacent two lugs 15 will function as a passage the valve chamber 11 communicates with the reservoir 3 before the tip 5 is pressed on the valve body 12. Although the forward faces of the small diameter portion 41 and the lugs 15 extend perpendicular to the axis, they may be modified to be tapered backwards and towards the axis.

The small diameter portion 41 and the lugs 15 constitute the valve rest 18 in rear of the valve body 12. The valve chamber 11 is thus defined between such a valve rest and the forward opening 14*a*. Length of the valve chamber 11 in axial direction is designed such that the valve body 12 not being pressed with the tip 5 does contact both the ends of the lugs 15 and the rim around the opening 14*a*. Elastic repellency of the valve body in this state will cause it to close the opening 14*a*. FIG. 31(*a*) illustrates this normal state of the valve body 12 to which the tip 12 is not exerting any elastic force. In this state, the valve body's rearward portion contacts the lugs 15, while at the same time its forward portion contacts the rim of the opening 14*a*. Thus, although the application liquid can flow into the valve chamber through the passage (i.e., slits) 19 formed in the valve rest 9, it can not advance towards the tip due to the closed opening 14*a*.

If the writing pressure urges backwards the tip 5 in this resting state to move a first distance, the valve body 12 receiving this urging force will be compressed to open the forward opening 14*a* to supply the tip with the liquid or ink. In this activated state, the ink can flow through the slits each between the lugs 15 and then through a clearance present between the valve body 12 and side walls 11*b* of the valve chamber 11, and subsequently though the opening 14*a* until reaching the tip 5. If the tip is further pushed back beyond a second distance, the valve body will be compressed more to take a position shown in FIG. 31(*b*). In this ultimate state the valve body 12 will bear not only with the lugs 15 but also with the front face of 'small diameter portion' 41, resulting in the closing of the valve 6, stopping ink feed from the reservoir 3.

The tip 5 is composed of any known material such as a resin or a fiber so that it can exude ink due to capillary action. Any proper material may be used alone to form the tip, although any composite rod consisting of a plastics piece and a fiber bundle connector bonded thereto are employable, too. Instead of them, the so-called 'writing brush' type tip may be used.

The distal end of the tip 5 protrudes forwards beyond the distal end of the external cylinder 2, for convenience in writing characters or drawing strokes. The proximal end face 5*d* of the tip has, jutting rearwards therefrom, a protrusion 5*c*. This protrusion 5*c* is in contact with the valve body 12 of the ink feed valve 6. The tip's end face 5*d* is normally spaced a certain distance from the forward face of the distal stopper 4, but will be brought into contact therewith when the tip is pushed back.

The certain distance noted above is equal to or greater than the second distance such that when the tip's rear face 5*d* contacts the distal stopper's 4 forward face, the valve body 12 will bear against the forward surface of the 'small diameter portion' 41 so as not to continue ink feed.

The tip 5 consists of a distal small diameter portion 5*a*, a proximal large one 5*b* integral therewith, and the protrusion 5*c* jutting from the rear face 5*d*. Diameter of the large diameter portion 5*b* is made somewhat smaller than that of the inner periphery of external cylinder 2, so as to define between them a small clearance. Thus, a narrow space formed around that tip's proximal larger portion communicates with the forward face of sealant 20, through the valve 6.

In the external cylinder 2 and in rear of the tip holding portion 2*b* thereof, a cylindrical mass of urethane foam 16 is secured. A superfluous amount of ink will be absorbed by this urethane foam serving as an ink storage, and later this foam will occasionally supplement the ink in the tip from time to time. The urethane foam 16 has its inner end bearing against the shoulder formed between the small diameter and large diameter portions 5*a* and 5*b*. This arrangement, that the tip 5 is urged inwards by this foam 16 but with a force weaker than the spring 13 urging the tip outwards, is useful to avoid rickety motion of the tip and unintentional opening of the valve 6.

The ink reservoir 3 is filled, initially, with an aqueous ink or any other desired application liquid. Also incorporated in the reservoir is a back-flow inhibitor 8 that is composed of, in the illustrated example, a rubber or plastics float 8*a* and a back-flow inhibiting agent 8*b* enclosing same. This inhibitor 8 is located at a boundary between the ink column and a vacant space present behind same so as to seal the rear end of ink column, in a manner that any bubbles are not produced in or any amount of air does not penetrate into the ink. Such a back-flow inhibitor 8 will advance forward, following shrinkage of the column of ink caused by consumption thereof.

A proximal stopper 7 is attached to the proximal end of external cylinder 2. This stopper comprises a lid 7*a* and a short cylindrical portion 7*b* forwardly continuing therefrom. The cylindrical portion 7*b* of an outer diameter matching the inner diameter of the external cylinder 2 is fitted therein. Any inlet for introducing ambient air may be formed in the proximal stopper 7.

In operation, the valve body 12 which the applicator 1 of the present embodiment is urged to and pressed on the opening 14*a* in the valve chamber 11, owing to its own elastic repellency. Thus, ink will not be fed to the writing tip 5 from reservoir, in non-use state of the applicator.

When writing is to be done using this applicator, the writing pressure will drive the tip the first distance, so that the valve body is compressed to open the opening 14*a*. Consequently, the ink will flow from the valve chamber 11 to the tip 5.

There may take place the event that the tip 5 would occasionally be displaced beyond the second distance. This will cause a pressure higher than an upper limit imparted to the valve body 12, and consequently it will be further compressed to close the valve 6. As a result, ink feed to the valve chamber 11 is stopped, thereby protecting the tip 5 from being supplied with any superfluous amount of ink.

Elastic deformation of the valve body 12 will not produce any feeling of bumping or clunking that would otherwise be caused by the moving tip 5.

Figure 33:
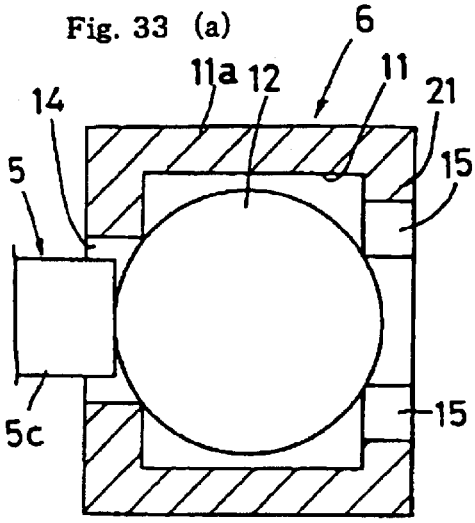
FIG. 33(*a*) is a schematic cross section of another example of an application liquid-supplying valve assembly, wherein the distal opening of the housing is closed because the applying tip has not yet exerted a pressure.
Figure 33:
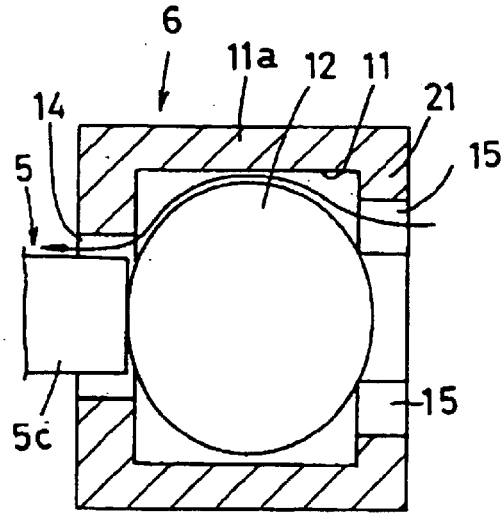
Figure 33:
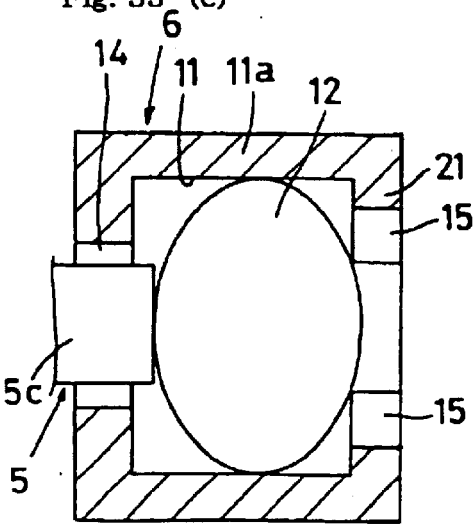

FIGS. 33(*a*) to 33(*c*) show a modification of the valve body 12 included in the embodiment just described above. In this case, the valve body 12 compressed to an excessive extent by the tip 5 having moved beyond the second distance will come into contact with the lateral walls 11*b* of the chamber 11. If this happens, the valve 6 will be closed also surely but in a different manner from that in the described embodiment. Description of the other structural features that are the same as those in the above embodiment is not repeated.

Sixteenth Embodiment

Figure 34:
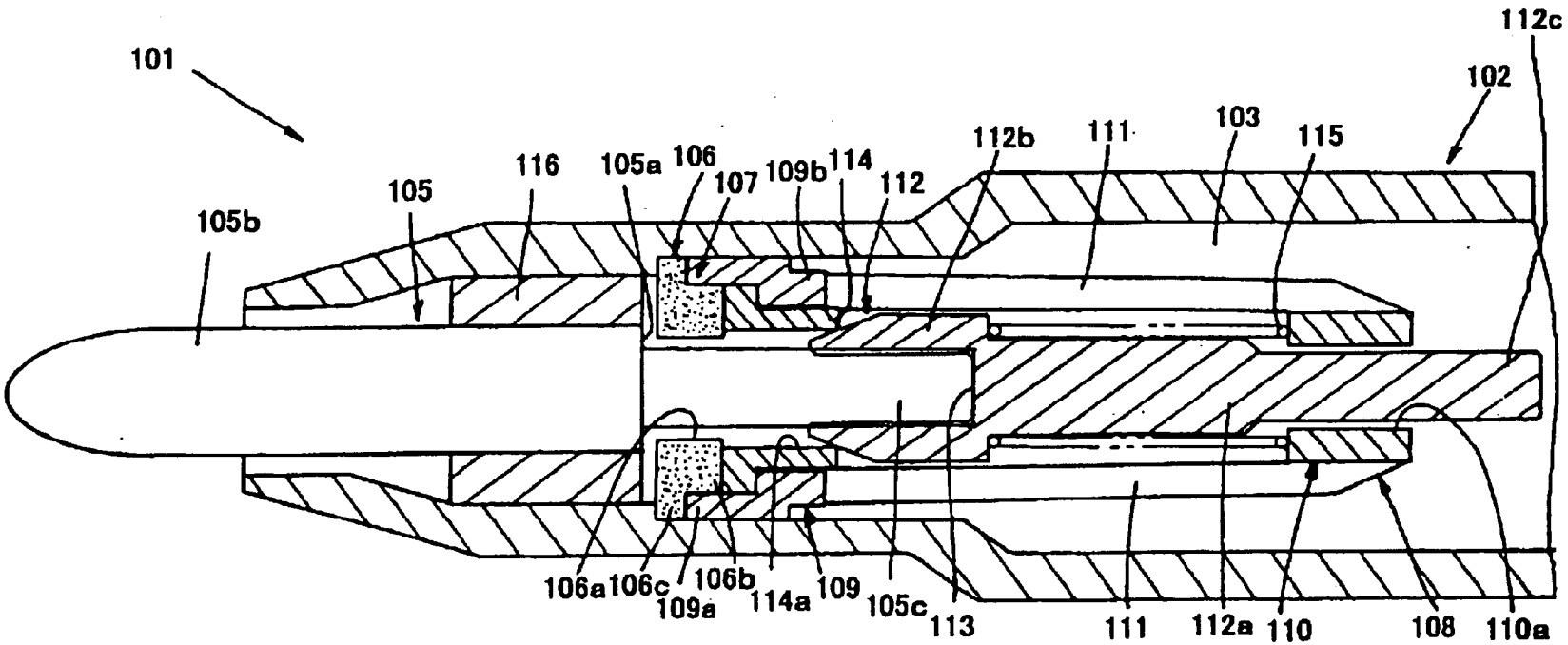
FIG. 34 is a vertical cross section of an applicator provided in a further embodiment of the present invention.

FIG. 34 shows a sixteenth embodiment of the applicator. This pen 101 comprises a tip of the fiber bundle type for use with an aqueous ink, and an external main body (external cylinder) 102. An ink container (reservoir) 103 is formed in the main body 102, and a distal partition 106 for the reservoir 103 is disposed in front thereof. A valve disposed in rear of the distal partition 106 is for feeding the ink from the reservoir to a tip 105 in response to this tip being driven backwards.

The valve comprises a valve body 112 held by a valve retainer 108 so as to be movable fore and aft. The valve body is constructed such that it can rest on a valve seat 104 to stop ink feed from the reservoir, and move away from the seat to conduct ink feed. A compression coiled spring (biasing member) 115 urges always the valve body 112 towards the seat 114 (in forward direction). The tip 105 is disposed in front of the valve body 112, so that it engages with rear end of the tip. With this body 112 being retracted, the valve will open. A back-flow inhibitor (not shown) may be disposed in rear of the reservoir 103 in order to prevent the ink from flowing back. Also, a proximal stopper may be attached to rear end of the main body 102. It may be possible to construct a rear half of this writing tool in the same fashion as the frontal half summarized above. The same reservoir or different reservoirs may supply those halves with the same or different inks, respectively.

The ink reservoir 103 is a hollow cylinder to store therein the ink, and in the illustrated example, is a part of the main body itself. However, a separate cylindrical member prepared as the reservoir may be incorporated in the main body.

The external main body 102 is a cylinder having its diameter gradually decreasing towards its distal end may be formed of a plastics such as a polypropylene, or a metal such as aluminum or stainless steel. Preferably, the main body is formed of any proper transparent or translucent hard synthetic resin.

The distal partition 106 is set in place in the main body 102 and in front of the reservoir 103 so as to separate it from a further forward region of said main body. An axial bore 106 penetrates the distal partition 106 so as to receive the tip 105. A gap provided around the tip's 105 portion and between it and the bore's 106*a* inner periphery allows the tip's portion to freely move through the gap. The distal partition 106 has of a large diameter portion 106*c* and a small diameter portion 106*d* protruding rearwards therefrom. A stepped shoulder formed in the inner periphery of the main body 102 serves to firmly and tightly secure therein the larger portion 106*c* of distal partition 106. The portion 106*d* smaller in diameter than the larger portion cooperates with the inner periphery of main body 102 to constitute a space 107 for fixing the valve retainer 108.

The partition 106 is made of a silicone rubber or the like elastic material so that it buffers its collision with a stepped shoulder 105*a* of the writing tip 105.

The valve retainer 108 fits in the mounting space therefor defined between the partition 106 and the main body 102. This valve retainer 108 fixed in the reservoir 103 comprises a distal ring 109 and proximal ring 110, connected one to another by a plurality of tie rods 111. The ink can flow in between those tie rods 111 towards the tip, and the valve body 112 can move fore and aft within an circular array of those tie rods. The proximal ring 110 has a bore 110*a* through which a proximal portion of the valve body 112 extends to freely slide therein. The distal ring 109 has an annular extension 109*a* fitted in the space 107 for fixing the valve retainer 108. A collar 109*b* integral with and extending rearwards from the annular extension 109*a* has diameter smaller than this extension in order to fit on valve seat 114. This collar 109*b* is spaced from the rear face of the partition 106 by a distance to leave therebetween a cavity to firmly receive the valve seat.

The valve seat 114 has its forward face in contact with rear face of partition 106, and its outer periphery in contact with inner periphery of distal ring 109. This ring constituting the valve retainer 108, and thus valve seat 114 is fixedly held in place. An axial ink feed bore 114*a* of valve seat also surrounds rear portion 105*c* of tip 105, allowing this portion to freely move in axial direction. The valve body 112 being urged by spring (biasing member) 115 is in a forced contact with the rear end of valve seat 114, normally closing ink feed bore 114*a* with valve seat 112. Both the partition's bore 106*a* and the seat's bore 114*a* are larger in diameter than the tip's rear portion 105*c*. A continuous passage thus formed around the tip portion 105*c* will permit ink to flow forwards, when this applicator is used.

The valve body 112 is composed of a barrel 112*a*, a coupling portion 112*b* having an enlarged diameter and engaging the tip, and a stem or basal portion 112*c*. The coupling portion 112*b* protrudes forwards from the barrel 112*a*, with the basal portion 112*c* extending rearwards therefrom, all these three portions being formed integral with each other. A recess 113, that faces forwards, is formed in and centrally of the coupling portion 112*b*. The coupling portion thus fits on rear portion 105*c* of the tip 105 to coupled therewith. Bottom of the recess 113 is made flat to be in a face-contact with the tip's rear end face. The forward region of coupling portion 112*b* is tapered to reduce its diameter towards its frontal end. This frontal end of coupling portion 112*b* is tapered forwards to reduce diameter has a diameter smaller than the ink feed bore 114*a* of valve seat 114. Rear region of coupling portion 112*b* has a diameter larger than this bore 114*a*. The valve body's 112 fore end is rendered in this fashion to be capable of engaging with valve seat 114 to stop ink feed, and capable of disengaging therefrom. Diameter of the coupling portion 112*b* is larger than that of barrel 112*a* so that rear face of this portion bears against one end of spring 115. The fore face of proximal ring 110 of the valve retainer 108 does support thereon the spring's 115 other end, to thereby always urge the valve body 112 forwardly towards the valve seat 114.

The stem 112*c* of valve body is made thinner in diameter than the barrel thereof 112*a*, so that it can move fore and aft through the bore 110*a* of proximal ring 110 of valve retainer 108. Thus, valve body 112 can slide in its entirety in axial direction, within external main body 102. Preferably, all of the valve body 112, valve retainer 108 and valve seat 114 may be formed of a plastics or the same or different metals. The spring 115 may be made using a nylon fishing gut, a wire leader or the like thin elongate material, or alternatively any other proper biasing may be employed as the spring.

The distal end 105*b* of tip 105 protrudes forwards beyond the distal end 102*b* of main body 102, for convenience in writing characters or drawing strokes. The tip's proximal portion 105*c* is thinner (in diameter) than the distal portion 105*b*, and extends through both the partition's bore 106*a* and the seat's bore 114*a*. Rear face of such a distal portion 105*b* of the tip 105 is in face-contact with the bottom 113*a* of recess 113. The tip 105 may be composed of any known material such as a resin or a fiber so that it can exude ink due to capillary action. Any proper material may be used alone to form the tip, although any composite rod consisting of a plastics piece and a fiber bundle connector bonded thereto are employable, too. Instead of them, any tip of the so-called 'writing brush' type may be used.

A shoulder 105*a* is defined between the fore and rear portions 105*b* and 105*c* of tip 105. When the tip is retracted over a distance, this shoulder 105*a* will collide with the transverse partition 106. In detail and more precisely, the writing pressure will drive the tip 105 to push the valve body 112 backwards and upwards to thereby open the valve 106, before such a collision of shoulder 105*a* is stopped by partition 106. In this way, the fore face of partition 106 functions as a resistant member for inhibiting the tip from moving back beyond a limit.

In the main body and in front of the partition 106, a cylindrical piece of urethane foam 116 is secured. A superfluous amount of ink will be absorbed by this urethane foam, and later it will occasionally supplement the ink in the tip from time to time. The urethane foam 116 useful to avoid transverse rickety motion of the tip 105 is disposed around a basal region of the tip's large diameter portion 105*b*.

In operation, the applicator 101 provided in this embodiment will have its valve maintained closed so long as it is left non-used. This is because the spring 115 continues to urge the valve body 112 towards the valve seat 114. Any positive feed of ink is not effected in this state.

When writing is done, the writing pressure will be imparted to the tip 105 to press it backwards. Consequently, the valve body 112 is forced inwards to be displaced relative to the valve seat 114, instantaneously opening the valve to start ink feed to the tip. The resistant means describe above will delimit the tip's rearward displacement, thereby inhibiting the valve to open beyond an allowed degree.

During these motions, the tip's shoulder 105*a* will collide with the fore face of partition 106 serving as the resistant means. However, this partition is made of the silicone rubber of an excellent cushioning property such that the users' hands will scarcely feel such a collision of the tip.

Breakage of the tip 105 will also be avoided thanks to such a cushioning portion (fore face of partition 106), though it collides with the tip's shoulder.

Seventeenth Embodiment

Figure 35:
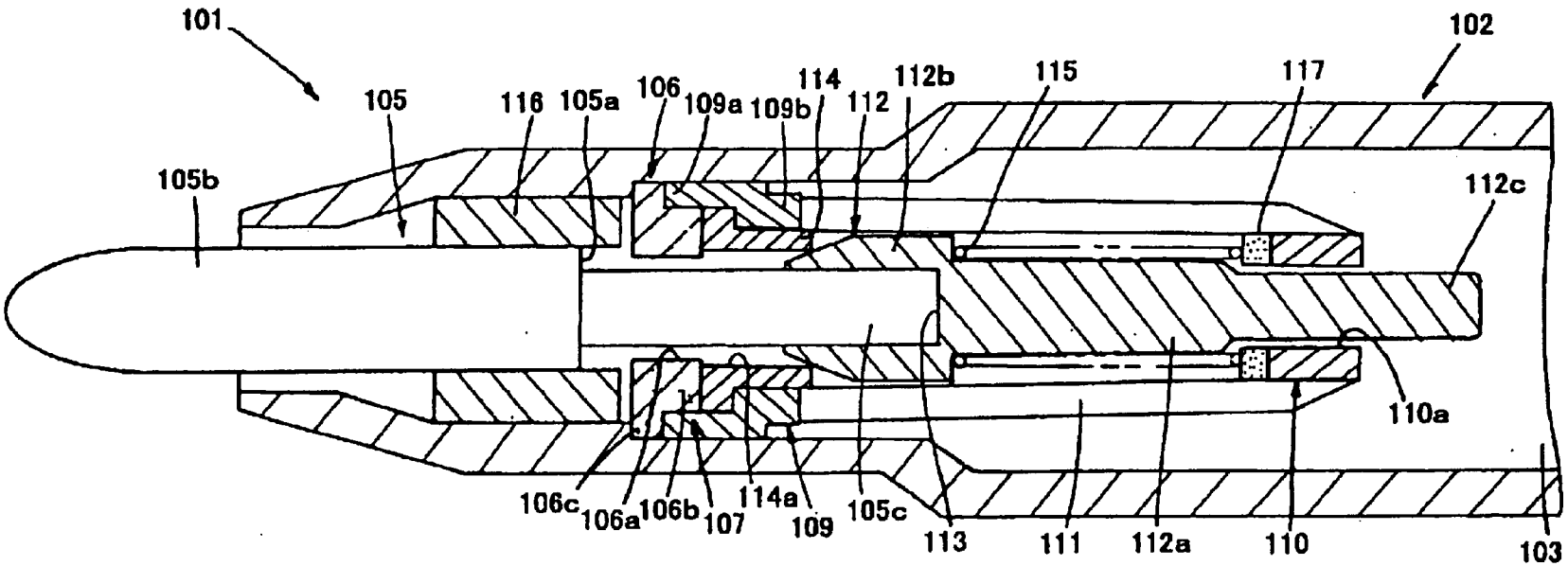
FIG. 35 is a vertical cross section of an applicator provided in a still further embodiment of the present invention.

FIG. 35 shows a seventeenth embodiment of the applicator. Description of components that are the same as or similar to those shown in FIG. 34 is abbreviated, by allotting to them the same reference numerals. Only the newly recited members will be described below on their structure and function.

In this applicator 101, a cushion member 117 of a silicone rubber is displaced on the front face of rear ring 110, to be integral with the valve retainer 108. This cushion member 117 will also function as the resistant means for delimiting the tip's rearward displacement. The valve body 112 being driven rearwards by the tip 105 will be stopped by the cushion member 117 (through and by means of the spring 115).

Eighteenth Embodiment

Figure 36:
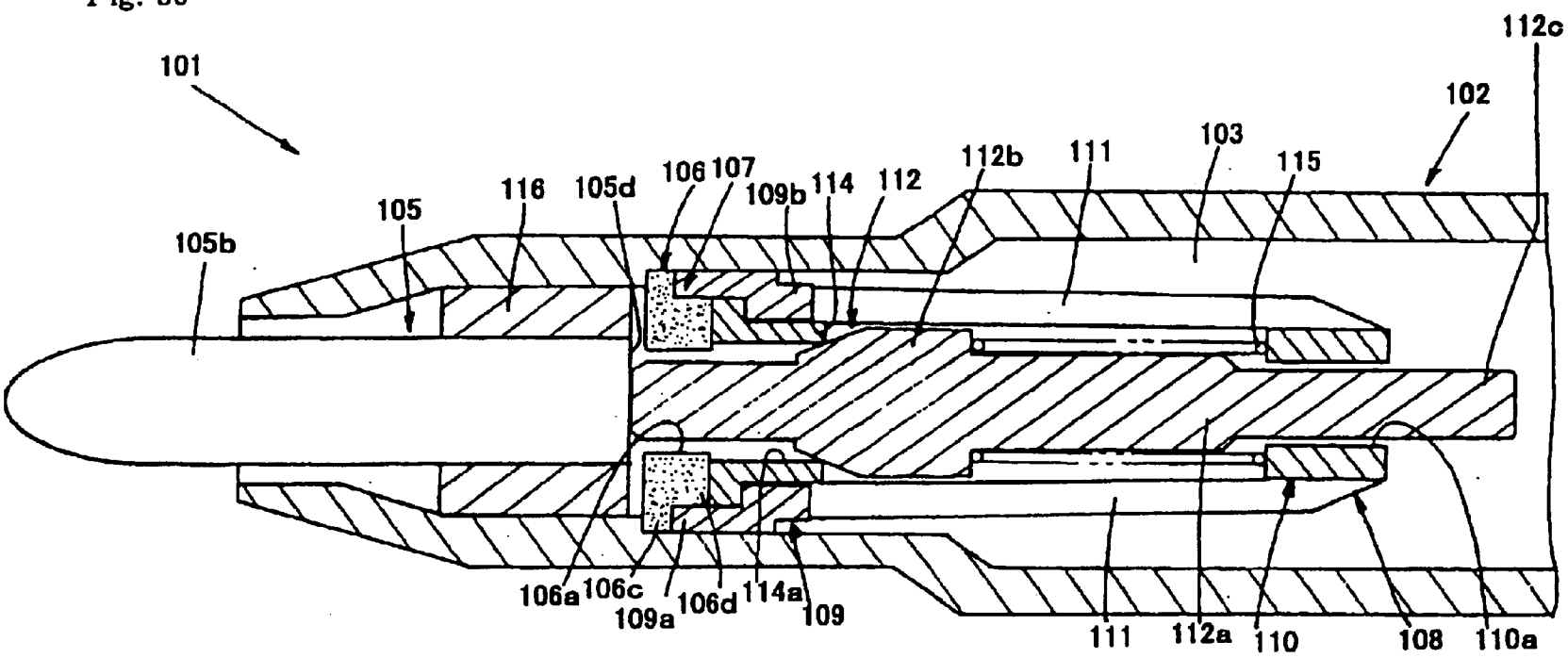
FIG. 36 is a vertical cross section of an applicator provided in another embodiment of the present invention.

FIG. 36 shows an eighteenth embodiment of the applicator, whose components the same as or similar to those in FIG. 34 is not described but indicated at the same reference numerals. Only the newly recited members will be described below on their function.

The barrel 112*a* of valve body 112 in this applicator 101 is elongated forwards. Its fore portion extends through the valve seat's bore 114*a* and the partition's bore 106*a* and protrudes a little distance beyond the fore face of partition 106. A diametrically enlarged portion 112*b* formed at a middle region located intermediate between fore and rear ends of the barrel 112*a*. The forward region of this enlarged portion 112*b* is tapered to reduce its diameter towards its frontal end, such that fore face of this forward region is capable of closing the ink feed bore 114*a* formed through valve seat 114.

Foremost end of the valve body's barrel 112*a* is in contact with the rear end face of the tip. This tip 105 in this embodiment is designed to be much shorter than that shown in FIG. 34, so that its rear end 105*d* is located ahead the partition 106. Therefore, the rear end 105*d* will abut against the resistant means, that is the fore face of partition 106, when the tip is retracted.

The fiber bundle tip of this embodiment is simpler in structure, easier to manufacture and lower in production cost.

Nineteenth Embodiment

Figure 37:
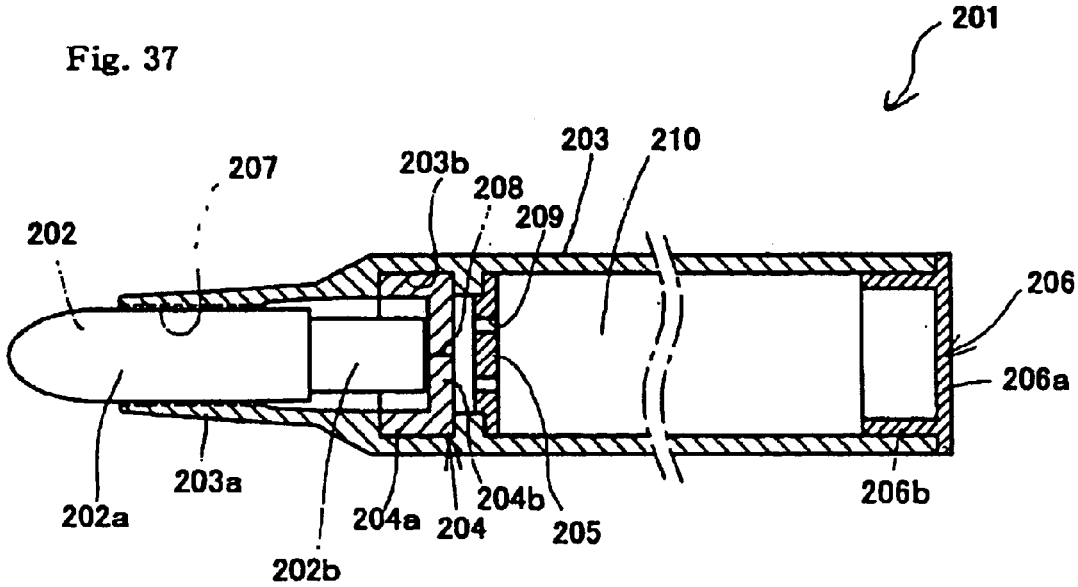
FIG. 37 is a vertical cross section of an applicator provided in still another embodiment of the present invention.
Figure 38:
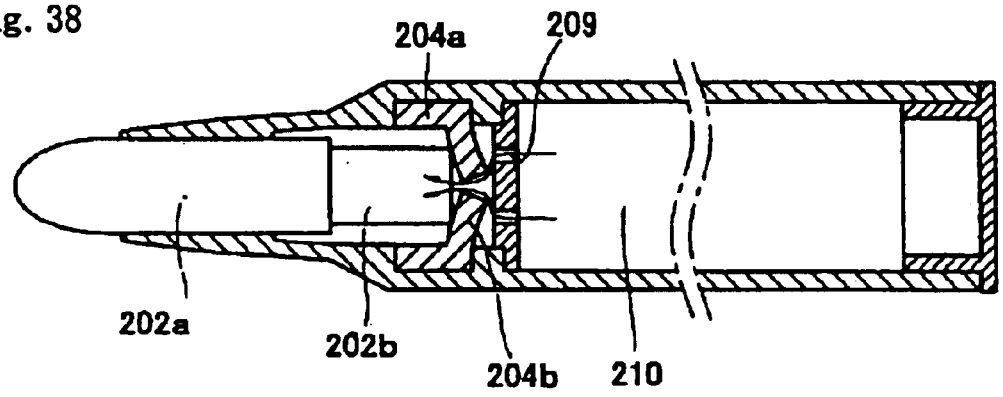
FIG. 38 shows one stage in operation of the applicator shown in FIG. 37.
Figure 39:
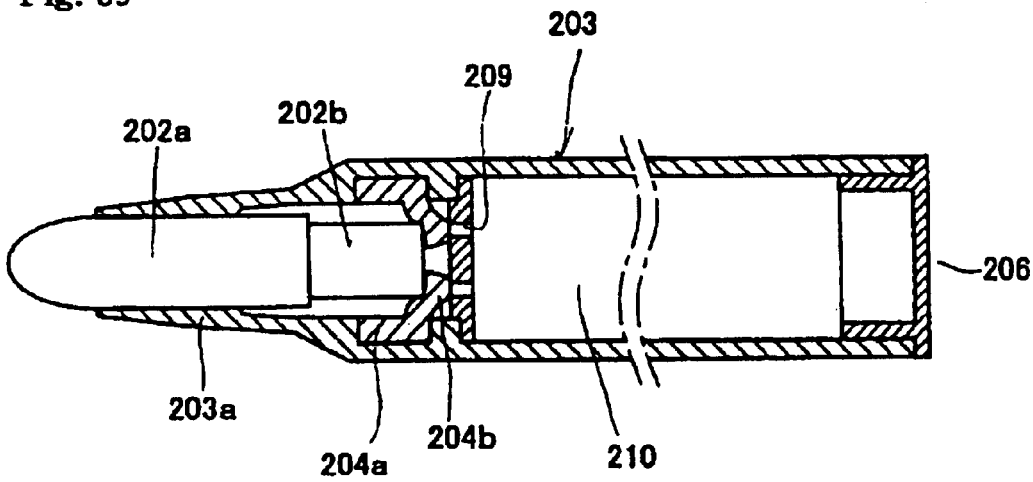
FIG. 39 shows a further stage in operation of the applicator shown in FIG. 37.

FIGS. 37, 38 and 39 show a nineteenth embodiment, wherein an applicator 201 does also have a tip 202 of the fiber bundle type. This applicator comprises a generally cylindrical main body (external cylinder) 203, the pen-point tip 202 secured in a fore portion of the main body, a slit valve 204, a partition 205 and a proximal stopper 206.

The main body 203 is of an elongated cylindrical article, that is made of a plastics such as a polypropylene, or made of a metal such as aluminum or a stainless steel. A tapered and thin distal end of main body 203 serves herein as a tip-holding portion, in which portion the tip 5 is fitted to slide fore and aft. An air inlet may be formed in any convenient portion of the main body 203, and in this embodiment. Vertical grooves 207 formed in the inner periphery of cylindrical portion 203*a* are opened to the outside to serve as the air inlet in this embodiment. Any desired cap (not shown) may be removable attached to the distal end of main body 2.

A valve-receiving section 203*b* formed in the inner periphery of main body and intermediate between the inner and outer ends thereof is designed to hold the slit valve 204 in place. In the illustrated example, that section 203*b* is an annular groove to fit on the slit valve. A short, elastic and cylindrical piece having a closed bottom 204*b* is used to manufacture the slit valve 204, by piercing the bottom in a fore-and-aft direction to form a normally closed slit 208. The slit valve has a cylindrical portion 204*a* secured in the receiving section 203*b*. In normal state, the bottom 204*b* stands not deformed but sealing fore space relative to rear space that is separated with the bottom. Elastic deformation of such a bottom 204*b* of slit valve 204 will however force the slit 208 to open so that the fore and rear spaces communicate with each other through this slit 208. Silicone rubbers are suited for use to manufacture the slit valve 204, though any other proper rubbers may be used. The slit 208 can be of a straight, L-shaped, cruciform or any other appropriate shape.

The partition 205 is located behind and spaced a small distance from the slit valve. Although the partition can be made integral with the main body 203, it is a separate disc in the illustrated examples. This disc as the partition 205 is fitted and fixed in the main body, and apertures 209 for flowing the ink are formed in and through this partition. Any pattern such a non-continuous circular pattern may be employed to arrange those apertures, but they are preferably arranged in a row (or rows) extending perpendicular to the entire slit (or segments thereof).

In the illustrated examples, the space 210 located upstream of the partition 205 will be charged with the ink. In other words, the partition 205 and the slit valve 204 are disposed in front of this space, and forwardly in this order. The ink-storing chamber or space 210 may alternatively be provided using a separate reservoir placed the main body and also disposing a partition 205 and a slit valve 204 in front of the separate reservoir. In any case, those partition 205 and slit valve 204 will remain at their position to close the valve during non-use of the applicator. Upon retraction of the tip 202 by a moderate and small distance, the feeding of ink from the chamber 210 to the tip will commence. However, this valve assembly is characterized in that it will be closed caused by a further retraction of tip beyond the said small distance. The chamber 210 may store therein any desired application liquid such as an aqueous ink, an oily ink or the like.

The tip 202 may be composed of any known material such as a resin or a fiber so that it can exude ink due to capillary action. Any proper material may be used alone to form the tip, although any composite rod consisting of a plastics piece and a fiber bundle connector bonded thereto are employable, too. Instead of them, any tip of the so-called 'writing brush' type may be used.

The distal end of tip 202 protrudes forwards beyond the distal end of main body 203, for convenience in writing characters or drawing strokes. The tip's proximal end is in contact with or in the vicinity of the bottom 204*b* of slit valve 204. The tip 202 is composed of a forward large-diameter portion 202*a* and a rear small-diameter one 202*b* integral therewith. Outer diameter of the latter portion 202*b* is designed smaller than inner periphery of the cylindrical portion 204*a* of the slit valve. However, a circumcircle enclosing all the apertures 209 is substantially included in the smaller diameter in projection.

A proximal stopper 206 is attached to the proximal end of main body 203. This stopper comprises a lid 206*a* and a short cylindrical portion 206*b* forwardly continuing therefrom. The cylindrical portion 206*b* of an outer diameter matching the inner diameter of the main body 203 is liquid-tightly fitted therein.

In operation, the applicator 201 stands at a position as shown in FIG. 37 wherein the bottom 204*b* of slit valve 204 is not yet deformed, since the inner face of tip 202 located in front of said bottom is not acting thereon.

When writing is started by pushing back the tip 202 a small distance, the bottom 204*b* of slit valve 204 will be deformed to a relatively slight extent as shown in FIG. 38. Consequently the slit 208 in the bottom 204*b* is spread somewhat wide to provide a passage through said bottom. The ink stored in reservoir 210 will thus be allowed to flow through the apertures 209 and this passage and then reach the tip 202, rendering the applicator ready for use to do writing.

If the tip is pressed too strongly, then the slit valve's bottom 204*b* will be deformed extremely as shown in FIG. 39. In this state, the bottom 204*b* is in a forced contact with the front face of partition 205, closing the apertures 209. This means that the slit valve 204 opened too wide by overly pressing back the tip will rather result in the closing of said valve. By virtue of this feature, any excessive amount will not be supplied to the tip and thus any problem of ink dripping will not take place.

Elastic recovery of the slit valve 204 will return the tip to its forward home position, upon release of the user's writing pressure that has been being imparted to the tip. At this home position is shown in FIG. 37, the slit valve 204 is closed to disable ink feed.

Figure 40:
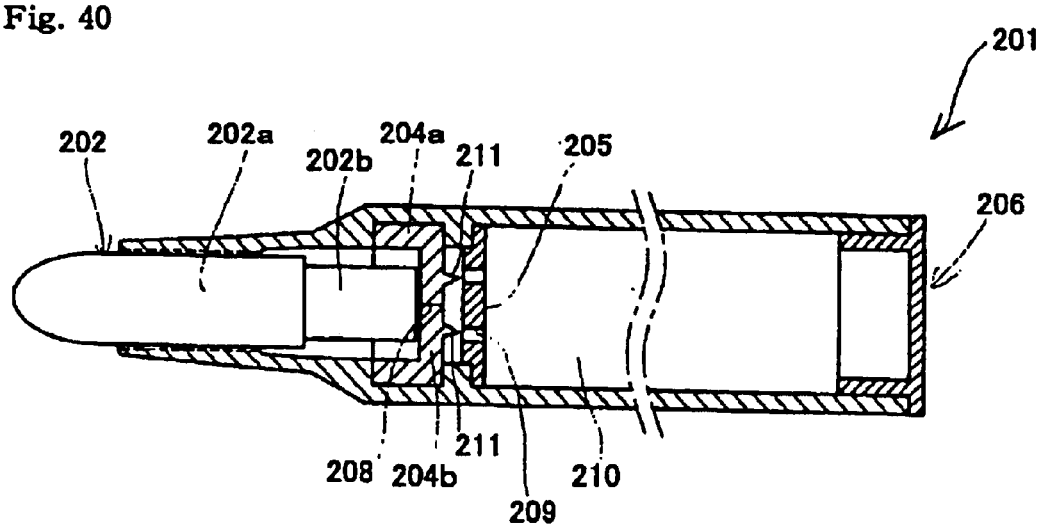
FIG. 40 is a vertical cross section of an applicator provided in yet another embodiment of the present invention.

FIG. 40 shows another example of the slit valve 204, wherein lugs 211 are formed on the rear face of the bottom 204*b*, which the elastic cylindrical member in this case does likewise comprise. Those apertures 209 as in the preceding example are at their positions facing the lugs 211, respectively. Therefore, with the bottom 204 being deformed, these lugs will enter the respective apertures 209, thereby more surely closing them. Further in this example, the slit valve need not be cylindrical in shape but may be a simple disc, block or any other proper piece. Further, the slit valve may be designed such that natural writing pressure will open it, or only an extraordinary pressure can open it.

Twentieth Embodiment

Figure 41:
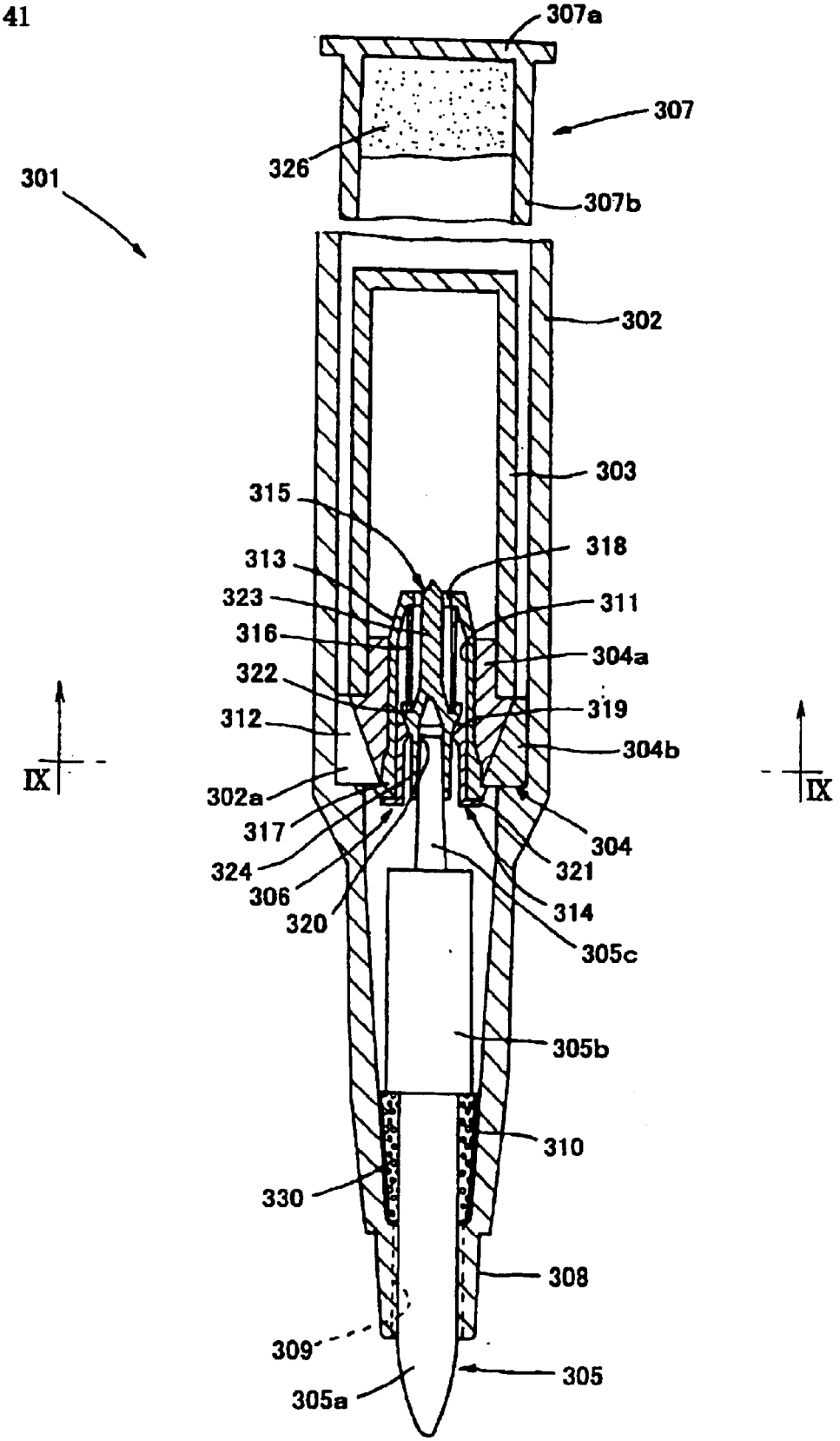
FIG. 41 is a vertical cross section of an applicator provided in a yet further embodiment of the present invention.
Figure 42:
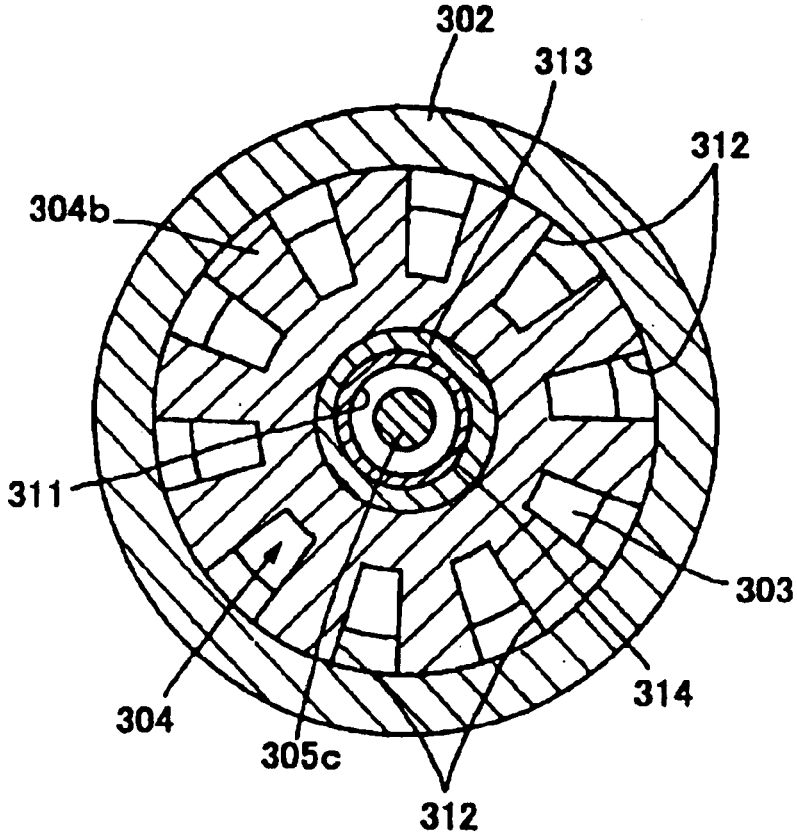
FIG. 42 is a cross section taken along the line IX—IX in FIG. 41.

FIGS. 41 and 42 a twentieth embodiment, wherein an applicator 301 does also have a tip 305 of the fiber bundle type. This applicator comprises a pen body or external cylinder (external main body) 302, an ink reservoir 303, a distal stopper 304, the fiber bundle tip 305, a valve assembly 306 and a proximal stopper 307.

The external cylinder 302 is of an elongated cylindrical article, that is made of a plastics such as a polypropylene, or made of a metal such as aluminum or a stainless steel. A tapered and thin distal end of external cylinder 302 serves herein as a tip-holding portion 308, in which portion the tip 305 is tightly fitted to slide fore and aft. An air inlet may be formed in any convenient portion of the external cylinder 302, and in this embodiment vertical grooves 309 formed in the inner periphery of cylindrical portion 308 cooperate with ribs 310 to provide the air inlet opened to the outside. Those ribs 310 provide a clearance between the external cylinder's 302 inner periphery and a urethane foam 330 (detailed below). However, the air inlet may be formed directly in and through the peripheral wall of external cylinder 302. Any desired cap (not shown) may be removable attached to the distal end of main body 2.

The ink reservoir 303 is a cylinder made of a plastics such as a polypropylene, or of a metal such as aluminum or stainless steel. This reservoir 303 held in place in the external cylinder 302 is hollow to store the ink, and has an outer diameter smaller than the inner diameter of said cylinder 302 so as to define a space between them.

The distal stopper 304 made of the same or similar material is disposed at a location between opposite ends of the external cylinder 302. An axial bore 311 is formed through this stopper in axial direction, and a rear portion 304*a* of the stopper 304 is cylindrical in shape to be fitted in the distal end of the reservoir 303. A fore part of stopper 304 extends radially and outwards to provide an enlarged diameter portion 304*b*, which is fitted in the external cylinder 302 and is supported at its fore face with a shoulder 302*a* formed in the inner periphery of external cylinder 302. Slits (communication holes) 312 are formed in the outer periphery of the stopper 304 so as to allow communication between the fore and rear spaces separated from each other with this topper.

The valve assembly 306 comprises a support 313, a valve seat-providing member 314, a valve body 355 and a biasing member 316.

The support 313 is an article made of a hard plastics or the like to be generally cylindrical-shaped or a frame-shaped. This support is fitted in the axial bore 311 of distal stopper 304. A flange 317 protrudes outwards and radially from the fore end of support 313, with its rear face being born by the fore end face of distal stopper 304. An opening 318 formed in the inner end of the support's rear end is in communication with the interior of reservoir 303. Such an opening may alternatively formed in the periphery of support 313.

The valve seat-providing member 314 is a cylindrical piece tightly inserted in the support 313, and has at its rear end a valve seat 319. An axial ink feed bore 320 is formed through this seat 319. The valve seat-providing member 314 has also an outwardly extending flange 321 in contact with the fore end face of the support 313.

The valve body 355 comprises a conical and closing member 322 capable of contacting and resting on the valve seat 319 so as to close an ink feed bore 320. The closing member 322 has a stem 323 extending rear-wards and formed integral with this member. This rear stem 323 extends through the opening 318 present at rear end of support 313 in such a fashion that axial displacement is allowed to this rear stem. The closing member 322 has a hollow shaft 324 that protrudes forwards from this member.

In this way, the valve seat-providing member 314 is incorporated in the support 313, and the closing member 322 is disposed between rear portions or rear ends of said member 314 and support 313. The hollow shaft 324 forming the fore portion of valve body 355 is disposed inside the valve seat-providing member 314, with the rear stem 323 inserted in and through the rear opening 318. Thus, the valve body 355 can move within a space that is defined between rear portions or rear ends of said member 314 and support 313.

A compression coiled spring (biasing member) is fitted on the rear stem 323 of valve body 355, coaxially therewith. One end of the spring 316 is secured to fore face of the support 313, with the other end to rear face of the closing member 322. The valve body 355 is always pressed on the valve seat 319 in this way, to close the valve opening 320.

The tip 305 may be composed of any known material such as a resin or a fiber so that it can exude ink due to capillary action. Any proper material may be used alone to form the tip, although any composite rod consisting of a plastics piece and a fiber bundle connector bonded thereto are employable, too. Instead of them, any tip of the so-called 'writing brush' type or a length of thin metal tube may be used.

The distal end of tip 305 protrudes forwards beyond the distal end of external cylinder 302, for convenience in writing characters or drawing strokes. The tip's proximal end is in contact with the valve body 355 of the valve assembly 306.

The tip 305 is composed of a forward large-diameter portion 305*a*, a middle large-diameter portion 305*b* and a rear thin portion 305*c*, all integral with each other. Outer diameter of the middle portion 305*b* is designed smaller than inner periphery of the external cylinder 302, so as to define a space between this and the rear portion of tip 305. The space surrounding the rear portion of tip 305 communicates with the other space present between the reservoir 303 and external cylinder 302.

In the external cylinder 302 and in rear of the tip holding portion 308 thereof, a cylindrical mass of urethane foam 330 is secured. A superfluous amount of ink will be absorbed by this urethane foam serving as an ink storage, and later this foam will occasionally supplement the ink in the tip from time to time. The urethane foam 330 has its inner end bearing against the shoulder formed between the small diameter and large diameter portions 305*a* and 305*b*. This arrangement, that the tip 305 is urged inwards by this foam 16 but with a force weaker than the spring 316 urging the tip outwards, is useful to avoid rickety motion of the tip and unintentional opening of the valve assembly 306.

A proximal stopper 307 is attached to the proximal end of external cylinder 302. This stopper comprises a lid 307*a* and a short cylindrical portion 307*b* forwardly continuing therefrom. The cylindrical portion 307*b* of an outer diameter matching the inner diameter of the external cylinder 302 is fitted therein. An anti-drying agent 326 packed in the portion 307*b* of proximal stopper 307 is mainly composed of a piece of sponge or the like porous material, or a block of a highly water-absorptive polymer. The agent 17 is impregnated with water that is a solvent of the ink stored in the reservoir. In a case wherein the application liquid is an oily ink, the porous material may be impregnated with an alcohol or the like solvent, or may be replaced with a gel of the organic solvent.

In operation, the applicator 301 provided in this embodiment will have its valve body 355 maintained closed so long as it is left non-used. This is because the spring 316 continues to urge the valve body 355 towards the valve seat 319. Thus, the ink fed opening 320 is closed and any positive feed of ink is not effected in this state from the reservoir 303 to the tip 305.

When writing is done, the writing pressure will be imparted to the tip 305 to push back the valve body 355 to open the ink feed opening 320 opening the valve to start ink feed to the tip. Thus, the ink will flow from out of the reservoir towards the space surrounding the rear region of tip 305, whereby the ink absorbed by the tip 305 will be exuded forwards due to capillary action to enable the writing on a paper sheet or the like.

Water contained in the anti-drying agent 326 will evaporate at any ambient temperature, producing vapor to diffuse into the space between the external cylinder 302 and reservoir 303. This space is in communication with the other space present between the tip's rear portion and the external cylinder 302,through the slits 312 formed in the distal stopper 304. Thus, humidity in air of the latter space is maintained at a somewhat high level so as to suppress evaporation of solvent out of the tip 305.

The ink reservoir may be made integral with the distal stopper, and also the valve assembly may be directly formed in the fore end portion the of ink reservoir. The outer main body may not necessarily be of a cylindrical shape, but be of any other desired shape.

This application is based on patent applications Nos. Hei 11-261145, Hei 11-261146, Hei 11-261147, Hei 11-261148, Hei 11-261149, Hei 11-261150, Hei 11-261151, Hei 11-261152, Hei 11-261153, Hei 11-261154, Hei 11-261155, Hei 11-261156, Hei 11-261157, Hei 11-261158 filed in Japan, the content of which is incorporated hereinto by reference.

All the foregoing embodiments are intended to exemplify the wide range of concepts that are included in the scope of this invention. Therefore, many modifications or improvements may be possible without departing the technical ideas disclosed herein above. The species of the present invention that are listed below and based on the embodiments will implicitly indicate that some of the species may be claimed in the present application, and the other species may be claimed in any divisional applications that will be filed later.

List of Species of the Invention 1.1 A device for supplying an application liquid, the device comprising: a reservoir for holding therein a given amount of the application liquid; a liquid-supplying valve assembly disposed in a distal region of the reservoir; the valve assembly comprising a valve chamber having a valve seat, with the seat having an opening opened forwardly; a valve body accommodated in the chamber and movable fore and aft to rest on and depart from the seat; and a flow restrainer also placed in the chamber and movable fore and aft and disposed in rear of the valve body, the device further comprising a biasing member disposed in rear of the flow restrainer such that this member urges the valve body through the restrainer towards the seat.

1.2 The device as defined in the item 1.1, wherein clearance appearing between the valve chamber inner wall and the valve body having departed from its seat is designed larger than the clearance between the flow restrainer and said wall.

1.3 The device as defined in the item 1.1, wherein the flow restrainer is a ball having a larger diameter than the valve body of a spherical shape.

1.4 The device as defined in the item 1.1, wherein the flow restrainer is a columnar member having a larger diameter than the valve body of a spherical shape.

1.5 Applicator comprising a pen-point tip disposed in front of the liquid-supplying valve assembly, the tip having its rear end in contact with the distal portion of the valve body, whereby in use application pressure imparted to the tip will push back the valve body so that the liquid is fed thereto through the valve at a moderately low rate.

1.6 The applicator as defined in the item 1.5, wherein the reservoir is a cylindrical member disposed in an external cylinder having a distal end to which the tip is connected to be retractable.

2.1 An applicator comprising: a reservoir for holding therein a given amount of an application liquid; a valve assembly disposed in a distal region of the reservoir; the valve assembly comprising: a valve chamber having a forward opening; a valve body accommodated in the chamber and movable fore and aft to rest on and depart from the seat; and a biasing member for urging the valve body to be pressed against a circular rim around the opening so as to close it, the applicator further comprising a tip in front of the valve so that a distal portion of the valve body is in contact with a rear end of the tip, wherein the application liquid stored in the reservoir has a viscosity of 100 mPa·s or less, and the applicator further comprises a follower in the reservoir and in rear of the column of the liquid so as to control flow rate of the liquid flowing out through the valve chamber opening, the follower serving also as a back-flow inhibitor for the application liquid, and a viscous material forming the follower shows the value of '2' or less as the ratio of its viscosity at 5° C. to that at 35° C.

2.2 An applicator comprising: a reservoir for holding therein a given amount of the application liquid; a valve assembly disposed in a distal region of the reservoir; the valve assembly comprising: a valve chamber having a forward opening; a valve body accommodated in the chamber and movable fore and aft to rest on and depart from the seat; and a biasing member for urging the valve body to be pressed against a circular rim around the opening so as to close it, the applicator further comprising a tip in front of the valve so that a distal portion of the valve body is in contact with a rear end of the tip, wherein the application liquid stored in the reservoir may has a viscosity of 100 mPa·s or less, and the applicator further comprises a back-flow inhibitor in the reservoir and in rear of the column of the liquid so as to control flow rate of the liquid flowing out through the valve chamber opening, the back-flow inhibitor being formed of a silicone oil.

3.1 An applicator comprising: a reservoir for holding therein a given amount of the application liquid; a valve assembly disposed in a distal region of the reservoir; the valve assembly comprising: a valve chamber having a forward opening; a valve body accommodated in the chamber; and a biasing member for urging the valve body to be pressed against a circular rim around the opening so as to close it, the applicator further comprising a tip in front of the valve so that a distal portion of the valve body is in contact with a rear end of the tip protruding forwardly from the distal opening, wherein the tip has an outer periphery coated with a plastics or with a metal, with the rear face of the tip not covered with the plastics or metal.

3.2 An applicator comprising: a reservoir for holding therein a given amount of the application liquid; a valve assembly disposed in a distal region of the reservoir; the valve assembly comprising: a valve chamber having a forward opening; a valve body accommodated in the chamber; and a biasing member for urging the valve body to be pressed against a circular rim around the opening so as to close it, the applicator further comprising a tip in front of the valve so that a distal portion of the valve body is in contact with a rear end of the tip protruding forwardly from the distal opening, wherein the proximal portion of the tip, the valve assembly and the reservoir are all incorporated in an external cylinder, and the tip has an outer periphery coated with a plastics or with a metal.

3.3 The applicator as defined in the item 3.1 or 3.2, wherein the tip is composed of a smaller diameter distal portion and a larger diameter proximal portion continuing therefrom, and only the larger diameter portion is coated with the plastics or metal.

3.4 The applicator as defined in the item 3.1 or 3.2, wherein the valve chamber is a cylindrical member constricted at its distal end, and preferably the tip has its proximal face of a diameter larger than that of the chamber distal end, the cylindrical member disposed in the external cylinder is held in place in and by a distal stopper that is secured to the distal end of the reservoir, such that the forward end of the distal stopper is located in rear of the forward end of the valve body protruding out of the valve opening, but in front of the forward end of the cylindrical member forming the valve chamber, whereby the plastics or metal covering the outer periphery of the tip preferably is allowed to abut against the forward end of the distal stopper.

3.5 An applicator comprising: a reservoir for holding therein a given amount of the application liquid; a distal stopper disposed in a distal region of the reservoir; an application liquid-feeding valve assembly secured in the distal stopper; a tip disposed in front of the valve assembly, the valve assembly comprising: a valve chamber having a valve seat with a forward opening and having a proximal region opened into the reservoir; a valve body accommodated in the chamber and movable fore and aft to rest on and depart from the seat; and a biasing member disposed behind the valve body so as to urge it to rest on the seat, with the distal portion of the valve body being in contact with a rear end of the tip, wherein the distal stopper is entirely or partially made of a gas permeating material, and this material is exposed inside the reservoir and in a space around the tip.

3.6 The applicator as defined in the item 3.5, wherein the outer diameter of the tip rear end is twice or more as large as the inner diameter of the distal opening of the liquid-supplying valve assembly, and further comprising a stopping protrusion formed on the outer periphery of the valve chamber so as to occasionally bear against the rear face of the tip for the purpose of restricting its retraction.

3.7 The applicator as defined in the item 3.5, wherein the ink reservoir is cylindrical in shape, and the distal stopper consists of a stopper body and a sealant, the stopper body being made of a metal or a hard plastics and having a large diameter portion and a small diameter portion fitted in the sealant, the sealant intervening between the outer periphery of the small diameter portion and the inner periphery of the reservoir, with the large diameter portion being in a direct contact with the reservoir inner periphery, so that communication holes penetrating the large diameter portion fore and aft whereby the sealant has its surface areas exposed to openings of the communication holes.

3.8 The applicator as defined in the item 3.7, wherein the sealant is a ring formed of a silicone rubber.

3.9 The applicator as defined in the item 3.5, wherein the distal stopper is a ring entirely formed of an elastic material, with the valve chamber being inserted in and through such a stopper.

3.10 The applicator as defined in the item 3.9, wherein the sealant is a ring formed of a silicone rubber.

3.11 An applicator comprising: a reservoir for holding therein a given amount of the application liquid; a valve assembly disposed in a distal region of the reservoir; the valve assembly comprising: a valve chamber having a forward opening; a valve body accommodated in the chamber; and a biasing member for urging the valve body to be pressed against a circular rim around the opening so as to close it, the applicator further comprising: a tip in front of the valve so that a distal portion of the valve body is in contact with a rear end of the tip, wherein the tip's rear portion, the valve assembly and the ink reservoir are all disposed inside an external cylinder, and there are formed two closed spaces, one between the rear portion and the external cylinder, the other between the reservoir and this cylinder, and in the latter closed space communicating with the former, an anti-drying agent for the tip is disposed.

3.12 The applicator as defined in the item 3.11, wherein the anti-drying agent is such a material as absorbing and retaining a solvent of the ink or the like application liquid stored in the reservoir.

3.13 The applicator as defined in the item 3.11, wherein both the reservoir and the external cylinder are cylindrical in shape, and the rear end of the external cylinder is closed, with the anti-drying agent is disposed near the rear end.

3.14 The applicator as defined in the item 3.11, wherein both the reservoir and the external cylinder are cylindrical in shape, and a rear stopper is fitted in the rear end of the external cylinder, with the anti-drying agent disposed in the rear stopper.

3.15 The applicator as defined in the item 3.13 or 3.14, wherein a valve holder for fixedly supporting the valve assembly is formed in and at a middle region of the external cylinder, and holes penetrating the holder provides fluid-communication between the first and second closed spaces.

4.1 An applicator comprising: a reservoir for holding therein a given amount of the application liquid; a valve assembly disposed in a distal region of the reservoir; the valve assembly comprising; a valve chamber having a forward opening; a valve body accommodated in the chamber and movable fore and aft; and a biasing member for imparting an urging elastic force to the valve body to close the opening, the applicator further comprising a tip in front of the valve so that a distal portion of the valve body is in contact with a rear end of the tip, wherein the 'spring factor' of the biasing member is 0.1 kgf/mm or higher.

4.2 An applicator comprising: a reservoir for holding therein a given amount of the application liquid; a valve assembly disposed in a distal region of the reservoir; the valve assembly comprising; a valve chamber having a forward opening; a valve body accommodated in the chamber and movable fore and aft; and a biasing member for imparting an urging elastic force to the valve body to close the opening, the applicator further comprising a tip in front of the valve so that a distal portion of the valve body is in contact with a rear end of the tip, wherein the 'spring factor' of the biasing member is 0.5 kgf/mm or higher.

4.3 The applicator as defined in the item 4.1 or 4.2, wherein the biasing member is designed such that the valve body does close surely and tightly the valve chamber opening with a forward force weaker than its intrinsic force, under the condition that the valve body is capable of being retracted by an actual and external backward force away from the opening until it takes a lifted position where the intrinsic and external forces are balanced with each other.

4.4 An applicator comprising: a reservoir for holding therein a given amount of the application liquid; a valve assembly disposed in a distal region of the reservoir; the valve assembly comprising; a valve chamber having a forward opening; a valve body accommodated in the chamber; and a biasing member for imparting an urging elastic force to the valve body to close the opening, the applicator further comprising a tip in front of the valve so that a distal portion of the valve body protruding forwards from the opening is in contact with a rear end of the tip, this tip capable of being pressed back by the application pressure and against the urging force until it departs from the opening, wherein the biasing member, having undergone elastic deformation due to the writing pressure transmitted through the tip and ball, does exert an increased force that is 1.5 times or more as strong as the initial valve closing force.

5.1 An applicator comprising: a reservoir for storing therein an amount of an application liquid; a liquid-supplying valve assembly disposed in a distal portion of the reservoir; the valve assembly comprising a valve body and an biasing member so that the valve body accommodated in a valve chamber having a forward opening is urged by the biasing member to bear against a rim around the opening so as to close it, the applicator further comprising an applying tip disposed in front of the valve assembly, so that a rear end of the tip is kept in contact with a forward portion of the valve body, wherein a check valve is interposed between the valve assembly and the reservoir.

5.2 The applicator as defined in the item 5.1, wherein the check valve consists of a spherical valve body and a valve seat having a bore, the bore communicating with the interior of the reservoir, with the valve body being capable of moving fore and aft due to gravitational force and capable of closing the check valve when the applicator is put upside down.

5.3 The applicator as defined in the item 5.2, further comprising a distal stopper disposed in a forward end of the reservoir and has an axially extending aperture for feeding the application liquid, wherein the valve assembly is secured in a distal region of the distal stopper, with the check valve being likewise secured in a proximal region of said stopper.

5.4 The applicator as defined in the item 5.3, wherein a valve seat of the check valve is formed in the proximal region of the distal stopper and around the axially extending aperture or bore so that distal end thereof serves as the valve opening, the spherical valve body of the check valve is placed in a middle region of said aperture of bore, wherein a fine clearance is defined between the outer periphery of the spherical valve body and the inner periphery of said aperture or bore, and a displacement-limiting member also formed in said middle region is located ahead the spherical valve body, thereby keeping forward motion thereof within limits.

6.1 An applicator comprising: a cylindrical reservoir for storing therein a given amount of the application liquid; a valve assembly secured to the distal region of the reservoir; the valve assembly comprising a valve chamber having a forward opening; a valve body placed in the chamber; and a biasing member for urging the valve body to be pressed on a rim defining the opening so as to close it, the applicator further having: an applying tip whose rear end is in contact with the valve body; a back-flow inhibitor arranged in rear of the column of the liquid; the inhibitor being capable of sliding within the reservoir to follow the column, as the liquid is gradually consumed; an air inlet is formed in the rear end of the reservoir; and an obstructer for preventing the back-flow inhibitor from moving in a reverse direction, wherein the obstructer is disposed in or near the rear end of the reservoir.

6.2 The applicator as defined in the item 6.1, wherein the obstructer is formed by deforming a portion of the reservoir.

6.3 The applicator as defined in the item 6.1, wherein the obstructer is a plug-shaped member fixedly fitted in the rear opening of the reservoir.

6.4 The applicator as defined in the item 6.1, wherein the obstructer is a resin foam fitted in the rear opening of the reservoir such that the resin foam serves as the obstructer and also as the air inlet, at the same time.

6.5 The applicator as defined in the item 6.1, wherein the reservoir is installed in an external cylinder having a proximal stopper attached thereto, such that forward portion of the proximal stopper is exposed in the reservoir so as to serve as the obstructer.

7.1 An applicator comprising: a cylindrical reservoir for storing therein a given amount of the application liquid; a valve assembly secured to the distal region of the reservoir; the valve assembly comprising a valve chamber having a forward opening; a valve body placed in the chamber; and a first biasing member for urging the valve body to be pressed on a rim defining the opening so as to close it, the applicator further having an applying tip whose rear end is in contact with the valve body, wherein the applicator further comprise a second biasing member incorporated therein so that it urges backwards the tip with an urging force weaker than that of the first biasing member.

7.2 The applicator as defined in the item 7.1, wherein the tip is composed of a distal small diameter portion integral with a proximal large diameter portion, so that the second biasing member is disposed in a stepped region present between those small diameter and large diameter portions.

7.3 The applicator as defined in the item 7.2, wherein the second biasing member is a cylindrical polyurethane piece fitted on the small diameter portion. 7.4 The applicator as defined in the item 7.2, wherein the second biasing member fitted on the small diameter portion of the tip is a liquid-absorptive cylindrical piece capable absorbing the application liquid.

8.1 An applicator comprising: a cylindrical reservoir for storing therein a given amount of the application liquid; a valve assembly secured to the distal region of the reservoir:

the valve assembly comprising: a valve chamber having a forward opening; a valve body placed in the chamber; and a biasing member for urging the valve body to be pressed on a rim defining the opening so as to close it, the applicator further having an applying tip whose rear end is in contact with forward end of the valve body protruding forwards from the valve opening, wherein the applicator further has a tip stopper incorporated therein so that tip retraction beyond a limit is inhibited, and the distal end of valve chamber is located in rear of the proximal end of the tip which the tip stopper supports, the valve chamber being a cylinder whose distal end portion constricted forwards.

8.2 An applicator comprising: a cylindrical reservoir for storing therein a given amount of the application liquid; a valve assembly secured to the distal region of the reservoir: the valve assembly comprising: a valve chamber having a forward opening; a valve body placed in the chamber; and a biasing member for urging the valve body to be pressed on a rim defining the opening so as to close it, the applicator further having an applying tip whose rear end is in contact with forward end of the valve body protruding forwards from the valve opening, wherein the applicator further has a tip stopper incorporated therein, the tip stopper is disposed around the forward end of the valve chamber and has an engageable portion capable of bearing against the rear face of the tip that is retracted, and the engageable portion is located behind the valve body's distal portion protruding forwards from the valve opening, but ahead the distal end of the valve chamber.

8.3 The applicator as defined in the item 8.1 or 8.2, further comprising a valve rest for delimiting retraction distance of the valve body, so that there is provided a space between the rest and the forward opening of the valve chamber, in which space the valve body is capable of reciprocating fore and aft, with the valve body engaging the valve rest, its forward end is positioned behind the valve chamber's forward end.

8.4 The applicator as defined in the item 8.2, further comprising a valve rest for delimiting retraction distance of the valve body, so that there is provided a space between the rest and the forward opening of the valve chamber, in which space the valve body is capable of reciprocating fore and aft, with the valve body engaging the valve rest, its forward end takes a position protruding forwards from the valve opening but behind the tip stopper's engageable portion then in contact with the tip's rear end face.

9.1 An applicator comprising: a reservoir for storing a given amount of an application liquid; a tip disposed in front of the reservoir and movable fore and aft; a valve assembly for enabling and disabling feed of the liquid from the reservoir to the tip; the valve assembly comprising: a valve seat having a forward opening; a valve body disposed behind the valve seat; a valve stopper for supporting the valve body at its rear end so as to press the valve body onto the seat to thereby close the forward opening; a valve chamber defined as a space between the valve stopper and the seat so that the valve body is accommodated in the chamber; and a passage for allowing the liquid to flow from the reservoir into the chamber, wherein the passage is formed through the valve stopper, and the valve body is formed of an elastic material compressible in a fore-and-aft direction when pushed with the tip moving backwards.

9.2 The applicator as defined in the item 9.1, wherein the valve body is of a spherical shape.

9.3 The applicator as defined in the item 9.1, wherein the valve body is of a property that it closes the passage in the valve stopper, in response to pressure above a predetermined value.

9.4 The applicator as defined in the item 9.2, wherein the valve chamber is of a cylindrical shape so that the valve body will engage at its entire circumference along its equator with the inner periphery of the chamber, in response to pressure above a predetermined value.

9.5 An application liquid-supplying valve assembly for incorporation in an applicator and designed to feed the liquid from a reservoir to a writing tip upon retraction thereof, the valve assembly comprising: a valve chamber having a liquid supplying forward opening; a valve body accommodated in the chamber; a valve stopper for supporting the valve body to cause it to close the forward opening; and a passage for the liquid, the passage being formed in the valve supporter, wherein the valve body is made of a material such as silicone rubber capable of elastic deformation so that the valve body is capable of being compressed or expanded fore and aft in axial direction, to thereby open or close the forward opening.

9.6 The valve assembly as defined in the item 9.5, wherein the valve body is of a spherical shape.

9.7 The valve assembly as defined in the item 9.5, wherein the valve body is of a property that it closes the passage in the valve stopper, in response to pressure above a predetermined value.

9.8 The valve assembly as defined in the item 9.6, wherein the valve chamber is of a cylindrical shape so that the valve body will engage at its entire circumference along its equator with the inner periphery of the chamber, in response to pressure above a predetermined value.

10.1 An applicator comprising: an applying tip, an application liquid-storing reservoir, the tip being held in place either by a body of the applicator or by a tip holder secured to a distal portion of the applicator body so as to move fore and aft, the reservoir being designed to dispense therefrom the application liquid, in response to retraction of the tip, and a resistant member for restricting displacement of the tip within limits, wherein the resistant member is made of a buffering material such as a silicone rubber.

10.2 The applicator as defined in the item 10.1, wherein the resistant member is disposed to engage with a stepped region formed in the tip and intermediate the forward and rearward ends thereof.

10.3 The applicator as defined in the item 10.1, wherein the resistant member is disposed at a location to abut against the proximal end of the tip.

10.4 The applicator as defined in the item 10.1, wherein the resistant member is disposed at such a location that it abuts against a valve body driven backward by the tip, to thereby stop the tip.

11.1 An applicator comprising: a liquid reservoir for storing therein an application liquid; an applying tip disposed in front of the reservoir and capable of moving fore and aft; and a valve assembly intervening between the reservoir and the tip, wherein the valve assembly is normally closed, and capable of opening in response to retraction of the tip by a relatively short distance, in such a state that a further retraction of the tip by a relatively longer distance will close again the valve assembly.

11.2 An applicator comprising: a liquid reservoir; a slit valve disposed on the distal end of the reservoir; an applying tip disposed in front of the slit valve and capable of moving fore and aft; the slit valve capable of elastic deformation when pressed with the tip retracting in use, to thereby form a temporary opening through which the liquid will be delivered to the tip from the reservoir, with this temporary opening capable of being closed when the tip returns to its forward home position; and a passage disposed in rear of the slit valve's proximal portion so as to guide thereto the liquid from the reservoir, wherein the passage remains opened so long as elastic deformation of the slit valve is below a limit, but capable of being closed when the elastic deformation is increased to exceed the limit.

11.3 The applicator as defined in the item 11.2, wherein the slit valve is a short elastic cylinder with a closed bottom through which slits are formed, wherein the slits penetrating the bottom are capable of opening rearwards to communicate with the interior of the reservoir through the passage, and the passage is closed when leaves in the bottom defining the slits are forcibly pressed against the reservoir.

12.1 An applicator comprising: an application liquid-storing reservoir; a passage formed in the distal end of the reservoir so as to allow the liquid to flow therethrough; a valve assembly for opening and closing the passage; a biasing member urging forwards the valve assembly so as to close the passage, and a tip disposed in front of the reservoir; the tip having its rear end in engagement with the valve assembly such that the passage is opened to feed the liquid to and around the tip's rear end when the tip is pushed back against the urging force of the biasing member, wherein at least a rear portion of the tip is enclosed in an external cylinder together with the valve assembly and the reservoir so that two closed spaces are formed, one between the tip rear portion and the external cylinder, the other between the reservoir and the external cylinder, with the former space communicating with the latter space in which an anti-drying agent is disposed.

12.2 The applicator as defined in the item 12.1, wherein the anti-drying agent contains a liquid that is useable as or compatible with a solvent to prepare the application liquid.

12.3 The applicator as defined in the item 12.1, wherein both the reservoir and the external cylinder are of a cylindrical shape, and the latter has its rear end closed, so that the anti-drying agent is disposed therein.

12.4 The applicator as defined in the item 12.1, wherein both the reservoir and the external cylinder are of a cylindrical shape, and a proximal stopper is fitted in the rear end of the external cylinder, with the anti-drying agent being held in the proximal stopper.

12.5 The applicator as defined in the item 12.3 or 12.4, wherein a valve holder for fixedly supporting the valve assembly in and at a middle region of the external cylinder, and holes penetrating the holder serve as a passage through which the first and second closed spaces communicate with each other.

What is claimed is:

1. An applicator comprising: a reservoir for storing therein a given amount of an application liquid; and a valve assembly secured to a distal region of the reservoir, the valve assembly comprising a valve chamber having a forward opening, a valve body placed in the valve chamber, and a biasing member for urging the valve body to be pressed on a rim defining the opening so as to close the opening;

the applicator further comprising an applying tip with a rear end that is in contact with a forward end of the valve body protruding forwards from the valve opening; and wherein the applicator further comprises a tip stopper incorporated therein so that tip retraction beyond a limit is inhibited, and a distal end of the valve chamber is located in rear of a proximal end of the tip which the tip stopper supports, the valve chamber being a cylinder with a distal end portion that is constricted forwards, wherein the valve assembly is a liquid-supplying valve assembly and comprises a valve chamber having a valve seat, with the valve seat having an opening opened forwardly, a valve body accommodated in the chamber and movable fore and aft to rest on and depart from the seat, and a flow restrainer also placed in the chamber and movable fore and aft and disposed rear of the valve body, the applicator further comprising a biasing member disposed rear of the flow restrainer such that the biasing member urges the valve body through the restrainer towards the seat.

2. An applicator comprising: a reservoir for storing therein a given amount of an application liquid; and a valve assembly secured to a distal region of the reservoir, the valve assembly comprising a valve chamber having a forward opening, a valve body placed in the valve chamber, and a biasing member for urging the valve body to be pressed on a rim defining the opening so as to close the opening;

the applicator further comprising an applying tip with a rear end that is in contact with a forward end of the valve body protruding forwards from the valve opening;

wherein the applicator further comprises a tip stopper incorporated therein, the tip stopper is disposed around a forward end of the valve chamber and has an engageable portion capable of bearing against a rear face of the tip that is retracted, and the engageable portion is located behind a distal portion of the valve body protruding forwards from the valve opening, but ahead of a distal end of the valve chamber, said applicator further comprising a valve rest for delimiting retraction distance of the valve body, so that there is provided a space between the valve rest and a forward opening of the valve chamber, in which space the valve body is capable of reciprocating fore and aft, with the valve body engaging the valve rest, a forward end of the valve body takes a position protruding forwards from the valve opening but behind an engageable portion of the tip stopper then in contact with a rear end face of the tip.

3. An applicator comprising: a reservoir for storing therein an amount of an application liquid; and a liquid-supplying valve assembly disposed in a distal portion of the reservoir, the valve assembly comprising a valve body and a biasing member so that the valve body accommodated in a valve chamber having a forward opening is urged by the biasing member to bear against a rim around the opening so as to close the opening;

wherein the applicator further comprises an applying tip disposed in front of the valve assembly, so that a rear end of the tip is kept in contact with the valve body;

wherein the applicator further comprises a tip stopper incorporated therein so that tip retraction beyond a limit is inhibited, and a distal end of the valve chamber is located in rear of a proximal end of the tip which the tip stopper supports, the valve chamber being a cylinder with a distal end portion constricted forwards; and wherein a check valve is interposed between the valve assembly and the reservoir.

4. An applicator as defined in claim 3, wherein the check valve consists of a spherical valve body and a valve seat having a bore, the bore communicating with the interior of the reservoir, with the valve body capable of moving fore and aft due to gravitational force and capable of closing the check valve when the applicator is put upside down.

5. An applicator as defined in claim 4, further comprising a distal stopper disposed in a forward end of the reservoir and having an axially extending aperture for feeding application liquid, wherein the valve assembly is secured in a distal region of the distal stopper, with the check valve being secured in a proximal region of the distal stopper.

6. An applicator as defined in claim 5, wherein a valve seat of the check valve is formed in a proximal region of the distal stopper and around the axially extending aperture so that a distal end thereof serves as the valve opening, the spherical valve body of the check valve is placed in a middle region of said aperture, wherein a fine clearance is defined between the outer periphery of the spherical valve body and an inner periphery of said aperture, and a displacement-limiting member also formed in said middle region is located ahead the spherical valve body, thereby keeping forward motion thereof within limits.

7. An applicator comprising: a reservoir for storing therein a given amount of an application liquid; and a valve assembly secured to a distal region of the reservoir;

the valve assembly comprising a valve chamber having a forward opening, a valve body placed in the chamber, and a first biasing member for urging the valve body to be pressed on a rim defining the opening so as to close the opening, wherein the applicator further comprises an applying tip having a rear end that is in contact with the valve body;

wherein the applicator further comprises a tip stopper incorporated therein so that tip retraction beyond a limit is inhibited, and a distal end of the valve chamber is located rear of a proximal end of the tip which the tip stopper supports, the valve chamber being a cylinder with a distal end portion constricted forwards; and wherein the applicator further comprises a second biasing member incorporated therein that urges backwards the applying tip with an urging force weaker than a force generated by the first biasing member.

8. An applicator as defined in claim 7, wherein the applying tip comprises a distal small diameter portion integral with a proximal large diameter portion, so that the second biasing member is disposed in a stepped region between the small diameter and large diameter portions.

9. An applicator as defined in claim 8, wherein the second biasing member is a cylindrical polyurethane piece fitted on the small diameter portion.

10. An applicator as defined in claim 8, wherein the second biasing member is a liquid-absorptive cylindrical piece fitted on the small diameter portion of the tip and capable of absorbing application liquid.

* * * * *